US005288553A

United States Patent [19]

Collins et al.

[11] Patent Number: 5,288,553

[45] Date of Patent: Feb. 22, 1994

[54] POLYESTER FINE FILAMENTS

[75] Inventors: Robert J. Collins, Wilmington; Hans R. E. Frankfort, Kinston; Stephen B. Johnson, Wilmington, all of N.C.; Benjamin H. Knox, Wilmington, Del.; Elmer E. Most, Jr., Kinston, N.C.

[73] Assignee: E. I. Du Pont de Nemours and Company, Wilmington, Del.

[21] Appl. No.: 5,672

[22] Filed: Jan. 19, 1993

Related U.S. Application Data

[63] Continuation-in-part of Ser. No. 647,381, Jan. 29, 1991, abandoned, and Ser. No. 860,776, Mar. 29, 1992, abandoned, which is a continuation-in-part of Ser. No. 647,371, Jan. 29, 1991, abandoned.

[51] Int. Cl.[5] ..... D02G 3/00

[52] U.S. Cl. ..... 428/364; 428/397; 428/373; 428/374; 57/243

[58] Field of Search ..... 428/364, 397, 376, 398, 428/401, 373, 374; 264/103, 176 F; 57/243

[56] References Cited

U.S. PATENT DOCUMENTS

| | | | |
|---|---|---|---|
| 2,604,667 | 7/1952 | Hebeler | 18/54 |
| 2,604,689 | 7/1952 | Hebeler | 28/82 |
| 3,771,307 | 11/1973 | Petrille | 57/157 |
| 3,772,872 | 11/1973 | Piazza et al. | 57/140 |
| 4,134,882 | 1/1979 | Frankfort et al. | 528/309 |
| 4,156,071 | 5/1979 | Knox | 528/272 |
| 4,195,051 | 11/1973 | Frankfort et al. | 264/176 |
| 4,233,363 | 11/1980 | Cemel et al. | 428/364 |
| 4,390,685 | 6/1983 | Oka et al. | 528/308.1 |
| 4,929,698 | 5/1990 | Hagewood | 264/177.13 |
| 4,933,427 | 6/1990 | Charles et al. | 264/177.13 |
| 5,043,216 | 8/1991 | Misoo et al. | 428/397 |
| 5,250,245 | 10/1993 | Collins et al. | 264/103 |

*Primary Examiner*—Patrick J. Ryan
*Assistant Examiner*—Patrick R. Jewik

[57] ABSTRACT

Polyester fine filaments having excellent mechanical quality and uniformity, and preferably with a balance of good dyeability and shrinkage, are prepared by a simplified direct spin-orientation process by selection of polymer viscosity and spinning conditions.

12 Claims, 10 Drawing Sheets

RELATIVE DISPERSE DYE RATE (RDDR)$_{1/2}$ %/(min)$^{1/2}$ (NORMALIZED TO 1 DPF)
300
250
200
150
100
50
0
0
.04
.08
.12
.16
.20
BIREFRINGENCE (△n)
( □ SPUN; ● DRAWN)

$V_{f,am} = CS^3 \cdot \left(\frac{1-X}{X}\right)\left(\frac{1-fa}{fa}\right)(Å)^3$
$10^7$
$10^6$
$10^5$
70
80
90
100
110
120
130
140
DYNAMIC LOSS PEAK, T(E"max), °C

POLYESTER FINE FILAMENTS

CROSS-REFERENCE TO RELATED APPLICATION

This application is a continuation-in-part of application Ser. No. 07/647,381 filed Jan. 29, 1991, now abandoned and also of application Ser. No. 07/860,776 filed Mar. 29, 1992, now abandoned as a continuation-in-part of application Ser. No. 07/647,371 filed Jan. 29, 1991, now abandoned.

TECHNICAL FIELD

This invention concerns improvements in, and relating to, polyester fine filaments and their manufacture and use.

BACKGROUND OF THE INVENTION

Historically, synthetic fibers for use in apparel, including polyester fibers, have generally been supplied to the textile industry for use in fabrics and garments with the object of more or less duplicating and/or improving on natural fibers. For many years, commercial synthetic textile filaments, such as were made and used for apparel, were mostly of deniers per filament (dpf) in a similar range to those of the commoner natural fibers; i.e., cotton and wool. More recently, however, polyester filaments have been available commercially in a range of dpf similar to that of natural silk, i.e. of the order of 1 dpf, and even in subdeniers, i.e., less than about 1 dpf, despite the increased cost. Various reasons have been given for the recent commercial interest in such fine filaments, such as of about 1 dpf, or even subdeniers.

Much has been written recently about this increasing interest in fine denier polyester filaments. Very little technical detail has, however, been published about any difficulties in spinning (i.e., extrusion and winding) techniques that have been used, or even would be desirable, for manufacturing such fine filaments, although it has been well understood by those skilled in the art that conventional preparation and handling techniques could not be used for such fine filaments. For instance, in Textile Month, June 1990, pages 40–46, three approaches are discussed for making microfibers; namely, 1) conventional spinning to fine deniers, 2) splitting bicomponent fibers (of higher deniers), and 3) dissolving away a component from bicomponent fibers of higher denier. It will be understood that the 2nd and 3rd approaches involve bicomponent spinning to form filaments first of higher denier, and processing such spun higher denier filaments to obtain the filaments of reduced denier; such processing techniques are not the subject of the present invention.

The present invention is concerned with the preparation of fine filaments by a novel direct spinning/winding process, in contrast with a process of first spinning and winding up bicomponent filaments of higher denier which then must be further processed to obtain the reduced fine denier filaments that are desired for use in textiles. Another 2-stage possibility of manufacturing filaments of reduced denier is to spin filaments of greater than one denier, and then, draw the filaments after the spinning operation, but this possibility has important disadvantages that have been discussed in the art; on the one hand, there are practical limitations to the amount of draw that can be effected; there are also product disadvantages in the properties of drawn yarns, as contrasted with direct spin-oriented yarns; and the cost of such processing (i.e., drawing) has to be considered, especially when the drawing is performed as a separate operation, after first packaging the spun filaments, such as single yarn or warp drawing. Such drawing proposals may have involved conventional drawing techniques, or may have involved other techniques, e.g., aerodynamic effects or reheating the filaments after they have been solidified, but still advancing under sufficient tension to draw (sometimes referred to as space-drawing, if performed without godets of differential speeds). Some direct spinning processes that have been proposed have relied on use of specific polymer compositions, for instance specific viscosities, that have disadvantages, so it would be desirable to use a process that does not require use of special viscosities or other special compositional aspects.

To summarize, previous polyester filament manufacturing techniques that have been disclosed in the art have not been specifically directed to and have not been suitable in practice for producing fine denier polyester filaments by a simple direct spinning/winding operation, or have involved limitations and disadvantages. So it has been desirable to provide such a direct spinning process for manufacturing fine polyester filaments of the desired dpf and properties without such disadvantages. The present invention solves this problem. The filaments of the invention are "spin-oriented", the significance of which is discussed hereinafter.

PRIOR ART

Commercial polyester filaments were made initially by "split" processes that involved a separate drawing stage after spinning and winding undrawn filaments. In the 1950's, Hebeler suggested in U.S. Pat. Nos. 2,604,667 and 2,604,689, the possibilities of high speed spinning of polyester melts. In the 1970's, high speed spinning of polyester melts, as described by Petrille in U.S. Pat. No. 3,771,307 and by Piazza and Reese in U.S. Pat. No. 3,772,872, were made the basis of a process for preparing spin-oriented yarns that have been used as draw-texturing feed yarns. High speed spinning of polyester melts has also been the basis of other processes that were first disclosed in the 1970's, such as Knox in U.S. Pat. No. 4,156,071, and Frankfort and Knox in U. S. Pat. Nos. 4,134,882, and 4,195,051.

Frankfort and Knox discussed polyester filaments of enhanced dyeability and low boil-off shrinkage (less than 4%, even in as-spun condition, and accompanied by good thermal stability over a large temperature range, as shown, e.g., by a dry heat shrinkage measured at 160 C. being no more than 1% more than the boil-off shrinkage), prepared by spinning at speeds of over 5 km/min, and characterized by a long period spacing above 300 Å in as-spun condition, crystal sizes greater than 55 Å, preferably greater than 70 Å and no less than (1250 $\rho$-1670)Å, where $\rho$ is the density, and a low skin-core value, as measured by a differential birefringence ($\Delta_{95-5}$) between the surface and the core of the filament of less than about $0.0055+0.0014\delta_{20}$, where $\delta_{20}$ is the stress measured at 20% extension and is at least about 1.6 gpd.

Knox disclosed polyester filaments spun at lower speeds of about 4 km/min to provide physical properties and dyeability that are unusual for polyester, being more akin to those of cellulose acetate than of conventional polyester filaments, including a low modulus of 30–65 g/d.

There are fundamental differences in fine structure and properties between filaments that are spin-oriented, indicating orientation of the polyester molecules obtained from the (high speed) spinning, and drawn filaments, indicating orientation derived from drawing of the filaments as an entirely separate process, after winding the spun filaments, or even as a continuous process, before winding, but after cooling the melt to form solid filaments before drawing such filaments.

Frankfort and Knox did not teach how to spin fine filaments at their high speeds. The lowest dpf specifically taught by Frankfort and Knox was in Example 42, at about 3 dpf, which is much higher than is now desired.

An object of the presnt invention is to provide filaments that are fine and have the characteristic of being spin-oriented.

SUMMARY OF THE INVENTION

Several aspects and embodiments are provided according to the present invention as follows:

1) a process for preparing spin-oriented polyester fine filaments;
2) spin-oriented polyester fine filaments with deniers about 1 or less, having enhanced mechanical quality and denier uniformity making these filaments especially suitable for high speed textile processing;
3) spin-oriented polyester fine filaments, especially suitable for use as draw feed yarns in high speed texturing, crimping, and warping processes;
4) spin-oriented polyester fine filaments, especially suitable for use as direct-use textile yarns, without need for additional draw or heat treatments, in critically dyed flat woven and knit fabrics; for use as feed yarns for air-jet texturing and stuffer-box crimping, wherein no draw is required; and may be uniformly cold drawn, if desired, to prepare warp yarns of higher shrinkage with dye uniformity suitable for critially dyed end-uses;
5) drawn spin-oriented polyester fine filaments, especially suitable for use as textile yarns in critically dyed flat woven and knit fabrics; and processes for preparing these drawn fine filament yarns;
6) bulked polyester fine filament yarns capable of being dyed uniformly under atmospheric conditions without the use of carriers; and a process for preparing these bulked fine filament yarns;
7) mixed filament yarns, wherein the fine filaments are of this invention; and especially mixed filament yarns, wherein, all filaments are of this invention, but differ in denier, cross-section, and/or shrinkage potential.

In particular according to the present invention, the following are provided:

A process for preparing spin-oriented polyester fine filaments, wherein, (i) the polyester polymer is selected to have a relative viscosity (LRV) in the range of about 13 to about 23, a zero-shear melting point ($T_M^o$) in the range of about 240° C. to about 265° C., and a glass transition temperature ($T_g$) in the range of about 40° C. to about 80° C;
(ii) said polyester is melted and heated to a temperature ($T_P$) in the range of about 25° C. to about 55° C., preferably in the range of about 30° C. to about 50° C., above the apparent polymer melting point $(T_M)_a$;
(iii) the resulting melt is filtered sufficiently rapidly that the residence time ($t_r$) at polymer melt temperature ($T_P$) is less than about 4 minutes;
(iv) the filtered melt is extruded through a spinneret capillary at a mass flow rate (w) in the range about 0.07 to about 0.7 grams per minute (g/min), and the capillary is selected to have a cross-sectional area ($A_c$) in the range about $125\times10^{-6}$ cm$^2$ (19.4 mils$^2$) to about $1250\times10^{-6}$ cm$^2$ (194 mils$^2$) preferably in the range of about $125\times10^{-6}$ cm$^2$ (19.4 mils$^2$) to about $750\times10^{-6}$ cm$^2$ (116.3 mils$^2$) and a length (L) and diameter ($D_{RND}$) such that the ($L/D_{RND}$)-ratio is at least about 1.25 and preferably less than about 6, and especially less than about 4;
(v) protecting the extruded melt from direct cooling as it emerges from the spinneret capillary over a distance ($L_{DQ}$) of at least about 2 cm and less than about ($12\sqrt{dpf}$)cm, where dpf is the denier per filament of the spin-oriented polyester fine filament, preferably in the range of about 1 to about 0.2 dpf, more desirably in the range of about 0.8 to about 0.2 dpf, and especially in the range of about 0.6 to about 0.2 dpf; and desirably an average along-end denier spread (DS) less than about 4%, and preferably less than about 3%, and especially less than about 2%;
(vi) cooling the attenuating spinline to below the polymer glass-transition temperature ($T_g$), preferably by radially directed air having a temperature ($T_a$) less than about the polymer $T_g$ and a velocity ($V_a$) in the range of about 10 to about 30 meters per minute (m/min);
(vii) attenuating to an apparent spinline strain ($\epsilon_a$) in the range of about 5.7 to about 7.6, and to an apparent internal spinline stress ($\sigma_a$) in the range of about 0.045 to about 0.195 grams per denier (g/d), preferably in the range of about 0.045 to about 0.105 g/d for preparing filaments especially suitable for draw feed yarns, characterized by a tenacity-at-7%-elongation ($T_7$) in the range of about 0.5 to about 1 g/d; and to an apparent internal spinline stress ($\sigma_a$) preferably in the range of about 0.105 to about 0.195 g/d for preparing filaments especially suitable for direct-use yarns, characterized by a tenacity-at-7%-elongation ($T_7$) in the range of about 1 to about 1.75 g/d;
(viii) converging the cooled and attenuated filaments into a multifilament bundle by use of a low friction surface at a distance ($L_c$) in the range about 50 cm to about 140 cm, preferably in the range of about 50 cm to about ($50+90\sqrt{dpf}$)cm; and
(ix) winding up the multifilament bundle at a withdrawal speed (V) in the range of about 2 to about 6 kilometers per minute (km/min), preferably in the range of about 2 to about 5 km/min, and especially in the range of about 2.5 to about 5 km/min;

Also, according the present invention the following spin-oriented polyester fine filaments, and products there from, are provided:

Spin-oriented polyester fine filaments of denier per filament (dpf) about 1 or less, preferably in the range of about 0.8 to about 0.2 dpf, wherein, said polyester is characterized by having a relative viscosity (LRV) in the range of about 13 to about 23, a zero-shear polymer melting point ($T_M^o$) in the range of about 240° C. to about 265° C., and a glass-transition temperature ($T_g$) in the range of about 40° C. to about 80° C.; and said fine filaments are further characterized by:

(i) boil-off shrinkage (S) less than about the maximum shrinkage potential ($S_m$), wherein $S_m=[(550-E_B)/6.5]$, % and the percent elongation-to-break ($E_B$) is in the range about 40% to about 160%;

(ii) maximum shrinkage tension, ($ST_{max}$), in the range about 0.05 to about 0.2 g/d, with a peak temperature $T(ST_{max})$, in the range about 5° C. to about 30° C. above the polymer glass-transition temperature ($T_g$);

(iii) a tenacity-at-7%-elongation ($T_7$) in the range of about 0.5 to about 1.75 g/d, and such that the $[(T_B)_n/T_7]$-ratio is of at least about ($5/T_7$) and preferably at least about ($6/T_7$); wherein, $(T_B)_n$ is the tenacity-at-break normalized to a reference LRV of 20.8 and % delusterant (such as $TiO_2$) of 0%;

(iv) desirably an average along-end denier spread (DS) of less than about 4%, preferably less than about 3%, and especially less than about 2%.

Spin-oriented fine filaments, especially suitable for use as draw feed yarns (DFY), characterized by a boil-off shrinkage (S) at least about 12%, an elongation-at-break ($E_B$) in the range about 80% to about 160%, a tenacity-at-7%-elongation ($T_7$) in the range about 0.5 to about 1 g/d.

Spin-oriented fine filaments, especially suitable for use as direct-use yarns (DUY), characterized by a shrinkage differential ($\Delta S=DHS-S$) less than about +2%, wherein, boil-off shrinkage (S) and dry heat shrinkage (DHS) are in the range of about 2% to about 12%, such that the filament denier after boil-off shrinkage, dpf(ABO), is about 1 or less and preferably in the range of about 1 to about 0.2 dpf, and more preferably in the range of about 0.8 to about 0.2 dpf; a tenacity-at-7%-elongation ($T_7$) in the range of about 1 to about 1.75 g/d; an elongation-at-break ($E_B$) in the range of about 40% to about 90%, and a post-yield modulus ($M_{py}$) in the range of about 2 to about 12 g/d;

Spin-oriented fine filaments having the capability of being uniformly cold drawn, characterized by a shrinkage differential ($\Delta S=DHS-S$) less than about +2%, wherein, boil-off shrinkage (S) and dry heat shrinkage (DHS) are in the range of about 2% to about 12%, an onset of cold crystallization, $T_{cc}$(DSC), of less than about 105° C. and an instantaneous tensile modulus ($M_i$) at least about 0.

Drawn spin-oriented polyester fine filaments with deniers after boil-off shrinkage, dpf(ABO), in the range of about 1 or less, preferably in the range of about 0.8 to about 0.2 dpf, wherein, said drawn filaments are further characterized by:

(i) boil-off shrinkage (S) and dry heat shrinkage (DHS) in the range of about 2% to about 12%;

(ii) a tenacity-at-7%-elongation ($T_7$) of at least about 1 g/d, such that the $[(T_B)_n/T_7]$-ratio is at least about ($5/T_7$); preferably at least about ($6/T_7$), wherein, $(T_B)_n$ is the tenacity-at-break normalized to a reference LRV of 20.8 and percent delusterant (such as $TiO_2$) of 0%; and an elongation-at-break ($E_B$) in the range of about 15% to about 55%;

(iii) a post-yield modulus ($M_{py}$), preferably in the range about 5 to about 25 g/d;

(iv) desirably an average denier spread (DS) less than about 4%, preferably less than about 3%, especially less than about 2%.

Bulked spin-oriented polyester fine filaments of denier after boil-off shrinkage, dpf (ABO), in the range of about 1 to about 0.2 dpf, preferably 0.8 to about 0.2 dpf, wherein, said bulked filaments are further characterized by a boil-off shrinkage (S) and dry heat shrinkage (DHS) in the range about 2% to about 12%, an elongation-at-break ($E_B$) in the of range about 15% to about 55%, a tenacity-at-7%-elongation ($T_7$) at least about 1 g/d, and preferably with a post-yield modulus ($M_{py}$) in the range about 5 to about 25 g/d and a relative disperse dye rate (RDDR), normalized to 1 dpf, of at least about 0.1.

Mixed filament yarns, wherein the fine filaments are of this invention; and especially mixed filament yarns, wherein, all filaments are of this invention, but differ in denier, cross-section, and/or shrinkage potential.

Preferred such spin-oriented, bulked and drawn flat filaments are capable of being dyed with cationic dyestuffs, on account of containing in the range of about 1 to about 3 mole % of ethylene-5-M-sulfo-isophthalate structural units, where M is an alkali metal cation, such sodium or lithium.

Especially preferred such spin-oriented, bulked, and drawn flat filaments capable of being disperse dyed uniformly under atmospheric conditions without carriers, are characterized by a dynamic loss modulus peak temperature $T(E''_{max})$ of less than about 115° C., preferably less than about 110° C.; and are of polyester polymer, essentially poly(ethylene terephthalate), composed of first alternating hydrocarbylenedioxy structural units A, [—O—$C_2H_4$—O—], and hydrocarbylenedicarbonyl structural units B, [—C(O)—$C_6H_4$—C(O)—], modified with minor amounts of other hydrocarby-lenedioxy structural units A' and/or hydrocarbylenedicarbonyl structural units B', that are different from the first structural units, such as to provide a polyester polymer with a zero-shear melting point ($T_M^o$) in the range about 240° C. to about 265° C. and a glass-transition temperature ($T_g$) in the range of about 40° C. to about 80° C.

The filaments of the present invention may be nonround for enhanced tactile and visual aesthetics, and comfort, where said nonround filaments have a shape factor (SF) at least about 1.25, wherein the shape factor (SF) is defined by the ratio of the measured filament perimeter ($P_M$) and the calculated perimeter ($P_{RND}$) for a round filament of equivalent cross-sectional area. Hollow filaments may be spun via post-coalescence from segmented spinneret capillary orifices to provide lighter weight fabrics with greater bulk and filament bending modulus for improved fabric drape.

Further aspects and embodiments of the invention will appear herein.

DETAILED DESCRIPTION OF THE INVENTION

Polyester Polymer

Figure 1:
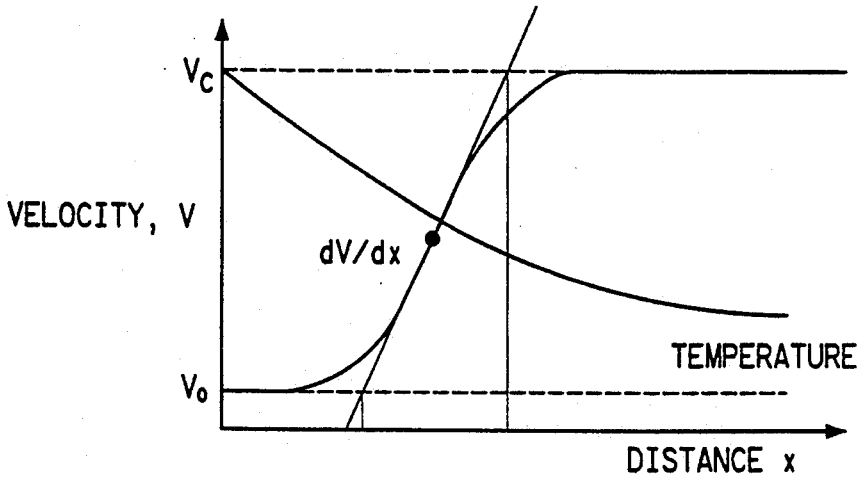
FIG. 1 is a graphical representation of spinline velocity (V) plotted versus distance (x) where the spin speed increases from the velocity at extrusion ($V_o$) to the final (withdrawal) velocity after having completed attenuation (typically measured downstream at the point of convergence, $V_c$); wherein, the apparent internal spinline stress ($\sigma_a$) is taken as being proportional to the product of the spinline viscosity at the neck point $(\eta)_N$, (i.e., herein found to be approximately proportional to about the ratio $LRV/T_p^6$, where $T_P$ is expressed in ° C.), and the velocity gradient at the neck point (dV/dx), (herein found to be approximately proportional to about $V^2$/dpf, especially over the spin speed range of about 2 to 4 km/min and proportional to about $V^{3/2}$/dpf at higher spin speeds, e.g., in the range of about 4 to 6 km/min). The spin line temperature is also plotted versus spinline distance (x) and is observed to decrease uniformly with distance as compared to the sharp rise in spinline velocity at the neck point.
Figure 2:
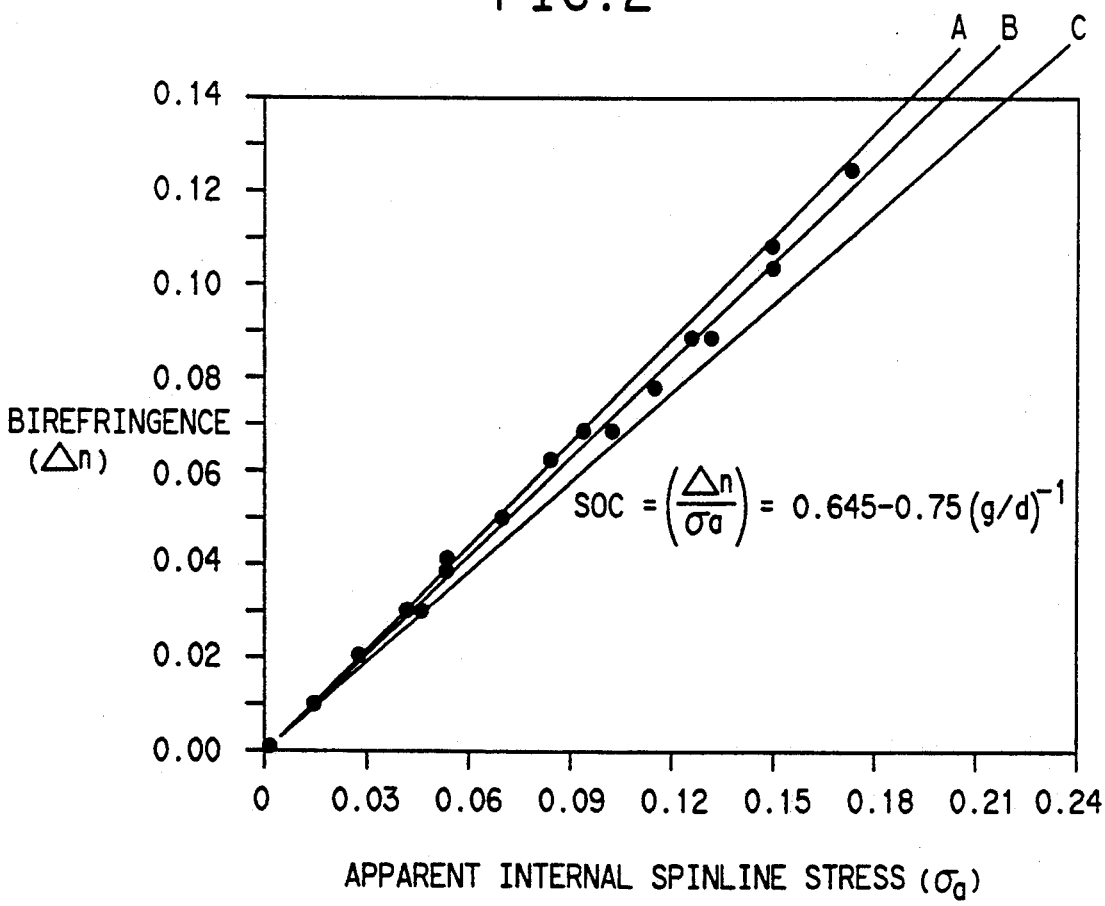
FIG. 2 is a graphical representation of the birefringence ($\Delta_n$) of the spin-oriented filaments versus the apparent internal spinline stress $(\sigma)_a$; wherein the slope is referred to as the "stress-optical coefficient, SOC" and Lines A, B, and C have SOC values of 0.75, 0.71, and 0.645 $(g/d)^{-1}$, respectively; with an average SOC of about 0.7; and wherein Lines A and C are typical relationships found in literature for 2GT polyester. The values of the apparent internal spinline stress ($\sigma_a$) agree well with values found in literature.
Figure 3:
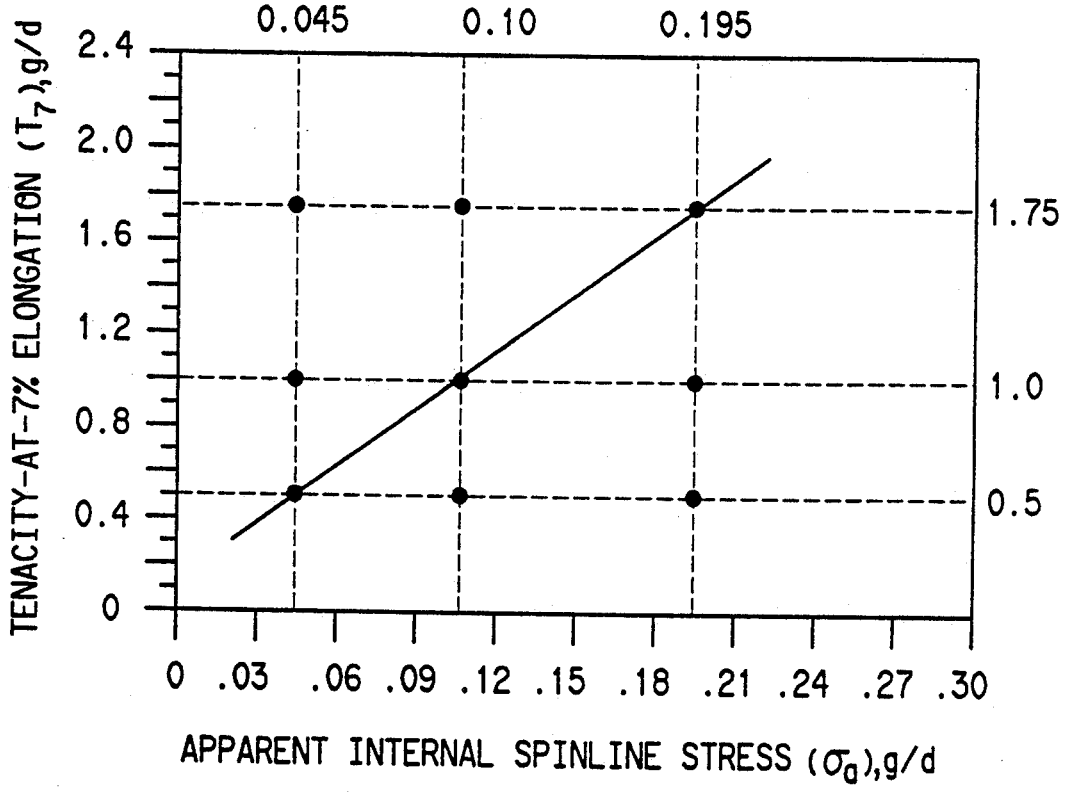
FIG. 3 is a graphical representation of the tenacity-at-7%-elongation ($T_7$) of the spin-oriented filaments versus the apparent internal spinline stress ($\sigma_a$). The near linear relationship of birefringence ($\Delta_n$) and $T_7$ versus the apparent internal spinline stress ($\sigma_a$), as shown in FIGS. 2 and 3, permits the use of $T_7$ as a useful parameter being representative of the filament average orientation. Birefringence ($\Delta_n$) is typically very difficult structural parameter to measure for fine filaments with deniers less than 1.
Figure 4:
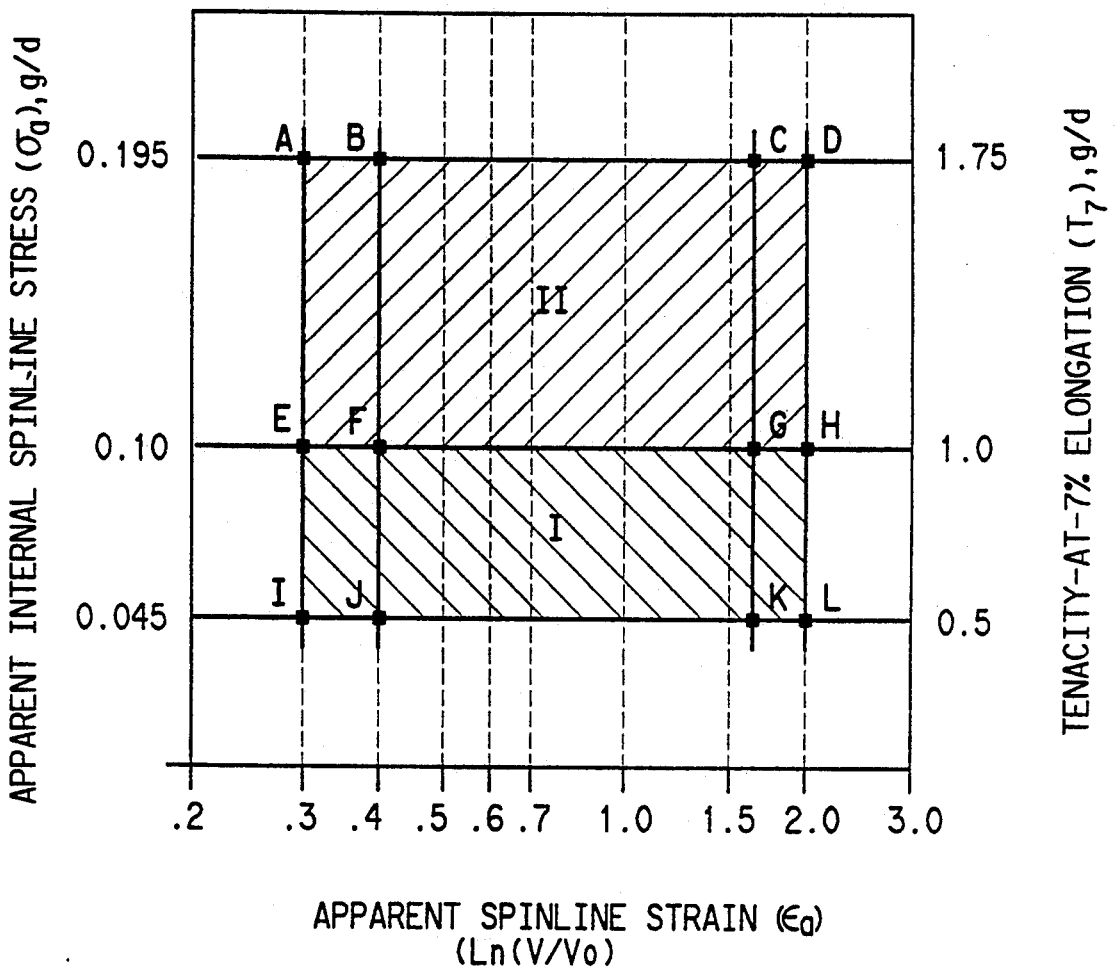
FIG. 4 is a graphical representation of the preferred values of the apparent internal spinline stress ($\sigma_a$) and the spin-oriented filament yarn tenacity-at-7%-elongation ($T_7$) plotted versus the apparent spinline strain ($\epsilon_a$) which is derived from the spin line extension ratio $E_R$ ($=V/V_o$) on a natural logarithm scale (where $E_R$-values of 200 and 2000, for example, are expressed on the x-axis as 0.2 and 2; i.e., $E_R/1000$); thus the natural logarithm $\ln(E_R)$ is called herein the apparent spinline strain ($\epsilon_a$); V is the final (withdrawal) spinline velocity and $V_o$ is the capillary extrusion velocity. The process of the invention is described by the enclosed region ADLI with region ADHE (II) preferred for preparing direct-use filaments and region EHLI (I) preferred for preparing draw feed yarns. Especially preferred processes are represented by regions BCGF and FGKJ.

The polyester polymer used for preparing spin-oriented filaments of the invention is selected to have a relative viscosity (LRV) in the range about 13 to about 23, a zero-shear melting point ($T_M^o$) in the range about 240° C. to about 265° C.; and a glass-transition temperature ($T_g$) in the range about 40° C. to about 80° C. (wherein $T_M^o$ and $T_g$ are measured from the second DSC heating cycle under nitrogen gas at a heating rate of 20° C. per minute). The said polyester polymer is a linear condensation polymer composed of alternating A and B structural units, where the As are hydrocarbylenedioxy units of the form [—O—R'—O—] and the Bs are hydrocarbylenedicarbonyl units of the form [—C(O)—R''—C(O)—], wherein R' is primarily [—$C_2H_4$—], as in the ethylenedioxy (glycol) unit [—O—$C_2H_4$—O—], and R'' is primarily [—$C_6H_4$—], as in the 1,4-benzenedicarbonyl unit [—C(O)—$C_6H_4$—C(O)—], such to provide, for example, at least about 85 percent of the recurring structural units as ethylene terephthalate, [—O—$C_2H_4$—O—C(O)—$C_6H_4$—C(O)—].

Suitable poly(ethylene terephthalate), herein denoted as PET or 2GT, based polymer may be formed by a DMT-process, e.g., as described by H. Ludewig in his book "Polyester Fibers, Chemistry and Technology", John Wiley and Sons Limited (1971), or by a TPA-process, e.g., as described in Edging U.S. Pat. No. 4,110,316. Included are also copolyesters in which, for example, up to about 15 percent of the hydrocarbolenedioxy and/or hydrocarbolenedicarbonyl units are replaced with different hydrocarbolenedioxy and hydrocarbolenedicarbonyl units to provide enhanced low temperature disperse dyeability, comfort, and aesthetic properties. Suitable replacement units are disclosed, e.g., in Most U.S. Pat. No. 4,444,710 (Example VI), Pacofsky U.S. Pat. No. 3,748,844 (Col. 4), and Hancock, et al. U.S. Pat. No. 4,639,347 (Col. 3).

The polyester polymer may also be modified with ionic dye sites, such as ethylene-5-M-sulfo-isophthalate residues, where M is an alkali metal cation, such as sodium or lithium; for example, in the range of 1 to about 3 mole percent ethylene-5-sodium-sulfo-isophthalate residues may be added to provide dyeability of the polyester filaments with cationic dyestuffs, as disclosed by Griffing and Remington U.S. Pat. No. 3,018,272, Hagewood et al in U.S. Pat. No. 4,929,698, Duncan and Scrivener U.S. Pat. No. 4,041,689 (Ex. VI), and Piazza and Reese U.S. Pat. No. 3,772,872 (Ex. VII). To adjust the dyeability or other properties of the spin-oriented filaments and the drawn filaments therefrom, some diethylene glycol (DEG) may be added to the polyester polymer as disclosed by Bosley and Duncan U.S. Pat. No. 4,025,592 and in combination with chain-branching agents as described in Goodley and Taylor U.S. Pat. No. 4,945,151.

Process for Preparing Polyester Fine Filaments

According to the present invention there is provided a process for preparing spin-oriented polyester filaments having a fineness, for example, in the range of about 1 to about 0.2 denier per filament (dpf), preferably in the range about 0.8 to about 0.2 denier per filament (dpf);

(a) by melting and heating said polyester polymer, as described herein before, to a temperature ($T_P$) in the range of about 25° C. to about 55° C., preferably in the range of about 30° C. to about 50° C., above the apparent melting temperature $(T_M)_a$, wherein, $(T_M)_a$ is greater than the zero-shear melting temperature ($T_M^o$) as a result of the shearing action of the polymer during extrusion and is defined, herein, by:

$$(T_M)_a=[T_M^o+2\times10^{-4}(L/D_{RND})G_a],$$

where L is the length of the capillary and $D_{RND}$ is the capillary diameter for a round capillary, or for a non-round capillary, wherein $D_{RND}$ is the calculated equivalent diameter of a round capillary of equal cross-section area $A_c$ ($cm^2$); and $G_a$ ($sec^{-1}$) is the apparent capillary shear rate, defined herein after;

(b) filtering the resulting polymer melt through inert medium, such as described by Phillips in U.S. Pat. No. 3,965,010, in a pack cavity (similar to that illustrated in FIG. 2-31 of Jamieson U.S. Pat. No. 3,249,669), sufficiently rapidly that the residence time ($t_r$) is less than about 4 minutes, wherein, $t_r$ is defined by ratio ($V_F/Q$) of the free-volume ($V_F$, $cm^3$) of the filter cavity (filled with the inert filtration medium) and the polymer melt volume flow rate (Q, $cm^3$/min) through the filter cavity. The polymer melt volume flow rate (Q) through the filter cavity is defined by the product of the capillary mass flow rate (w, g/min) and the number of capillaries ($\#_c$) per cavity divided by the melt density (herein taken to be about 1.2195 g/$cm^3$); that is, $Q=\#_c w/1.2195$. The free-volume ($V_F$, $cm^3$) of the filter cavity (filled with the inert filtration medium) is experimentally determined by standard liquid displacement techniques using a low surface tension liquid, such as ethanol. By replacing the capillary mass flow rate (w), by its equivalent $w=[(dpf\ V)/9]$, (where V is the withdrawal spin speed expressed as km/min), in above expression for the melt residence time $t_r$, it is found that the residence time $t_r$ decreases with increasing filament denier, withdrawal speed (V) and number of filaments ($\#_c$) per filter cavity, and decreases with a reduction in the filter cavity free-volume ($V_F$). The cavity free-volume ($V_F$) may be decreased by altering the pack cavity dimensions and by utilizing inert material which provides sufficient filtration capabilities with less free-volume. The number of filaments (i.e., capillaries) per filter cavity ($\#_c$) may be increased for a given yarn count by extruding more than one multifilament bundle from a single filter cavity, that is, spinning a larger number of filaments and then splitting (herein, called multi-ending) the filament bundle into smaller filament bundles of desired yarn denier, preferably by using metered finish tip separator guides positioned between about 50 cm to about $(50+90\sqrt{dpf})$cm;

(c) the filtered polymer melt is extruded through a spinneret capillary at a mass flow rate (w) in the range of about 0.07 to about 0.7 grams per minute (g/min) and the capillary is selected to have a cross-sectional area, $A_c=(\pi/4)D_{RND}^2$, in the range of about $125\times10^{-6}$ $cm^2$ (19.4 $mils^2$) to about $1250\times10^{-6}$ $cm^2$ (194 $mils^2$), preferably in the range of about $125\times10^{-6}$ $cm^2$ (19.4 $mils^2$) to about $750\times10^{-6}$ $cm^2$ (116 $mils^2$), and a length (L) and diameter ($D_{RND}$) such that the $L/D_{RND}$-ratio is in the range of about 1.25 to about 6, preferably in the range of about 1.25 to about 4; wherein, $$G_a(sec^{-1})=[(32/60\pi)(w/\rho)/D_{RND}^3],$$

and w is the capillary mass flow rate (g/min), $\rho$ is the polyester melt density (taken as 1.2195 g/$cm^3$), and $D_{RND}$ is the capillary diameter (defined herein before) in centimeters (cm);

(d) protecting the freshly extruded polymer melt from direct cooling, as it emerges from the spinneret capillary over a distance $L_{DQ}$ of at least about 2 cm and less than about (12√ dpf)cm, where dpf is the denier per filament of the spin-oriented polyester fine filament;

(e) carefully cooling the extruded melt to below the polymer glass-transition temperature ($T_g$), wherein said cooling may be achieved by use of laminar cross-flow quench fitted with a delay tube (e.g., as described in Makansi U.S. Pat. No. 4,529,368), and preferably by radially directed air (e.g., as described in Dauchert U.S. Pat. No. 3,067,458), wherein the temperature ($T_a$) of the quench air is less than about $T_g$ and the velocity ($V_a$) of the quench air is in the range of about 10 to about 30 m/min;

f) while attenuating the cooled melt to an apparent spinline strain ($\epsilon_a$) in the range of about 5.7 to about 7.6, preferably in the range of about 6 to about 7.3, wherein the apparent spinline strain $\epsilon_a$ is defined as the natural logarithm (ln) of the spinline extension ratio ($E_R$), and $E_R$ is the ratio of the withdrawal speed (V) and the capillary extrusion speed ($V_o$); that is, for $D_{RND}$ in centimeters, $\epsilon_a$ is given by:

$$ln(E_R)=ln(V/V_o)=ln[(2.25\times10^5\pi\rho)(D_{RND}^2/dpf)];$$

g) providing during attenuation the development of an apparent internal spinline stress ($\sigma_a$) in the range of about 0.045 to about 0.195 g/d, preferably in the range of about 0.045 to about 0.105 g/d for preparing spin-oriented filaments, especially suitable for draw feed yarns (DFY), characterized with tenacity-at-7%-elongation ($T_7$) values in the range of about 0.5 to about 1 g/d, and preferably an apparent internal spinline stress ($\sigma_a$) in the range of about 0.105 to about 0.195 g/d for preparing spin-oriented filaments especially suitable for direct-use yarns (DUY), characterized by tenacity-at-7%-elongation ($T_7$) in the range of about 1 to about 1.75 g/d; wherein, the apparent internal spinline stress ($\sigma_a$) is defined herein by the product of the apparent viscosity of the attenuating melt ($\eta_m$) and the spinline velocity gradient (dV/dx) at the point that attenuation is essentially complete (herein referred to as the 'neck-point'; and the apparent internal spinline stress ($\sigma_a$) is found to increase with increasing polymer LRV and withdrawal speed (V) and to decrease with increasing filament dpf, number of filaments ($\#_c$) for a given spinneret surface area ($A_o$ cm$^2$) and polymer temperature ($T_p$); and herein is expressed by an empirical analytical relationship of the form:

$$(\sigma_a)=k(LRV/LRV_{20.8})(T_R/T_P)^6(V^2/dpf)(A_o/\#_c)^{0.7},$$

wherein k has an approximate value of (0.01/SOC) for spin-oriented filaments of density in the range of about 1.345 to about 1.385 g/cm$^3$, that is about 1.36 g/cm$^3$ and SOC is the "stress-optical coefficient" for the polyester polymer (e.g., about 0.7 in reciprocal g/d for 2GT homopolymer); $T_R$ is the polymer reference temperature defined by ($T_M^o$+40° C.) where $T_M^o$ is the zero-shear (DSC) polymer melting point; $T_P$ is the polymer melt spin temperature, ° C.; V is the withdrawal speed expressed in km/min; $\#_c$ is the number of filaments (i.e., capillaries) for a given extrusion surface, $A_o$, expressed as $\#_c$/cm$^2$; LRV is the measured polymer (lab) viscosity and $LRV_{20.8}$ is the corresponding reference LRV-value (where LRV is defined herein after) of the polyester polymer having the same zero-shear "Newtonian" melt viscosity ($\eta_o$) at 295° C. as that of 2GT homopolymer having an LRV-value of 20.8 (e.g., cationic-dyeable polyester of 15 LRV is found to have a melt viscosity as indicated by capillary pressure drop in the range of 2GT homopolymer of about 20 LRV and thereby a preferred reference LRV for such modified polymers is about 15.5 and is determined experimentally from standard capillary pressure drop measurements);

(h) converging the cooled and fully attenuated filaments into a multifilament bundle by use of a low friction surface, (that is, in a manner that does not abrade nor snub the filaments), such as by a finish roll, and preferably by a metered finish tip applicator (e.g., as described in Agers U.S. Pat. No. 4,926,661), at a distance ($L_c$) from the face of the spinneret in the range of about 50 cm to about 140 cm, preferably in the range of about 50 cm to about (50+90√ dpf)cm, wherein the finish is usually an aqueous emulsion of about 5% to about 20% by weight solids and finish-on-yarn is about 0.4% to about 2% by weight solids, depending on the end-use processing requirements;

(i) interlacing the filament bundle using an air jet, essentially as described, e.g., by Bunting and Nelson in U.S. Pat. No. 2,985,995 and by Gray in U.S. Pat. No. 3,563,021, wherein, the degree of interfilament entanglement (herein referred to as rapid pin count RPC, as measured, for example, according to Hitt in U.S. Pat. No. 3,290,932) is selected based on yarn packaging and end-use requirements;

(j) winding up the multifilament bundle at a withdrawal speed (V), herein defined as the surface speed of the first driven roll, in the range of about 2 to about 6 km/min, preferably in the range of about 2 to about 5 km/min, and especially in the range of about 2.5 to about 4.5 km/min; wherein the retractive forces from aerodynamic drag are reduced by relaxing the spinline between the first driven roll and the windup roll by overfeeding in the range of about 0.5 to about 5%, without the application of heat (except for use of heated interlace jet fluid (such as heated air or water-saturated air) for preventing finish deposits forming on the interlace jet surfaces as described, e.g., by Harris in U.S. Pat. No. 4,932,109.

The polyester fine filaments of this invention are manufactured by a simplified direct spin-orientation (SDSO) process which need not incorporate drawing or heat treatment, and thereby can provide a preferred balance of shrinkage and dyeability behavior making the polyester fine filaments of the invention especially suitable for replacement of natural continuous filaments, such as silk. By careful selection of SDSO process parameters, fine filaments with excellent mechanical quality and uniformity are made; such that the fine filaments, having shrinkages less than about 12%, may be used in multifilament direct-use yarns (DUY) and processed without forming broken filaments in high speed weaving and knitting; and filaments, having shrinkages preferably greater than about 12%, may be used in multifilament draw-feed yarns (DFY) in high speed textile draw processes, such as friction-twist texturing, air-jet texturing, stuffer-box crimping and warp-drawing, without forming broken filaments.

Polyester Fine Filaments and Yarns

The fine filaments of this invention are characterized by having excellent mechanical quality permitting yarns made from these filaments to be used in high speed textile processes, such as draw false-twist and air-jet texturing, warp drawing, draw gear and stuffer-box crimping, and air and water jet weaving and warp knitting, without broken filaments. The filaments of this invention are further characterized by having excellent denier uniformity (as defined herein by along-end denier spread, DS) permitting use in critically dyed fabrics. These characteristics have been achieved despite spinning to much finer deniers (dpf) than those taught by Franklin and Knox. We have devised different process techniques herein specifically for spinning these fine denier filaments at high speeds. Our speeds, however, have not, so far, been as high as those taught by Frankfort and Knox. Our filaments also differ from those taught by Frankfort and Knox, apart from the lower dpf. For example, our filaments do not have the same crystal arrangement, and do not have LPS values as high as even 300 Å. The filaments of this invention may be used as filaments in draw feed yarns (and tows), preferably filaments having boil-off shrinkage (S) and dry heat shrinkage (DHS) greater than about 12% are especially suitable for draw feed yarns; and filaments of this invention, having shrinkages less than about 12%, are especially suitable flat untextured multifilament yarns, and as yarns for such texturing processes as air-jet texturing, gear crimping, and stuffer-box crimping, wherein, no draw need be taken, and the flat and textured filaments of this invention may be cut into staple fibers and flock; but the filaments with shrinkages less than about 12% may be uniformly cold drawn as described by Knox and Noe in U.S. Pat. No. 5,066,447.

In contrast to the polyester fine filaments prepared according to the invention, fine filaments made by such spinning technologies, which incorporate, for example, aerodynamic or mechanical draw and/or heat treatment steps for the reduction in filament denier and/or for the increase in molecular orientation and/or crystallinity, which are generally characterized by: 1) high shrinkage tension ($ST_{max}$) greater than about 0.2 g/d; 2) peak shrinkage tension occurring at temperatures, $T(ST_{max})$, greater than about 100° C. (i.e., greater than atmospheric dyeing temperatures); 3) dry heat shrinkage (DHS) which increases with treatment temperature over the normal textile dyeing and finishing temperature range of about 100° C. to about 180° C. (that is, having a $d(DHS)/dT>0$ for $T=100°$ C. to 180° C.) and a differential shrinkage, ($\Delta S=DHS-S$), greater than about +2%, where S is the boil-off shrinkage and DHS is the dry heat shrinkage, and thereby requiring high temperature treatments of the polyester fine filaments, or textile products made therefrom, prior to, or after dyeing, to impart sufficient thermal dimensional stability to the textile fabrics made from these fine filaments; and 4) inferior dyeability, requiring dyeing under pressure at high temperatures with chemical dye assists, called carriers, to achieve deep shades and uniform dyed fabrics.

In particular, according to the present invention, there are provided:

1. Spin-oriented polyester fine filaments of about 1 dpf or less, preferably less than about 0.8 dpf, especially less than about 0.6 dpf, and greater than about 0.2 dpf; wherein said polyester is of relative viscosity (LRV) in the range of about 13 to about 23, with a zero-shear polymer melt temperature ($T_M^o$) in the range of about 240° C. to about 265° C., and polymer glass transition temperature ($T_g$) in the range of about 40° C. to about 80° C.; and said filaments are further characterized by:

(a) a shrinkage differential, ($\Delta S=DHS-S$), less than about +2%, preferably less than about +1%, and especially less than about 0%; wherein , S is boil-off shrinkage and DHS is dry heat shrinkage measured at 180° C., (b) a maximum shrinkage tension, ($ST_{max}$), between about 0.05 and about 0.2 g/d, with the peak temperature of maximum shrinkage tension, $T(ST_{max})$, between about ($T_g+5°$ C.) and about ($T_g+30°$ C.); i.e., between about 75° C. and about 100° C. for poly(ethylene terephthalate) with a polymer $T_g$ of about 70° C.;

(c) a tenacity-at-7%-elongation ($T_7$) in the range of about 0.5 to about 1.75 g/d and a $[(T_B)_n/T_7])$-ratio at least about ($5/T_7$); preferably at least about ($6/T_7$), wherein, $(T_B)_n$ is the tenacity-at-break normalized to a reference LRV of 20.8 and percent delusterant (such as $TiO_2$) of 0%, defined by: $(T_B)_n=(T_B)[(20.8/LRV)^{0.75}(1-X)^{-4}]$; where tenacity-at-break, $(T_B)=T(1+E_B/100)$; $E_B$, the percent elongation-at-break, is between about 40% and about 160%, preferably about 60% to about 160%; X is the fractional weight of delusterant (i.e., %/100); and T is the tenacity defined as breaking load (grams) divided by original undrawn denier;

(e) an average along-end denier spread (DS) of less than about 4%, preferably less than about 3%, and especially less than 2%.

2. Spin-oriented fine filaments, especially suitable as use as draw feed yarns (DFY), such as for high speed draw false-twist and air jet texturing, draw warping, draw crimping and stuffer-box texturing, wherein, said filaments are further characterized by:

(a) boil-off shrinkage (S) and dry heat shrinkage (DHS) greater than about 12% and less than about the maximum shrinkage potential, ($S_M=[(550-E_B)/6.5]$)%, and for elongation-at-break ($E_B$) in the range of about 80% to about 160%;

(b) tenacity-at-7% elongation ($T_7$) in the range of about 0.5 to about 1 g/d.

Figure 5:
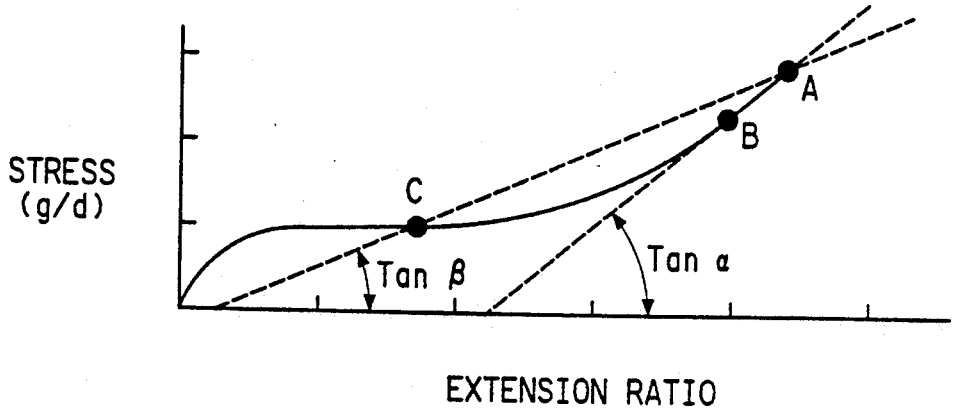
FIG. 5 is a representative Instron load-extension curve showing the graphical calculation of the "secant" post-yield modulus ($M_{py}$) from the slope of the line AC, where the tenacity-at-7%-elongation ($T_7$) is denoted by point C, and the tenacity-at-20%-elongation ($T_{20}$) is denoted by point A, and defined by the expression $(1.07T_7-1.2T_{20})/0.13$; and compares the "secant" $M_{py}$ (herein denoted as Tan $\beta$ to that of the "tangential" $M_{py}$ (herein denoted as Tan $\alpha$, i.e., slope of line segment AB). For yarns which have an instantaneous modulus $M_i$ (=d(stress)/d(elongation) greater than about 0, the value of Tan $\beta$ is about the same as Tan $\alpha$.
Figure 6:
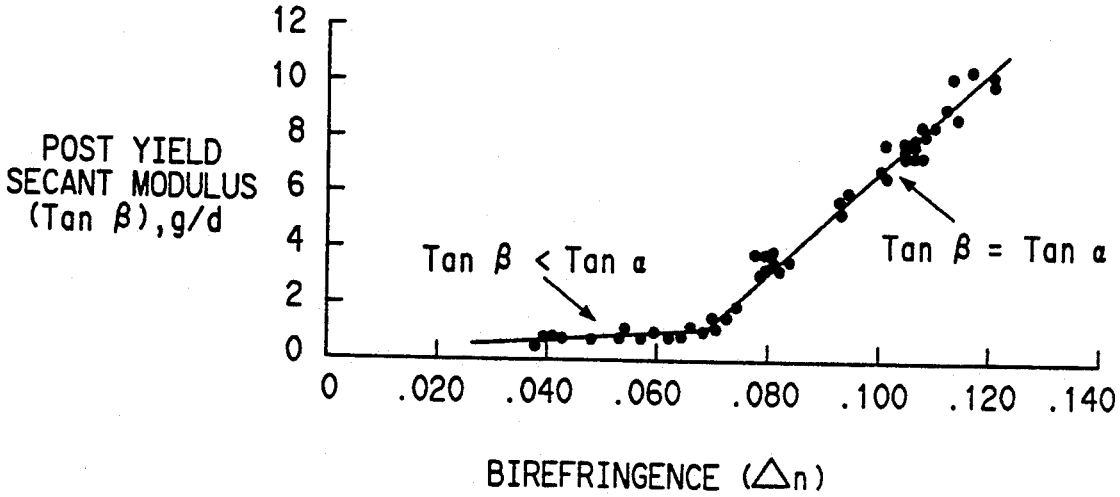
FIG. 6 is a graphical representation of the secant $M_{py}$ (Tan $\beta$ in FIG. 5) versus birefringence ($\Delta_n$) of spin-oriented filaments. For wherein Tan $\alpha$ is essentially equal to Tan $\beta$, the post-yield modulus ($M_{py}$) becomes a useful measure of molecular orientation.
Figure 7:
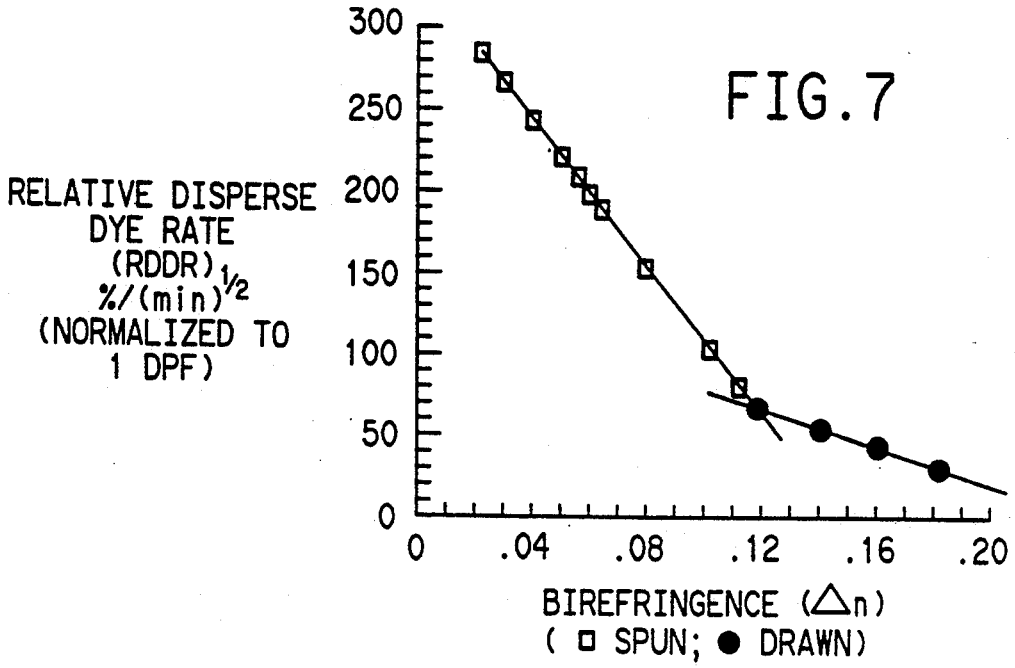
FIG. 7 is a graphical representation of the Relative Disperse Dye Rate (RDDR), as normalized to 1 dpf, versus the average filament birefringence ($\Delta_n$).
Figure 8:
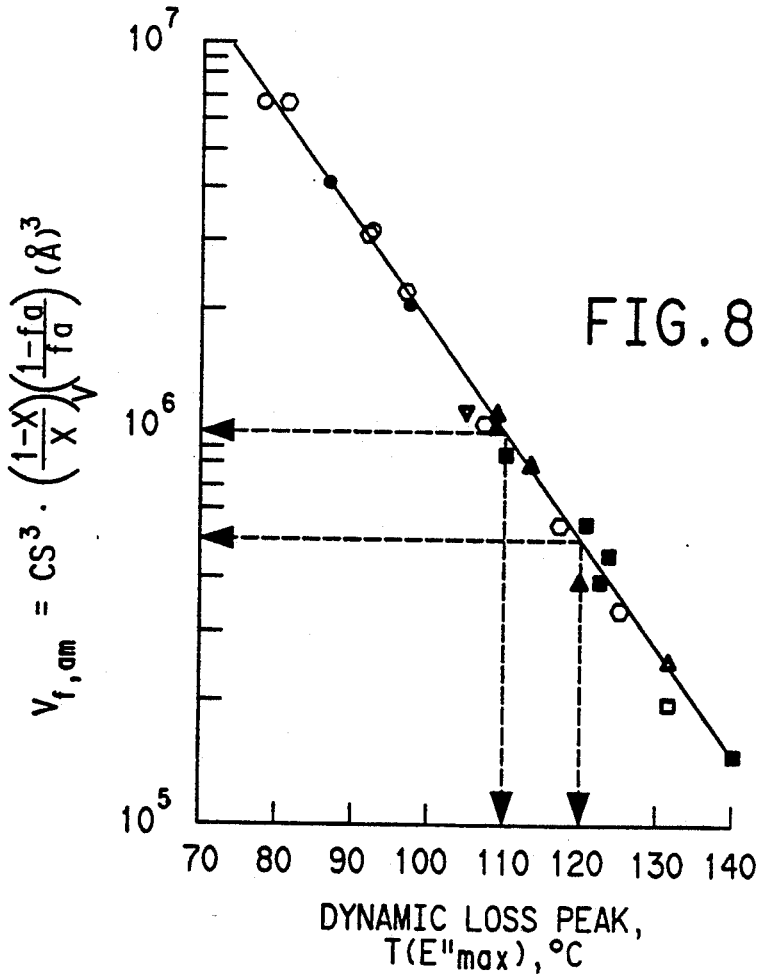
FIG. 8 is a graphical representation of the filament amorphous free-volume of the fiber ($V_{f,am}$, as defined herein after), versus the peak temperature of the fiber dynamic loss modulus, $T(E''_{max})$, taken herein as a measure of the glass transition temperature which is typically 20° C. to about 50° C. above the $T_g$ of the polymer. A decreasing T(E''max) value corresponds to greater amorphous free-volume ($V_{f,am}$), and hence to improved dyeability, as measured herein by a Relative Disperse Dye Rate (RDDR) value (normalized to 1 dpf) of at least about 0.1.
Figure 9:
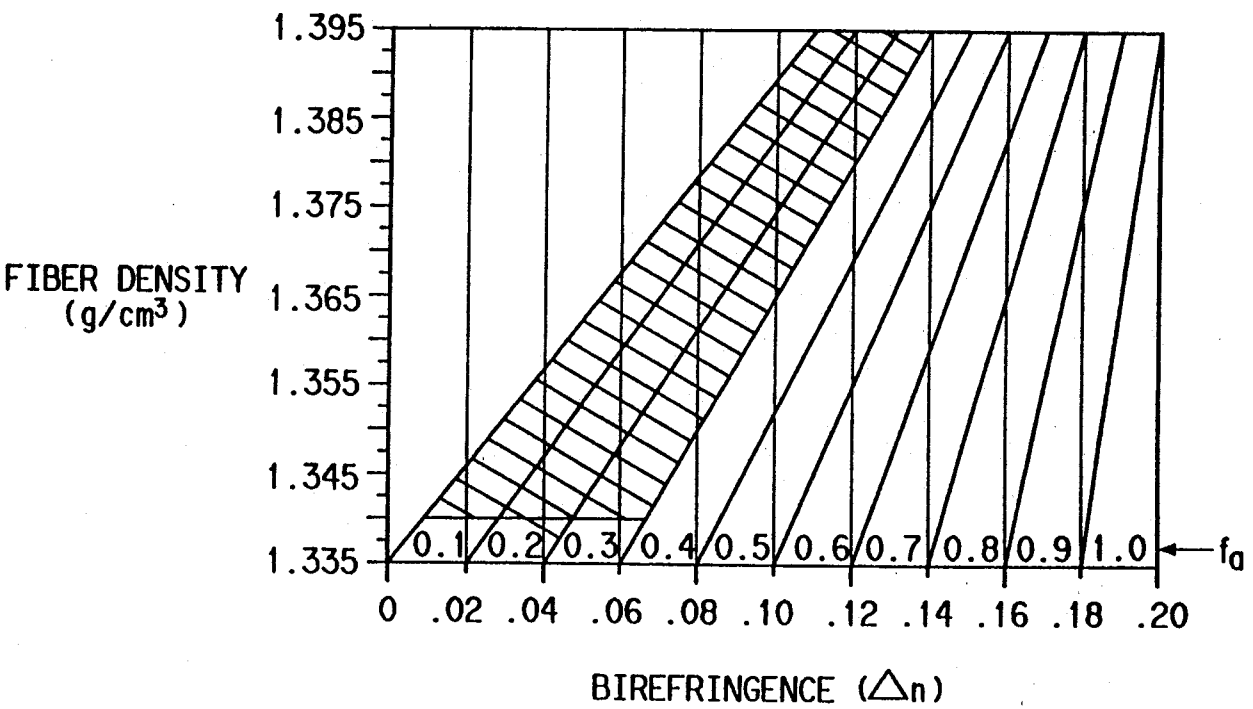
FIG. 9 is a graphical representation of the filament density ($\rho$) versus birefringence ($\Delta_n$); wherein the diagonal lines represent combinations of density ($\rho$) and ($\Delta_n$) of increasing fractional amorphous orientation ($f_a$), used in the calculation of the free-volume $V_{f,am}$ depicted in FIG. 8.
Figure 10:
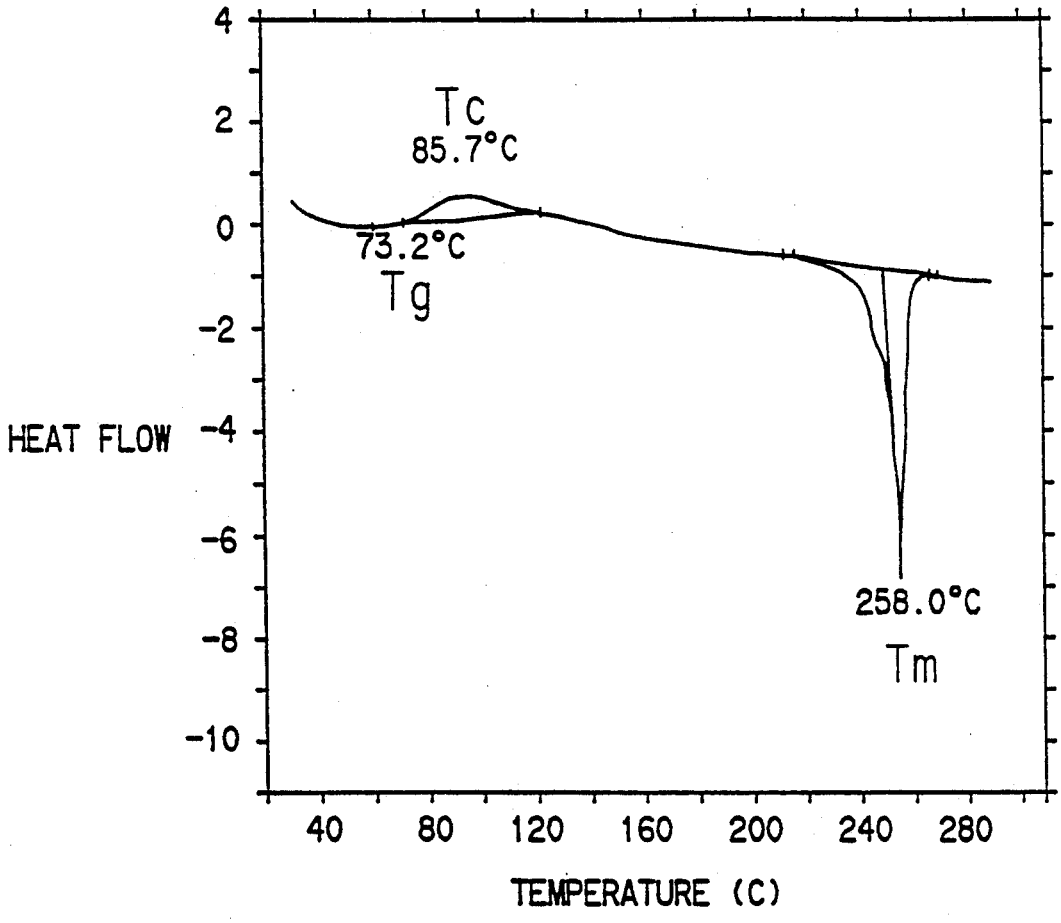
FIG. 10 is a representative Differential Scanning Calorimetry (DSC) spectrum for a fiber showing the thermal transitions corresponding to the glass-transition temperature ($T_g$), onset of "cold" crystallization $T_{cc}$(DSC), and the zero-shear melting point $T_M$ of the fiber, which is higher than the zero-shear melting point $T_M^o$ of the polymer due to the effect of orientation and crystallinity on the fiber melting point. To measure the zero-shear melting point ($T_M^o$) of the polymer, a second DSC heating of the previous melted DSC (fiber) sample is made to provide the DSC spectrum of the polymer rather than of the extruded fiber.
Figure 11:
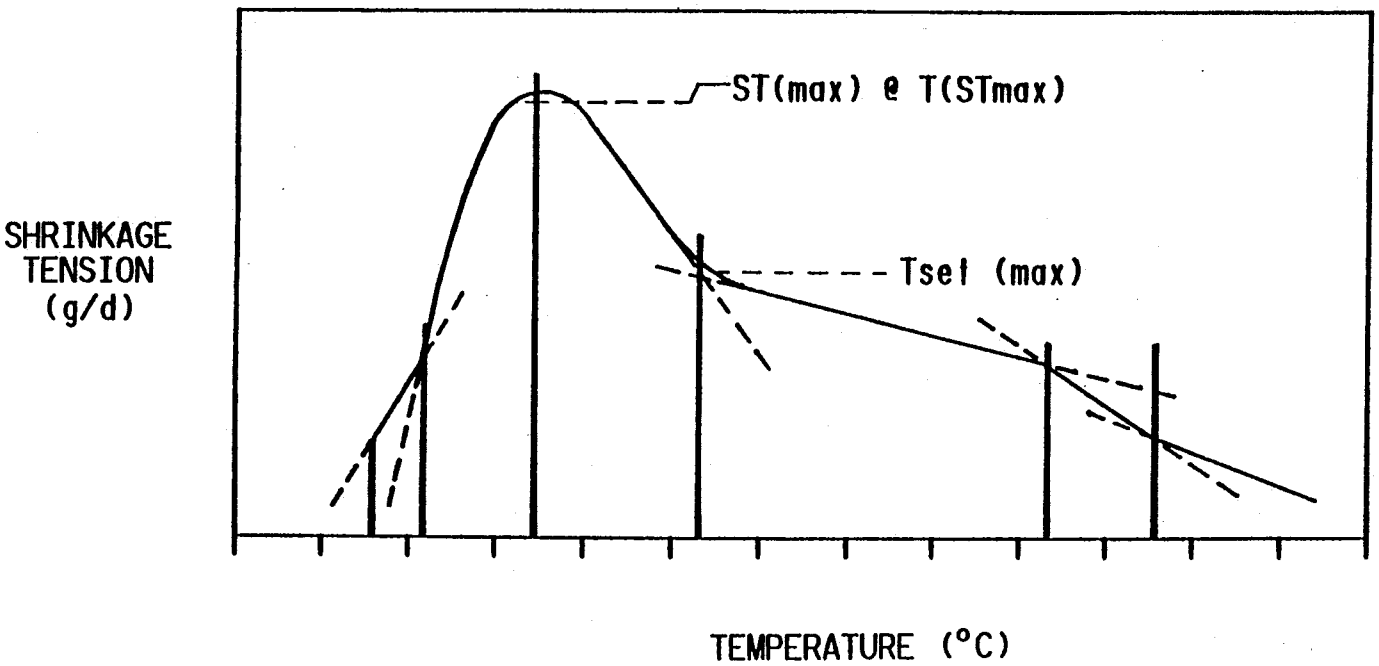
FIG. 11 is a representative shrinkage tension (ST)-temperature spectrum for the spin-oriented fine polymer filaments of the invention showing the maximum shrinkage tension $ST(_{max})$, peak temperature $T(ST_{max})$ and the preferred "heat set" temperature $T_{set}$ below which heat setting does not appreciably adversely affect dyeability.
Figure 12:
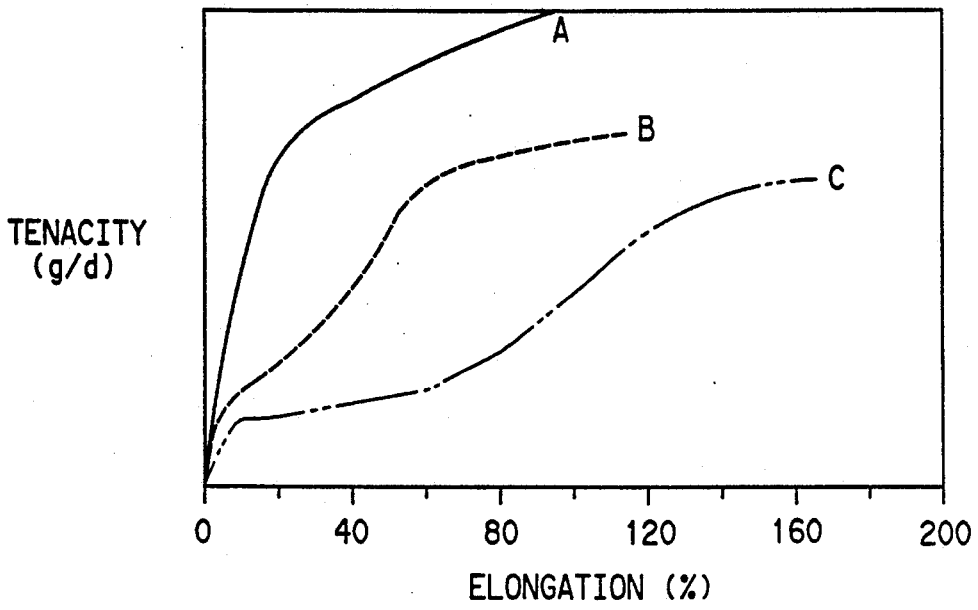
FIG. 12 are representative tenacity (T=load (gms)/original denier) versus percent elongation curves for a typical draw feed yarn of the invention (curve C); for a typical direct-use yarn of this invention (curve B); and for a preferred direct-use yarn of the invention after relaxed heat treatment (Curve A), i.e., akin to after dyeing.
Figure 13:
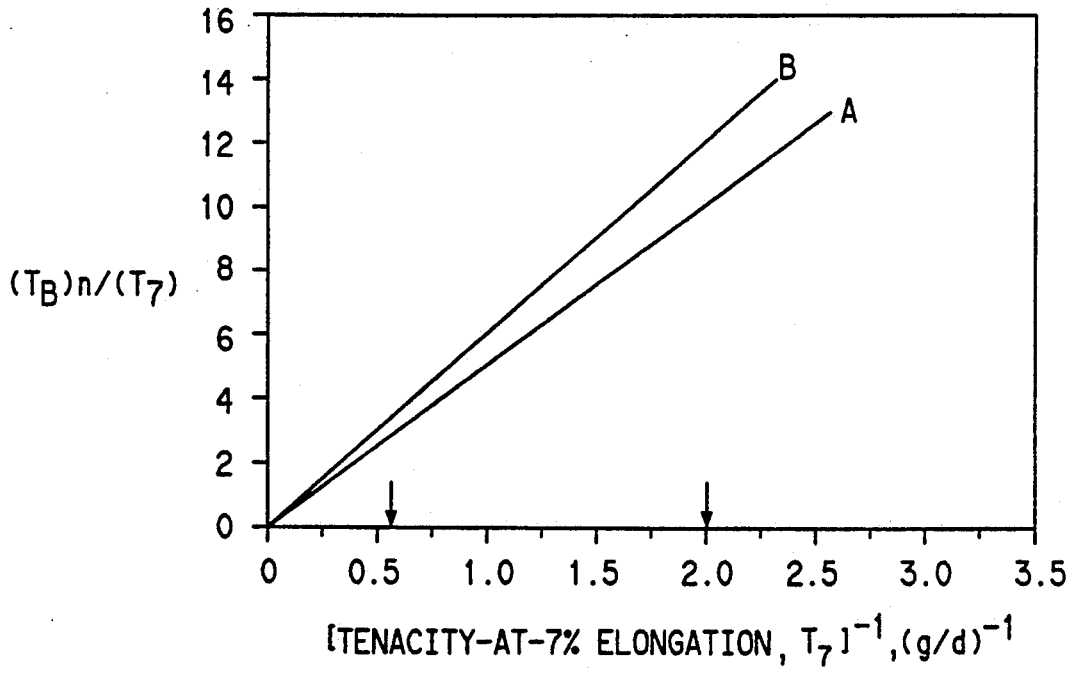
FIG. 13 is a graphical representation of the preferred values for the tenacity-at-break $(T_B)_n$, normalized for the effects of LRV and percent delusterant (such as $TiO_2$), plotted as the $(T_B)_n/T_7$-ratio versus the reciprocal of the $T_7$ (i.e., versus $1/T_7$); wherein, Curve A: $[(T_B)_n/T_7]=(5/T_7)$; and curve B: $[(T_B)_n/T_7]=(6/T_7)$.
Figure 14:
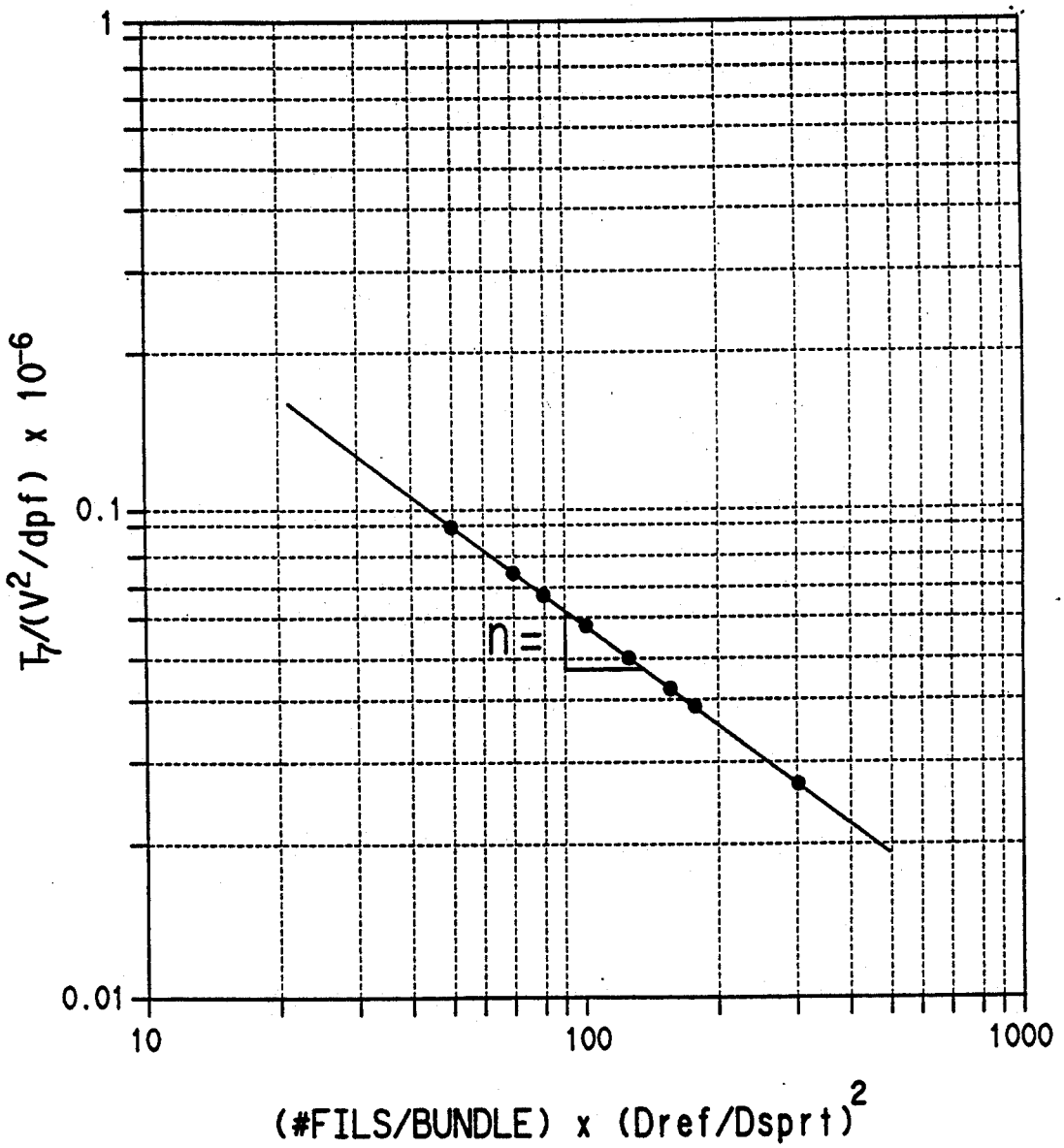
FIG. 14 is a plot of the ratio, $T_7/(V^2/dpf)$ versus the product of the number of filaments per yarn extrusion bundle ($\#_c$) and the ratio $(D_{ref}/D_{sprt})^2$, where $D_{ref}$ and $D_{sprt}$ are the diameters of a reference spinneret (e.g., about 75 cm) and the test spinneret, respectively. The slope "n" from a ln—ln plot is found to be about negative 0.7 (−0.7); that is, the tenacity-at-7%-elongation ($T_7$) is found to vary proportionally to $(V^2/dpf)$ and to $[(\#_c)(D_{ref}/D_{sprt})^2]^{-0.7}$; that is, the tenacity-at-7%-elongation ($T_7$) decreases approximately linearly with an increase in the filament extrusion density to the power of plus 0.7 (+0.7); and thereby the filament extrusion density may be used to as a process parameter to spin finer denier filaments at higher spinning speeds (V). At higher spin speeds, e.g., in the range of about 4 to 6 km/min, it is found that the apparent spinline stress increases less rapidly with spin speed (V); i.e., is found to be proportional to $(V^{3/2}/dpf)$.

3. Spin-oriented fine filaments, especially suitable for use as direct-use yarns (DUY), are further characterized by:

(a) boil-off shrinkage (S) and dry heat shrinkage (DHS) between in the range of about 2% to about 12%, preferably in the range of about 6% to about 12% for woven and preferably in the range of about 2% to about 6% for knits, such that the filament denier after boil-off, $dpf(ABO)=dpf(BBO)\times[(100/(100-S)]$, is in the range of about 1 to about 0.2 dpf, preferably in the range of about 0.8 to about 0.2 dpf, and especially in the range of about 0.6 to about 0.2 dpf;

(b) tenacity-at-7%-elongation ($T_7$) in the range of about 1 to about 1.75 g/d with an elongation-at-break ($E_B$) in the range of about 40% to about 90%, preferably about 60% to about 90%;

(c) a post-yield modulus ($M_{py}$), as defined by the secant Tan $\beta$ in FIG. 5 (that is, $M_{py}=(1.2T_{20}-1.07T_7)/0.13$), in the range of about 2 to about 12 g/d.

4. Spin-oriented fine filaments, capable of being cold drawn without heat setting to provide textile filaments, as further characterized by:

(i) a boil-off shrinkage (S) and dry heat shrinkage (DHS) less than about 12%;

(ii) an onset of cold crystallization, $T_{cc}$ (DCS), of less than about 105° C., as measured by differential scanning calorimetry (DSC) at a heating rate of 20° C. per minute;

(iii) an instantaneous tensile modulus, $M_i(=[d(stress)/d(elongation)]\times 100$, greater than about 0; wherein [d(stress)/d(elongation)] is the tangent to a plot of stress (grams per drawn denier) versus percent elongation; and wherein draw stress is the draw force (grams) divided by the drawn denier, where the drawn denier is defined the ratio of the undrawn denier and the residual draw-ratio, $(RDR=1+E_{B,\%}/100)$;

The shrinkage (S) of said drawn filaments may be reduced, if desired, without significant loss in dyeability provided that the post heat set temperature ($T_{set}$) is less than about the temperature at which the shrinkage tension undergoes no significant further reduction with increasing temperature; that is, it is preferred to maintain $T_{set}$ less than about the temperature at which the onset of rapid (re)-crystallization begins. The maximum value for $T_{set}$, is herein, defined as the temperature, at which the slope, [d(ST)/dT], of a shrinkage tension versus temperature spectrum abruptly decreases in value (becoming less negative)—see FIG. 11.

5. Preferred drawn yarns made by drawing the said spin-oriented filaments of this invention and said drawn yarns are characterized by:

(a) denier per filament after boil-off shrinkage, dpf(ABO), in the range of about 1 to about 0.2 dpf, and preferably in the range of about 0.8 to about 0.2 dpf;

(b) boil-off shrinkages (S) and dry heat shrinkages (DHS) in the range of about 2% to about 12%, preferably in the range of about 2% to about 6% for knits, and in the range of about 6% to about 10% for wovens;

(c) tenacity-at-7%-elongation ($T_7$) at least about 1 g/d, such that the $[(T_B)_n/T_7]$-ratio is at least about $(5/T_7)$; preferably at least about $(6/T_7)$, wherein, $(T_B)_n$ is the tenacity-at-break normalized to a reference LRV of 20.8 and percent delusterant (such as $TiO_2$) of 0%, and having an $E_B$ in the range of about 15% to about 55%;

(e) post-yield modulus ($M_{py}$) in the range of about 5 to about 25 g/d;

(f) relative disperse dye rate (RDDR), normalized to 1 dpf, of at least about 0.1, and preferably at least about 0.15;

(g) a dynamic loss modulus peak temperature, T(E"-max) less than about 115° C.; and preferably less than about 110° C.;

(h) an average along-end denier spread (DS) of less than about 4%, preferably less than about 3%, especially less than about 2%.

6. Bulky fine filament yarns (or tows) are provided by passing the fine filament yarns of this invention through a bulking process, such as air-jet texturing, false-twist texturing, stuffer-box and gear crimping; wherein, said bulky filaments are characterized by having individual filament deniers (after shrinkage) less than about 1, preferably less than about 0.8, with boil-off shrinkage (S) and dry heat shrinkage (DHS) less than about 12% and characterized by a $T(E''_{max})$ of less than about 115° C., preferably less than about 110° C., and a RDDR of at least about 0.1, and preferably at least about 0.15.

Especially preferred filaments for use in direct-use yarns (or tows) are also characterized by:

(a) an average crystal size (CS), as measured from the 010 plane by wide-angle x-ray scattering (WAXS), between about 50 and about 90 angstroms (Å) with a fractional volume crystallinity, $X_v=(\rho_m-1.335)/0.12$, between about 0.2 and about 0.5 for density values ($\rho_m$) between about 1.355 and about 1.395 grams/cm$^3$, corrected for percent delusterant;

(b) a fractional average orientation function, $f=\Delta_n/\Delta_n^\circ$ [where $\Delta_n^\circ$ is the average intrinsic birefringence, defined herein with a value of 0.22), between about 0.25 and about 0.5, with a fractional amorphous orientation function, $f_a=(f-X_vf_c)/(1-X_v)]$, less than about 0.4, preferably less than about 0.3, wherein ($\Delta_n$) is the average birefringence and $f_c$ is the fractional crystalline orientation function, $f_c=(180-COA)/180$, where COA is the crystalline orientation angle as measured by WAXS;

(c) an amorphous free-volume ($V_{f,am}$) of at least about $0.5\times 10^6$ cubic angstroms (Å$^3$), preferably at least about $1\times 10^6$ Å$^3$, where $V_{f,am}$ is defined herein by $(CS)^3[(1-X_v)/X_v)][(1-f_a)/f_a]$, providing a dynamic loss modulus peak temperature, $T(E''_{max})$, less than about 115° C., and preferably less than about 110° C.;

(d) an atmospheric relative disperse dye rate (RDDR), normalized to 1 dpf, of at least about 0.1, and preferably at least about 0.15.

The yarn characteristics are measured as in U.S. Pat. Nos. 4,134,882, 4,156,071, and 5,066,447; except the relative disperse dye rate (RDDR) is normalized to 1 dpf, dry heat shrinkage (DHS) is measured at 180° C., and the lab relative viscosity (LRV) is defined according to Broaddus in U.S. Pat. No. 4,712,998 and is equal to about (HRV−1.2), where HRV is given in U.S. Pat. Nos. 4,134,882 and 4,156,071. The value of $LRV_{20.8}$ is taken as the reference LRV of the polyester polymer of equal zero-shear "Newtonian" melt viscosity $\eta_o$ to that of 20.8 LRV 2GT homopolymer (e.g., providing for the same capillary pressure drop at the same mass flow rate and temperature). In Tables I through VIII, alphanumerics which are "raised to the power" of a number is expressed using the symbol "^" (such as $10^2=10$ 2); very small or very large numbers (such as 0.00254 cm and 254000 cm/min, for example) are expressed, for convenience as 0.254 and 254 where the units are given as "cm×10^2" and "cm/sec×10^−3, respectively; dashes (- - -) in the place of a number denotes that the value was not measured; "NA" in the place of a number denotes that the measured value is not applicable; and dashed arrows (- - - >) are used to denote values of a given parameter for a given item is the same as that of the preceeding item. Spin speed (V) was measured in yards/minute and have been converted in the text to km/minute, rounded to the second decimal place (e.g., 4500 ypm=4.115 km/min=>4.12).

The preferred embodiments of this invention are illustrated by the following examples:

Poly(ethylene terephthalate) having a polymer LRV in the range of about 13 to about 23 (which corresponds to an [η] in the range of about 0.5 to about 0.7), preferably in the range of about 13 to about 18 for ionically modified polyesters, and in the range of about 18 to about 23 for nonionically modified polyesters, a zero-shear melting point ($T_M^o$) in the range of about 240° C. to about 265° C., and a glass-transition temperature ($T_g$) in the range of about 40° C. to about 80° C., and containing minor amounts of delusterants and surface friction modifiers (e.g., $TiO_2$ and $SiO_2$), is melted at a polymer temperature $T_P$ and filtered through inert medium for a residence (hold-up) time ($t_r$, min) and then extruded through spinneret capillaries of diameter ($D_{RND}$) with length (L) at a capillary mass flow rate w [=(dpf V)/9], g/min] providing an apparent capillary shear rate ($G_a$, $sec^{-1}=[(32/60\pi)(w/\rho)/D_{RND}^3)]$, where capillary dimensions are expressed in units of centimeters and the withdrawal spin speed (V) in units of km/min.

The filaments of most of the examples herein were spun from spinnerets having a filament density per extrusion surface area in the range of typically about 2.5 to about 13, while it was possible to spin and quench filament bundles with a extrusion filament density as high as about 25 provided capillary hole pattern (filament array) was optimized for the type of quench (i.e., radial vs. cross-flow) and length/profile of the initial delay quench "shroud" and air velocity profile (see Example I); wherein the extrusion filament density is defined by the ratio of the number of filaments ($\#_c$) divided by the extrusion surface area ($A_o$),(i.e., $\#_c/A_o$,$cm^{-2}$), into a "shroud" which protects the freshly extruded filaments from direct quench air for a distance at least about 2 cm and not greater than about (12$\sqrt{}$ dpf)cm; and then carefully cooled to a temperature less than about polymer $T_g$, preferably by radially directed air having a temperature $T_a$ (herein about 22° C.) less than about the polymer $T_g$ (herein $T_g$ was about 70° C. for 2GT homopolymer) and of linear velocity $V_a$ (m/min) in the range of about 10 to about 30 m/min. Suitable spinning apparatus used are essentially as that described in U.S. Pat. Nos. 4,134,882, 4,156,071, and 4,529,368.

The along-end denier spread (DS) and draw tension variation (DTV) were minimized by balancing the values for the delay quench length ($L_{DQ}$), the quench air temperature ($T_a$), the quench air flow rate ($V_a$), and the convergence length ($L_c$), while selecting $T_P$ for spinning continuity. Increasing the polymer spin temperature ($T_P$) (but less than about [$(T_M)_a$+55° C.] usually increases spinning continuity and mechanical quality (i.e., $T_B$, g/d), but usually decreases along-end uniformity and increases shrinkage. To minimize loss of along-end uniformity while spinning at elevated temperatures ($T_P$), as required for mechanical quality, heat can be imparted to the extruded filaments through use of high shear rate ($G_a$) capillaries (that is, small diameter capillaries). However, the spinning operability unexpectedly deteriorated when high shear capillaries are used with high $L/D_{RND}$ ratios, such as use of a 9×50 mil capillary (see Example III). It is conjectured that at these low capillary mass flow rates and high shear conditions, incipient shear-induced molecular ordering (e.g., lower chain entropy and possible incipient "nucleation") of the polymer melt occurs, especially for polymer melt filtered prior to extrusion for residence times ($t_r$) greater than about 4 minutes, wherein this molecular ordering (possible incipient nucleation) is believed to increase the apparent polymer melting point from the zero-shear value ($T_M^o$) to an apparent value $(T_M)_a$. This has the effect of reducing the spin temperature differential, $T_p-(T_M)_a$. To maintain a sufficiently large enough spin temperature differential, it is found that the bulk polymer temperature $T_P$needs to be further increased as given by the amount defined by the expression: $2\times10^{-4}(L/D_{RND})G_a$,° C., for the selected values of L, $D_{RND}$, and $G_a$.

To obtain a balance of spinning continuity, mechanical quality and along-end uniformity, the apparent internal spinline stress ($\sigma_a$) at the "neck-point" is controlled in the range of about 0.045 to about 0.195 g/d while controlling the melt extension strain $\epsilon_a$ in the range of about 5.7 to about 7.6. The attenuated and cooled filaments are converged into a multifilament bundle and withdrawn at a spinning speed (V, km/min) as defined by the surface speed of the first driven roll. The external spinline tension arising from frictional surfaces (and air drag) is removed prior to packaging by slightly over feeding the spinline between the first driven roll and the windup, usually between about 0.5% and 5%. Finish is applied at the point of convergence and interlace is provided, preferably after the first driven roll. The values for finish-on-yarn (weight, %) and degree of filament entanglement (RPC) are selected to meet end-use processing needs.

Polyester fine filaments of the invention are of good mechanical quality and uniformity having a linear density less than about of that of natural worm silk, but greater than that of spider silk, that is between about 1 and about 0.2 denier per filament, and having the capability of being uniformly dyed without use of high temperatures and chemical dye assists; that is, more akin to that of natural silks.

Advantageously, if desired, the fine denier filament yarns may be treated with caustic in spin finish (as taught, e.g., by Grindstaff and Reese in U.S. Pat. No. 5,069,844) to enhance their hydrophilicity and improved moisture-transport and comfort. Incorporating filaments of different deniers and/or cross-sections may be used to reduce filament-to-filament packing and thereby improve tactile aesthetics and comfort. Unique dyeability effects may be obtained by co-mingling filaments of differing polymer modifications, such as homopolymer dyeable with disperse dyes and ionic copolymers dyeable with cationic dyes.

Fine filaments of lower shrinkage may be obtained, if desired, by incorporating chain branching agents, on the order of about 0.1 mole percent, as described in part in Knox U.S. Pat. No. 4,156,071, MacLean U.S. Pat. No. 4,092,229, and Reese in U.S. Pat. Nos. 4,883,032, 4,996,740, and 5,034,174; and/or increasing polymer viscosity by about +0.5 to about +1.0 LRV units.

The fine filament yarns of this invention are suitable for warp drawing, air jet texturing, false-twist texturing, gear crimping, and stuffer-box crimping, for example; and the low shrinkage filament yarns may be used as direct-use flat textile yarns and a feed yarns for air-jet texturing and stuffer-box crimping wherein no draw is need be taken. The filaments (and tows made therefrom) may also be crimped (if desired) and cut into staple and flock. The fabrics made from these improved yarns may be surface treated by conventional sanding and brushing to give suede-like tactility. The filament surface frictional characteristics may be changed by selection of cross-section, delusterant, and through such treatments as alkali-etching. The improved combination of filament strength and uniformity makes these filaments, especially suited for end-use processes that require fine filament yarns without broken filaments (and filament breakage) and uniform dyeing with critical dyes.

The fine denier filament polyester yarns of the invention are especially suitable for making of high-end density moisture-barrier fabrics, such as rainwear and medical garments. The surface of he knit and woven fabrics can be napped (brushed or sanded). To reduce the denier even further, the filaments may be treated (preferably in fabric form) with conventional alkali procedures. The fine filament yarns, especially those capable of being cationic dyeable, may also be used as covering yarns of elastomeric treatments yarns (and strips), preferably by air entanglement as described by Strachan in U.S. Pat. No. 3,940,917. The fine filaments of the invention may be co-mingled on-line in spinning or off-line with higher denier polyester (or nylon) filaments to provide for cross-dyed effects and/or mixed shrinkage post-bulkable potential, where the bulk may be developed off-line, such as over feeding in presence of heat while beaming/slashing or in fabric form, such as in the dye bath. The degree of interlace and type/amount of finish applied during spinning is selected based on the textile processing needs and final desired yarn/fabric aesthetics.

The process and products of this invention are further illustrated by the following Examples, details being summarized in the Tables.

EXAMPLE I

Yarns of 100 and 300 filaments of nominal 0.5 dpf were spun from poly(ethylene terephthalate) of 19 LRV (corresponding to about 0.60 [$\eta$]) and containing 0.3 weight percent of $TiO_2$. The 300-filament yarns were spun using spinnerets of varying construction; e.g. so to provide: (i) 2 or more capillaries from a single counterbore without inter-filament fusion by controlling the capillary-to capillary distance greater than about 40 mils (1 mm); (ii) 300 "equally-spaced" single capillaries; and (iii) 300 capillaries arranged in concentric rings occupying about "initially" 50% of the "outer" half of the available extrusion surface area ($A_o$) so to increase the effective extrusion filament density (EFD) from about 12.5 to about 25; however, immediately after extrusion the polymer melt streams of spinneret (iii) converge to form a conical bundle similar to that of spinnerets (i) and (ii); and thereby having an effective extrusion filament density (EFD) on the order of that for the spinneret constructions (i) and (ii); i.e. less than 25 and larger than 12.5, where the effective extrusion filament density (EFD) for such non-equally distributed filament configurations is experimentally determined following the graphical procedure in FIG. 14. Experimentally, filaments equally spaced over the entire extrusion area and filaments spaced on the perimeter in concentric rings are found to have about the same effective filament extrusion density since the filaments bundles, immediately after extrusion, assume similar configurations. The data in Table I for the 300-filament yarns were spun with capillaries arranged in concentric rings occupying initially about 50% of the available extrusion surface area. The freshly extruded filaments were cooled to room temperature by using a radial quench apparatus, essentially as described in U.S. Pat. No. 4,156,071, except for having a protective "shroud" of length ($L_{DQ}$) of about 1 inch (2.54 cm) for yarns spun at 3500 ypm (3.2 km/min) and about 2.25 inches (5.72 cm) for yarns spun at 4500 ypm (4.12 km/min). The filament yarns spun at 3500 ypm (3.2 km/min) had a high boil-off shrinkage (S), making these yarns especially suitable, for example, as draw feed yarns (DFY) in draw warping, draw air-jet texturing, draw false-twist texturing, and draw crimping. Increasing the spin speed to 4500 ypm (4.115 km/min), decreased boil-off shrinkage (S) to values less than 12% with a differential shrinkage ($\Delta S = DHS - S$) less +2%, a maximum shrinkage tension ($ST_{max}$) less than 0.175 g/d at a peak temperatures $T(ST_{max})$ less than 100° C., and a yield tenacity (herein approximated by the tenacity-at-7% elongation, $T_7$) greater than 1 g/d, making these filaments fully suitable for direct-use applications without requiring additional drawing or heat treatment, such as use as filaments in flat, air-jet textured and stuffer-box crimped textile filament yarns.

It was observed that the filaments spun from spinneret capillaries with a cross-sectional area ($A_c$) of 176.8 mils$^2$ (0.1140 mm$^2$, $1.14\times10^{-3}$ cm$^2$) had a lower tenacity-at-break ($T_B$) than the filaments spun from spinneret capillaries with an $A_c$ of 28.3 mils$^2$ (0.0182 mm$^2$, $1.82\times10^{-4}$ cm$^2$). The lower tenacity of the yarns of this Example I, is also, in part, due to the lower polymer LRV (19 vs. 20.8). The normalized values for $T_B$ (denoted herein by $(T_B)_n$) are defined by the product the measured tenacity-at-break ($T_B$) and the factor $(20.8/LRV)^{0.75}(1-X)^{-4}$ which for these yarns is about 1.057; thereby, the normalized break tenacities $(T_B)_n$ are about 6% higher when compared to reference LRV and % $TiO_2$ of 20.8 and 0%, respectively.

The fine filament yarns of this example were capable of being dyed to deep shades at atmospheric conditions (100° C.) without use of dye carriers as given by an Relative Disperse Dye rate (RDDR)-value (normalized to a 1 dpf) of about 0.16 versus an RDDR-value of 0.055 for a conventional fully drawn yarn.

To provide yarns of fewer filaments (and lower denier), it is possible to split, for example, the 300-filament yarn bundle into 2,3 or 4 individual bundles of 150, 100, and 75-filament yarn bundles, respectively, preferably by use of metered finish tip separating guides at the exit of the radial quench chamber. Multi-ending permits a higher mass flow rate (w) through the filter pack cavity and thereby reducing the residence time ($t_r$) in the pack cavity per threadline.

EXAMPLE II

Fine filaments were spun from poly(ethylene terephthalate) of nominal 20.8 LRV (about 0.65 [$\eta$]) and containing 0.1 weight percent $TiO_2$ at a withdrawal speed (V) of 4000 ypm (3.66 km/min) using a radial quench apparatus, essentially as described in Example I, except for having a delay "shroud" length ($L_{DQ}$) of about 2.25 inches (5.72 cm). Examples II-5 and II-6 had poor operability and no yarn was collected. The low apparent shear rates ($G_a$) for the 0.5 dpf filaments spun at 4000 ypm (3.66 km/min) using $15\times60$ mil ($0.38\times1.52$ mm, $0.038\times0.152$ cm) capillaries is believed to contribute to the poor operability and broken filaments. Even increasing temperatures $T_P$ to about 299° C. did not provide an acceptable process. Temperatures higher than 299° C.-300° C. were not tried because of the concern for poor along-end denier uniformity. Process and product details are summarized in Table I.

EXAMPLE III

In Example III, 68-and 136-(unplied and plied) filament yarns were spun, essentially according to Example I, except convergence was by a metered finish tip as described in U.S. Pat. No. 4,926,661 for Examples III-1 through III-9 and III-11 through III-25. Example III-10 used a metering finish roll surface to converge the filaments as described in Examples I and II. Other process details are summarized in Tables I and II. The filaments of Example III-1 through III-5 and III-12 through III-15 have $T_7$-values greater than about 1 g/d making them especially suitable for use as filaments in direct-use textile filament yarns and as feed yarns in air-jet textured, wherein no draw is taken; and, if desired, can be drawn uniformly without heat (cold) in warp drawing (and air-jet texturing) as described in Knox and Noe U.S. Pat. No. 5,066,447. The filaments of III-6,7, and III-16 through III-25 with $T_7$-values less than about 1 g/d are especially suitable as filaments in draw feed yarns (DFY), such as draw false-twist texturing (FTT) and draw air-jet texturing (AJT) or as draw feed yarns in warp drawing.

In Examples III-1 through III-5, 50 denier 68-filament yarns were spun from a single pack cavity and plied at the convergence guide to give a 100 denier 136-filament yarns of excellent mechanical quality. Example III-4, for example, had a spinning continuity of 0.39 breaks per 1000 lbs. (0.86 per 1000 kg) which is equivalent to about 9.5 breaks per $10^9$ meters. The yarns of Example III-4 were wound with about 10 cm interlace (as measured by the rapid pin count procedure described in U.S. Pat. No. 3,290,932) for air-jet texturing on a Barmag FK6T-80 without drawing and wound with about 5–7 RPC interlace for direct-use as a flat textile yarn in wovens and warp knits. Examples III-6 and 7 were drawn without broken filaments at 1.44×and 1.7×, respectively, to give drawn 35 denier 68-filament yarns. Example III-6 is preferred versus III-7 since the spinning productivity (spun denier x spin speed) of III-6 is about 25% greater than Example III-7. Yarns of Example III-6 were successfully cold warp drawn using a 1.44×draw-ratio.

It had been anticipated that increasing the $L/D_{RND}$-ratio of the 9 mil (0.229 mm, 0.0229 cm) capillary spinnerets from 2.22 to 5.56, as per the teaching of Frankfort and Knox in U.S. Pat. No. 4,134,882, would significantly improve mechanical quality by providing for increased shear heating of the extruding polymer melt; wherein the degree of capillary shear heating was estimated by the expression in Frankfort and Knox: $660(wL/D^4)^{0.685}$,°C., wherein D is given mils, and w is given in lbs./hr.; however, broken filaments were observed for Examples III-8 and III-11.

Acceptable quality was obtained for Example III-12; wherein the residence time ($t_r$) during filtration in the pack cavity was reduced by spinning 136-filaments versus 68-filaments. The yarn bundle could be withdrawn as a single 136-filament bundle or split to wind-up two 68-filament yarn bundles. Residence times ($t_r$) less than about 4 minutes for high $L/D_{RND}$ capillary spinnerets are found to be necessary to spin without having to use high "input" polymer temperatures ($T_P$). See Example IX for a more detailed discussion about the spinning with high shear capillary spinnerets. In Examples III-12 through III-15, 136-filament yarns were spun using 136-9×36 mil (0.229×0.916 mm, 0.0229×0.0916 cm) capillaries per spinneret, and thereby reducing the filtration residence time ($t_r$) by 50%, to provide yarns with good mechanical quality. The high filament count yarns are especially suitable for draw air-jet texturing (AJT) and for false-twist texturing (FTT), wherein, a straight draw-texturing machine configuration is preferred. Yarns from Examples III-19,22,24 and 25 were used for preparing warp drawn flat yarns of nominal 0.5 dpf as described in Example XII.

The structural properties of the filaments of Example III-10 are representative of spin-oriented filaments of this invention having shrinkages less than 6%. Example III-10 had a density ([$\rho$-measured=$\rho$-fiber−0.0087(% $TiO_2$)] of 1.3667 g/cm$^3$ (corrected for 0.03% $TiO_2$), giving a calculated fractional volume crystallinity [$X_v=(\rho_m-1.335)/0.12$] of 0.264, and a calculated fractional weight crystallinity [$X_w=(1.455/\rho_c)X_v$] of 0.281; an average crystal size (CS) of 70 angstroms (Å); an average crystal orientation angle (COA) of 12 degrees which corresponds to a crystal orientation function [$f_c=(180-COA)/180$] of 0.93; an average birefringence ($\Delta_n$) of 0.0744 giving an average orientation function [$f=\Delta_n/0.22$] of 0.34 and an amorphous orientation function [$fa=(f-X_vf_c)/(1-X_v)$] of 0.13 and an amorphous free-volume [$(V_{f,am})=[(1-X_v)/X_v][(1-f_a)/f_a]CS^3$] of about $6\times10^6$ cubic angstroms (Å$^3$). The filaments of this example also had a differential birefringence ($\Delta_{95-5}$) of 0.0113, an $N_{iso}$ of 1.5882, wherein $N_{iso}$ is the isotopic index of refraction, a sonic velocity (SV) of 2.72 km/sec giving a sonic modulus ($M_{son}$) of 83.6 g/d, a maximum shrinkage tension ($ST_{max}$) of 0.143 g/d at a peak temperature, $T(ST_{max})$, of 80° C., a boil-off shrinkage (S) of 4.6%, giving a shrinkage modulus [$M_s=(ST_{max}/S)100$] of 3.1 g/d, a dry heat shrinkage (DHS) of 5.0% to give a differential shrinkage (ΔS=DHS−S) of less than +1%, an initial modulus of 71.6 g/d with a post-yield modulus ($M_{py}$) of 5.35 g/d, and an uncorrected disperse dye rate (DDR) of 0.144 and relative disperse dye rate RDDR, normalized to 1 dpf, of about 0.104.

EXAMPLE IV

Poly(ethylene terephthalate) of nominal 21.2 LRV (about 0.66 [$\eta$]) of 0.035, 0.3 and 1 weight percent $TiO_2$ were spun using a radial quench spinning apparatus, essentially as described in Example I, except the length ($L_{DQ}$) of the delay "shroud" was about 2⅝ inches (6.7 cm), and the filament bundles were converged by a metered finish tip at 43 inches (109 cm) from the face of the spinneret. Other process details are summarized in Tables III and IV. Increasing weight percent $TiO_2$ is observed to decrease the tenacity-at-break ($T_B$) of these fine filaments. The amount of $TiO_2$ is usually varied between about 0.035% for minimum yarn-to-metal and yarn-to-yarn frictional needs and less than about 1.5%, more typically less than about 1% for desired mechanical quality and visual aesthetics.

EXAMPLE V

Poly(ethylene terephthalate) of nominal 21.1 LRV (about 0.655 [$\eta$]) and containing 0.3 weight percent $TiO_2$ was spun using apparatus similar to Example IV. Examples V-1 through V-4, IV-9 and IV-10 use 12×50 mil (0.305×1.270 mm, 0.0305×0.127 cm) spinneret capillaries. Examples V-5, 7, 8, and 11 through 13 use 9×36 mil (0.229×0.914 mm, 0.0229×0.0914 cm) spinneret capillaries, and Example V-6 uses 6×18 mil (0.152×0.457 mm, 0.0152×0.0457 cm) spinneret capillaries to spin 100-filament 85 denier feed yarns for warp draw and draw air-jet texturing (AJT). The length of delay quench ($L_{DQ}$) was increased from 2⅝ inches (6.7 cm) to 4⅝ inches (11.7 cm) in EX. V-8 and V-10. Increasing the length of delay ($L_{DQ}$), increased along-end non uniformity 4× and interfilament denier non uniformity, as measured optically from yarn bundle cross-sections, by 2×. When the delay length ($L_{DQ}$) is less than about (12√ dpf)cm, good uniformity may be obtained.

Example V-7 was repeated for Examples V-11 through V-13 at 2400, 3000, and 3500 ypm (2.2, 3.05, and 3.35 km/min); wherein, the capillary mass flow rate (w) was varied to spin a draw feed yarn such that the spun dpf would be drawn to a final denier of about 0.5 dpf [where, the drawn dpf=spun dpf/draw ratio=spun dpf x (drawn yarn RDR/spun yarn RDR), where the residual draw-ratio, RDR=(1+$E_B$, %/100)]. Examples V-11 through V-13 have tenacity-at-7%-elongation ($T_7$) values less than about 1 g/d making them especially suitable as draw feed yarns even though the shrinkages of the undrawn yarns were less than 12%. The results of the warp drawing are summarized in Example VII.

EXAMPLE VI

In Example VI, Example V-13 was repeated at 3300 ypm (3.02 km/min) for varying spun deniers, delay quench lengths ($L_{DQ}$), spinning temperatures ($T_P$), and convergence guide lengths ($L_C$). Example VI-2, with a denier spread (DS) of 3.8% was successfully drawn 1.35× to give a drawn 0.3 dpf 100-filament yarn with a 2.3% denier spread, tenacity of 4.4 g/d, $E_B$ of 32.5% and a boil-off shrinkage (S) of 6.3%. In this example it was observed that as total yarn bundle denier and individual filament denier is reduced, the along-end uniformity deteriorates unless the process is re-balanced. Increasing polymer temperature to insure good spinning continuity at these low mass flow rates is required. The along-end denier spread (DS) was improved from 12.1% (EX. VI-1) to less than 4% by reducing the delay length ($L_{DQ}$) to about 2.9 cm and decreasing the convergence length ($L_C$) from 109 cm to 81 cm. For yarns with dpf less than 0.5 it is difficult to achieve the same DS-values as for those of 0.5 to about 1 dpf. Process and product details are summarized in Tables III and IV.

EXAMPLE VII

Fine trilobal filaments were spun from poly(ethylene terephthalate) of nominal 21 LRV (about 0.65 [$\eta$] containing 0.035 weight percent $TiO_2$ using spinnerets with 9×36 mil (0.229×0.914 mm, 0.0229×0.0914 cm) and 12×50 mil (0.305×1.270 mm, 0.0305×0.127 cm) metering capillaries and a Y-shaped exit orifices of area ($A_c$) of about 197 mils$^2$ (1.27 mm$^2$, 0.0127 cm$^2$), which corresponds to a $D_{RND}$ of about 15.9 mils (0.40 mm, 0.04 cm) with an $L/D_{RND}$ of about 1.5 (as essentially as described in Examples 45–47 of U.S. Pat. No. 4,195,051). The 9×36 mil metering capillaries provided better mechanical quality and along-end denier uniformity than the 12×50 mil metering capillaries. The 100-filament yarns could be drawn without forming broken filaments to nominal 50 denier, or about 0.5 dpf.

EXAMPLE VIII

Poly(ethylene terephthalate) polymer modified with about 2 mole % of ethylene 5-sodium-sulfo isophthalate having a nominal LRV of about 15.3 was spun using a laminar cross-flow quench apparatus with a 2.2 inches (5.6 cm) delay, essentially as described in U.S. Pat. No. 4,529,368, and converging the filament bundle at about 43-inches (109 cm) with metered finish tip guides. The lower LRV is usually preferred for ionically modified polyesters because the ionic sites act as cross linking agents and provide higher melt viscosity. The 15 LRV used, herein, had a melt viscosity about that of a 20 LRV homopolymer. If, however, one wanted to spin low LRV homopolymer, then typically it is advantageous to add viscosity builders, such as tetra-ethyl silicate (as described in Mead and Reese, U.S. Pat. No. 3,335,211). It is generally preferred to spin ionically modified polyesters with LRV in the range of about 13 to about 18 and nonionically modified polyesters with LRV in the range of about 18 to about 23. Withdrawal speeds were increased from 2400 ypm (2.2 km/min) to 3000 ypm (2.74 km/min). As expected the cationic copolymer yarns had lower $T_B$-values based on their lower LRV. The lower LRV is preferred for filaments yarns used in napped and brushed fabrics and for tows to be cut into flock. The as-spun yarns could be drawn without breaking filaments to about 50 denier 100-filament varns. The cationically modified polyester had a RDDR value of 0.225 versus 0.125 for the 2GT homopolymer spun under similar conditions.

EXAMPLE IX

Poly(ethylene terephthalate) of nominal 21.9 LRV (about 0.67 [$\eta$]) and containing 0.3 weight percent $TiO_2$ was spun using apparatus similar to Example IV with a air flow rate of about 30 m/min. Examples IX-1 through IX-3 use 12×50 mil (0.305×1.270 mm, 0.0305×0.127 cm) spinneret capillaries; Examples IX-4 through IX-7 use 9×36 mil (0.229×0.914 mm, 0.0229×0.0914 cm) spinneret capillaries; and Examples IX-8 through IX-11 use 6×18 mil (0.152×0.457 mm, 0.0152×0.0457 cm) spinneret capillaries to spin nominal 50 denier 100-filament low-shrinkage yarns suitable as direct-use textile yarns for warp knits and wovens and as feed yarns for air-jet and stuffer-box texturing wherein no draw is required.

It was expected that mechanical quality would improve by increasing the capillary shear rate ($G_a$) as taught by Frankfort and Knox in U.S. Pat. No. 4,134,882. This improvement was observed for the 9×36 mil capillaries vs. the 12×50 mil capillaries; however, unexpectedly, higher polymer temperatures were required to spin with the 6×18 mil capillaries. From calculations of polymer temperature increase due to the higher shear rate ($G_a$), of the 6×18 mil capillaries, it was expected the 6×18 mil capillaries would actually require lower polymer temperatures ($T_p$) than that for the 9×36 and 12×50 mil capillaries, as per the teaching of Frankfort and Knox. However, it was necessary to increase polymer temperature by about 5°–6° C. to provide acceptable spinning continuity for the high shear 6×18 mil capillary spinnerets. It is speculated that at these low mass flow rates (w), the higher shear of the 6×18 mil capillaries induces molecular ordering of the polymer melt and may even induce nucleation with the effect of increasing the apparent polymer melting point $(T_M)_a$ as represented by the following empirical expression for $(T_M)_a$ as a function of capillary shear (Ga): that is, $(T_M)_a = T_M^0 + 2\times10^{-4}[(L/D_{RND})(Ga)$, ° C.]. The differential polymer spin temperature, defined herein by:

$$[T_P-(T_M)_a]=[(T_P-T_M^0)-[2\times10^{-4}(L/D_{RND})Ga],$$

is effectively reduced as the product of the apparent shear rate ($G_a$) and $L/D_{RND}$-ratio is increased; and thereby requiring an increase in polymer temperature $T_P$ to maintain a minimum differential spin temperature at least about 25° C. and, preferably at least about 30° C. for spinning continuity. This is contrary to what is expected from the teachings of Frankfort and Knox. Process and product results are summarized in Tables IV and V.

EXAMPLE X

Poly(ethylene terephthalate) of nominal 21.9 LRV (about 0.67 [$\eta$]) and containing 0.3 weight percent $TiO_2$ was spun using apparatus similar to Example IV with an air flow rate varied from about 11 to about 30 m/min.

Examples X-10 through X-15 use 12×50 mil (0.305×1.270 mm, 0.0305×0.127 cm) spinneret capillaries and Examples X-1 through X-9 use 9×36 mil (0.229×0.914 mm, 0.0229×0.0914 cm) spinneret capillaries to spin nominal 70 denier 100-filament low-shrinkage yarns with $T_7$-values greater than about 1 g/d, making these especially suitable as direct-use textile yarns for warp knits and wovens and as feed yarns for air-jet and stuffer-box texturing wherein no draw is required. It was observed that mechanical quality improved with higher polymer temperatures, and lower air flow rates. Changing the convergence guide distance $L_c$ had little effect on mechanical properties, as has been observed for higher dpf filaments (Bayer German Patent No. 2,814,104). Unfortunately the process changes which improve mechanical quality caused a deterioration in the along-end denier uniformity. Successful spinning of fine filaments with both good mechanical quality and denier uniformity requires a balance between "hot" polymer for mechanical quality and "rapid" cooling of polymer for uniformity. This in contrary to the teachings of Frankfort and Know which wherein the combination of "hot" polymer with slow quenching by use of low quench rates, delay shrouds, and/or heated delay quench were used to provide for good quality filaments of deniers greater than 1. Balancing higher "input" polymer temperatures ($T_P$) with shear heating via smaller diameter capillary spinnerets and rapid quenching via short delay lengths ($L_{DQ}$) permits, in general, a better balance of yarn properties. Shortening the convergence length ($L_c$) improved the uniformity and reduced winding tensions as a result of lower air drag. At the higher spun deniers of Frankfort and Knox, no significant improvements are found for shortening the convergence length. Process and product results are summarized in Tables V and VI.

EXAMPLE XI

The fine filament feed yarns of Example V-11, 12, and 13 were uniformly drawn cold and at 155° C. at 1.45×, 1.5×, and 1.55× draw-ratios, respectively, to give nominal 50 denier 100-filament drawn yarns that can be used as flat textile yarns. The drawn fine filament yarns have excellent mechanical quality and along-end denier uniformity with boil-off shrinkages (S) less than about 6%. The cold drawn yarns had slightly less shrinkage than the hot drawn yarns and also were slightly more uniform. With less interlace levels and a different finish, these yarns may be cold drawn air-jet textured, consistent with the teachings of Knox and Noe in U.S. Pat. No. 5,066,447. These fine filament spun yarns could also be used as feed yarns for draw air-jet/stuffer-box/friction-twist texturing. Warp draw process and product details are summarized in Table VII.

EXAMPLE XII

Examples III-20 through 25 were repeated by varying spin speed and spun denier to provide draw feed yarns capable of being drawn to provide 35 denier 68-filament yarns. Nominal 50 to 60 denier as-spun yarns with excellent mechanical quality and denier uniformity were drawn cold and heat set at 160° C. to 180° C. to obtain low shrinkage filaments of nominal 0.5 dpf yarns without loss in mechanical quality and along-end denier uniformity. Spin process and product details are summarized in Tables II, and the corresponding draw process and product details are summarized in Table VIII.

EXAMPLE XIII

In Example XIII the ability to obtain high $T_7$ fine filament yarns was explored. Spinning apparatus similar to that in Example X was used. Poly(ethylene terephthalate) of nominal 20.8 LRV (0.65 [$\eta$]) containing 0.3 weight percent $TiO_2$ was extruded through 9×36 mil (0.229×0.914 mm, 0.0229×0.0914 cm) spinneret capillaries and cooled using a radial quench apparatus as described in Example I, except for having a delay length $L_{DQ}$ of about 2.25 inches (5.7 cm). The cooled filaments were converged into yarn bundles at a convergence length ($L_c$) of about 32 inches (81.3 cm) from the face of the spinneret by use of metered finish tip guides. The withdrawal speed (V) was varied from 4500 ypm (4.12 km/min) to 5300 ypm (4.85 km/min) to provide 68 and 100-filament direct-use textile yarns with $T_7$-values between about 1 and 1.5 g/d. The process and product details are summarized in Table VI. The tensiles of Example XIII were inferior due to use of lower polymer melt temperature ($T_P$) and higher quench air flow rates ($V_a$) than in Example X.

EXAMPLE XIV

A 91 denier 100-filament yarn made according to Example IV was air-jet textured using a Barmag FK6T80 at 300 km/min; wherein, the as-spun yarns were drawn cold (about 40° C.) at 1.0×, 1.1×, 1.2×, and 1.32× draw-ratios and sequentially air-jet textured using a conventional air-jet at 125 lbs./in$^2$ (8.8 kg/cm$^2$) to provide bulky yarns with filament deniers between about 0.7 and 0.9 (before boil-off shrinkage) and between about 0.77 and 0.94 dpf (after boil-off shrinkage). The denier of the textured filament yarn, wherein no draw was taken, showed an increase in yarn denier of about 11% due to bulk (e.g., filament loops), where the ratio $(\text{denier})_{AJT}/(\text{denier})_{FLAT}$ is preferably greater than about 1.1); however, the filament denier showed no increase in denier. Textured yarn strengths, as expected, were lower than that of a drawn flat yarn due to the filament loops; but are adequate for bulky fabric end-uses. Even at a 1.32×draw-ratio, giving a textured yarn with a 27.2% residual elongation (corresponding to a 1.27 residual draw ratio RDR), the boil-off (S)and dry heat (DHS) shrinkages were only about 12.7% and 11%, respectively, with a shrinkage shrinkage ($\Delta S = DHS - S$) less than about (1.7). With heat setting these shrinkages can be reduced to about 2%, if desired. Example XIV-1 and 2 were uniformly cold partially drawn, as defined herein, by providing a RDR of at least about 1.4× in the drawn yarn. The capability of these fine filaments to be uniformly partially drawn is attributed to the crystalline structure of the as-spun filaments providing a thermal shrinkage less than about 12%, preferably less than about 10%, and especially less than about 8%, as per Knox and Noe in U.S. Pat. No. 5,066,447. In Example XIV-5 through 8, 68-filament yarns were sequentially draw cold and air-jet textured. The shrinkage increased with draw ratio, providing a route to higher shrinkage AJT yarns. The process and product data for Example XIV is given in Table VIII.

Co-mingling (plying) 2 or more cold drawn AJT yarn textile yarns, wherein at least one AJT yarn has been heat set to shrinkages less than about 3%, and a second AJT yarn has not been heatset, so has significantly higher shrinkage, provides a simplified route to a mixed shrinkage yarn. Similar mixed shrinkage AJT yarns may be provided with the lower shrinkage component provided by alternate techniques, for instance by hot drawing, with or without heat setting. Alternatively, mixed shrinkage AJT yarns may be provided by co-mingling 2 or more drawn filament bundles wherein both bundles are drawn by cold drawing, without post heat treatment, but the bundles are cold drawn to different elongations, preferably by about 10% or more. The resulting mixed shrinkage drawn yarn may be AJT to provide a mixed shrinkage textured (bulked) yarn. Incorporating filaments of different deniers and/or cross-sections may also be used to reduce filament-to-filament packing and thereby improve tactile aesthetics and comfort. Unique dyeability effects may be obtained by co-mingling drawn filaments of differing polymer modifications, such as homopolymer dyeable with disperse dyes and ionic copolymers dyeable with cationic dyes. AJT process and product details are summarized in Table VIII.

EXAMPLE XV

In Example XV yarns were spun for use as draw feed yarns (DFY) in false twist texturing (FTT). Example XV-1, a nominal 58 denier 68-filament yarn was textured at 500 m/min on a L900 PU machine with a 1.707 D/Y-ratio at a 1.628× draw to provide 68-filament textured yarns of nominal 37 denier (0.54 dpf) with a tenacity (T) of 4.1 g/d, an elongation-at-break ($E_B$) of 26.8%, a tenacity-at-7%-elongation ($T_7$) of 2.19 g/d, and an initial modulus (M) of 44.6 g/d. In Example XV-2 a nominal 118 denier 200-filament draw feed yarn was prepared for false twist texturing, as in Example XV-1, except with a D/Y-ratio of 1.59 at a 1.461X draw-ratio to provide 200-filament textured yarns of 83.5 nominal denier (0.42 dpf) with a tenacity (T) of about 3.25 g/d and an elongation-at-break ($E_B$) of about 23.9%. The 200-filament yarns were also successfully "partially" warp drawn as per the teachings of Knox and Noe in U.S. Pat. No. 5,066,447 with a 1.49X draw-ratio to provide a nominal 79.6 denier 200-filament flat yarn having a 4.81 g/d tenacity and a 45.1% elongation-at-break ($E_B$). In Example XV-5 a nominal 38 denier 100-filament yarn was prepared for use as a draw feed yarn in false-twist texturing and in warp drawing. The process operability for Example XV-3 was better with 6×18 mil (0.152×0.457 mm) capillaries than with 9×36 mil (0.229×0.914 mm) capillaries. The yarns of Example XV-3 were warp drawn over a range of conditions in Example XVIII to provide 0.22 to 0.27 dpf 100-filament yarns for wovens and knit fabrics.

EXAMPLE XVI

In Example XVI 21.2 LRV polyester polymer containing 0.035 weight percent $TiO_2$ was extruded at 285° C. through 9×36 mil (0.229×0.914 mm) metering capillaries with a four-diamond-shaped corrugated ribbon cross-section exiting orifice of area 318 mils$^2$ (0.205 mm$^2$). The 80 denier 100-filament bundles were quenched using radial quench apparatus similar to that used in Example III having a delay length of 2.9 cm and converged by a metered finish tip applicator at 109 cm from the face of the spinneret and withdrawn at a spin speed of 2350 ypm (2.15 km/min). Yarns quenched with 47.5 mpm room temperature air had a along-end denier spread (DS) of about 1.6–1.8%, a BOS of about 2.8%, an average elongation-at-break ($E_B$) of 92.9%, an average tenacity-at-break ($T_B$) of 4.56 g/d to give a $(T_B)_n/T_7$-ratio of about 4.3. Decreasing quench air velocity to 21.7 m/min increased the $T_B$ to about 4.64 g/d with a $(T_B)_n/T_7$-ratio of about 4.5. The lower $T_B$-values (i.e., less than about 5) are a consequence of the corrugated filament cross-sectional shape and such filaments may be used in processes, such as false-twist texturing (FTT) and air-jet texturing (AJT) where filament fracture is desired to give even finer filaments (i.e., even less than about 0.2 dpf) for a more spun-like aesthetics.

EXAMPLE XVII

In Example XVII nominal 43 denier 50-filaments with a concentric void of about 16–17% were spun at 3500 ypm (3.2 km/min) and at 4500 ypm (4.12 km/min). The hollow filaments were formed by post-coalescence of nominal 21.2 LRV polymer at 290° C. using segmented capillary orifices with 15×72 mil (0.381×1.829 mm) metering capillaries as essentially described by Champaneria etal in U.S. Pat. No. 3,745,061, Farley and Barker in Br. Patent No. 1,106,263, Hodge in U.S. Pat. No. 3,924,988 (FIG. 1), Most in U.S. Pat. No. 4,444,710 (FIG. 3), in Br. Pat. Nos. 838,141, and 1,106,263. The geometry of the entrance capillary (counterbore) to the segmented orifices was adjusted to optimize the extrudate bulge and minimize pre-mature collapse of the hollow melt spinline. The ratio of the inner and outer diameters of the circular cross-section formed by the segmented orifices was adjusted to provide percent void content greater than about 10% and preferably greater than about 15%. The void content is found to increase with extrusion void area ($\pi ID^2/4$), mass flow rate, polymer melt viscosity (i.e., proportional to $LRV/T_P$) and with increasing withdrawal speed (V) and the above process parameters are selected to obtain at least about 10% and preferably at least about 15% void content (VC). For example the fine hollow filaments were quenched using radial quench apparatus fitted with a short delay shroud as described in Example XVI, except air flow was reduced to about 16 m/min and converted via a metered finish tip applicator at a distance less than about 140 cm. The yarns spun at 3.2 km/min had tenacity/elongation/-modulus of about 3 gpd/90%/45 gpd, respectively and a tenacity-at-7%-elongation ($T_7$) of about 0.88 g/d. Yarns spun at 4.115 km/min had tenacity/elongation/-modulus of about 2.65 gpd/46%/64 gpd, respectively, and a tenacity-at-7%-elongation ($T_7$) of about 1.5 g/d. Yarns spun at 3.2 and 4.12 km/min had boil-off shrinkage (S) values between about 3–5%.

EXAMPLE XVIII

In Example XVIII, the spun yarns of Example XV-5 were drawn over a range of draw-ratios from 1.4X to 1.7X to provide drawn filament yarns of deniers 26.6 to 22.2, respectively; with tenacities increasing from 4.38 g/d to 5.61 g/d and elongations-at-break ($E_B$) decreasing from 36.6% to 15.8% with increasing draw-ratio. All the draw yarns had boil-off shrinkages (S) of about 4%.

EXAMPLE XIX

In Example XIX-1 and XIX-2, 200-filament and 168-filament yarns (feed yarns from Example XV-3 and 4, respectively) of nominal 0.5 dpf were spun at 4400 ypm (4.02 km/min) for use as direct-use flat yarns in woven and knit fabrics. These yarns can also be air-jet textured (AJT) without draw to provide low-shrinkage AJT yarns of nominal 3% shrinkage.

EXAMPLE XX

In Example XX mixed filament yarns were prepared by co-spinning sub denier filaments of the invention with higher denier filaments, such as the low shrinkage filaments as described by Knox in U.S. Pat. No. 4,156,071 and/or the high shrinkage filaments described by Piazza and Reese in U.S. Pat. No. 3,772,872 to provide the potential for mixed-shrinkage (e.g., post-bulking in fabric) such as in the case when the low shrinkage filaments of this invention are combined with the high shrinkage filaments of Piazza and Reese. On-line thermal treatment by use of a heated tube or a steam jet, wherein essentially no reduction in filament denier takes place (i.e., no space drawing) of mixed dpf low shrinkage filament yarns, such as those prepared by co-spinning filaments of this invention with those as described by Knox in U.S. Pat. No. 4,156,071, provides a route to unique mixed shrinkage post-bulkable filament yarns wherein the shrinkage of the sub denier filaments of this invention remain essentially unchanged while the shrinkage of the higher denier filaments (e.g., 2–4 dpf) is increased from initial boil-off shrinkage (S) of less than about 6–10% to greater than 10%, typically about 15–35%. The mixed shrinkage yarns prepared with the mentioned intermediate heat treatment differ from those obtained by combining the low shrinkage filaments of this invention with the higher shrinkage filaments of Piazza and Reese in that the heat treated high shrinkage filaments have significantly improved shrinkage tension (e.g., at least about 0.15 g/d) which permits development of the bulk from the mixed-shrinkage even in very tightly constructed woven fabrics.

The combination of high shrinkage and high shrinkage tension (herein called shrinkage power) was heretofore only obtained, for example, by fully drawing conventional LOY/MOY/POY followed by no or low temperature annealing. The sub denier filaments of the invention migrate to the surface on mixed shrinkage and provide a soft luxurious tactile aesthetics even in the most tightly constructed fabrics. The heat treatment is typically carried out after the filaments are fully attenuated and quenched to below their glass transition temperature and in a manner that the increase in tension during the heat treatment is of the magnitude equal to that of the observed increase in shrinkage tension by said heat treatment. Selecting heat treatment conditions greater than about the cold crystallization temperature $T_{CC}$(DSC), (typically about 95 to about 115° C.) and less than about the temperature of maximum crystallization $T_C$ (typically about 150° to about 180° C. for most polyesters) gives high shrinkage tension filaments of excellent dyeability (e.g., high RDDR), while treatment under temperatures greater than $T_C$ gives high shrinkage tension filaments of reduced dyeability. The filaments may be heated either by passing through high pressure superheated steam (e.g., 40–140 psi at about 245° C.) or by passing through a heated tube. The high and low dpf filaments may be spun from separate pack cavities and then combined to form a single mixed-dpf filament bundle or may be spun from a single pack cavity, wherein the capillary dimensions (L and D) and the number of capillaries $\#_c$ are selected to provide for differential mass flow rates; e.g., by selecting capillaries such that the ratio of spun filament deniers, $[(dpf)_b/(dpf)_a]$, is approximately equal to $[(L_aD_b/L_bD_a)^n \times (V_a/V_b) \times (D_b/D_a)^3]$, where a and b denote filaments of differing deniers; n = 1 for Newtonian polymer melts (and herein determined experimentally from conventional capillary pressure drop tests) and that the measured average $dpf = [(\#_a dpf_a + \#_b dpf_b)/(\#_a + \#_b)]$. The above heat treatment process can also be used to increase the lower shrinkage of the sub denier filaments of the invention as defined by the needs of the particular end-use, such as increasing from about 3% to about 6–8% with higher shrinkage tension (and shrinkage power) for tightly constructed wovens.

EXAMPLE XXI

In Example XXI 50 denier 68-filament undrawn flat textile yarns were uniformly cold drawn and heat treated at 160°, 170°, and 180° C. to provide nominal 36 denier 68 filament drawn yarns of about 4–5% boil-off shrinkage (S) with a $T_7$ of about 3.5 g/d, a tenacity of about 4.5 g/d with an elongation-at-break ($E_B$) of about 27%. The drawn yarns have a percent Uster of about 2.1–2.4% and may be used for critically dyed fabrics.

EXAMPLE XXII

The fine denier filaments of this invention may be used to cover elastomeric yarns (and tapes) by high speed air-jet entanglement as taught by Strachan in U.S. Pat. No. 3,940,917. Polyester fine filaments prepared from polymer modified for cationic dyeability are especially suitable for elastomeric yarns, such as are sold by Du Pont as Lycra® spandex yarns to prevent "bleeding" of the dyestuff from the elastomeric yarns, such as observed for Lycra® covered with homopolymer polyester dyed with nonionic disperse dyes. The direct-use filaments of this invention are preferred (and those with increased shrinkage, shrinkage tension, and shrinkage power as described in Example XX are especially preferred) for air-entanglement covering and permit the covered elastomeric yarns to be dyed under atmospheric conditions without the use of carriers, e.g., similar to the dye bath conditions to dye nylon filament covered elastomeric yarns (except for being dyed with anionic acid dyes).

Some example fabrics made from the yarns of the invention are: 1) a medical barrier fabric constructed with a low shrinkage 70 denier 100-filament direct-use flat yarn filling and a 70 denier 34-filament conventional warp drawn POY in the warp and woven on a high speed water-jet loom at 420 picks per minute to give a plain weave fabric of 164 ends per inch in the warp and 92 picks per inch in the fill; 2) a lounge wear satin constructed using the above 70 denier 100-filament direct-use yarn in the warp and combining it with a 60 denier 100-filament false twist textured fill to provide a satin with 172 ends per inch in the warp and 100 picks per inch in the fill; and 3) a crepe de chines fabric constructed with the above 70 denier 100-filament direct-use yarn in the warp and a 2-ply 60 denier 100-filament false twist textured yarn in the fill.

For convenience the symbols, and analytical expressions used hereinbefore are listed below, followed by conversions used, all temperatures being in degrees C:

| | |
|---|---|
| PET | Poly(ethylene terephthalate) |
| 2GT | PET |
| $TiO_2$ | Titanium dioxide |
| $SiO_2$ | Silicon dioxide |
| ()f | "of the fiber" |
| ()p | "of the polymer" |
| ()m | "measured" |
| dpf | Denier per Filament (1 gram/9000 meters) |

-continued

| | |
|---|---|
| dpf(ABO) | dpf after boil-off shrinkage |
| dpf(BBO) | dpf before boil-off shrinkage |
| DS | Along-end % Denier Spread (±3 sigma) |
| DTV | Draw tension variation (%) |
| $[\eta]$ | Intrinsic Viscosity (IV) |
| LRV | Relative Viscosity (Lab) |
| IV | Intrinsic Viscosity |
| $LRV_{20.8}$ | LRV of the polyester polymer having the same melt zero-shear Newtonian melt viscosity as 20.8 LRV homopolymer (unmodified 2GT) at 295 degrees °C. |
| °C. | Degrees centigrade |
| $\eta_a$ | Apparent melt viscosity (poise) |
| $\eta_o$ | Melt viscosity as shear rate → 0 |
| X | Weight fraction of delusterant (%/100) |
| $T_M^o$ | Zero-shear polymer melting point (°C.) |
| $(T_M)_a$ | Apparent melting point of polymer (°C.) |
| $T_g$ | Polymer glass-transition temp. (°C. |
| $T_P$ | Polymer melt spin temperature (°C.) |
| $T_a$ | Quench air temperature (°C.) |
| $T_s$ | Spinline surface temperature |
| $t_r$ | Filtration residence time (min) |
| w | Capillary mass flow rate (g/min) |
| q | Capillary volume flow rate ($cm^3$/min) |
| Q | Spin pack flow rate (g/min) |
| $\#_c$ | Number of filaments per spin pack |
| $V_F$ | Spin pack (filled) free-volume ($cm^3$) |
| L | Capillary Length (cm) |
| $L/D_{RND}$ | Capillary Length-Diameter Ratio |
| $D_{RND}$ | Capillary Diameter equal to round capillary of equal x-section area ($A_c$) |
| $D_{ref}$ | Diameter of reference spinneret |
| $D_{sprt}$ | Diameter of test spinneret |
| $A_c$ | Capillary cross-sectional area ($cm^2$) |
| $G_a$ | Apparent capillary shear rate ($sec^{-1}$) |
| $\epsilon_a$ | Apparent spinline strain |
| $E_R$ | Apparent spinline extension ratio ($V/V_o$), where both V and $V_o$ are of the same units of measurements |
| EFD | Extrusion filament density |
| dV/dx | Spinline velocity gradient ($min^{-1}$) |
| $\sigma_a$ | Apparent internal spinline stress (g/d) |
| $V_a$ | Quench air laminar velocity (m/min) |
| $L_{DQ}$ | Quench delay length (cm) |
| $L_c$ | Convergence length (cm) |
| $V_c$ | Spin speed at convergence (km/min) |
| V | Spin (withdrawal) speed (km/min) |
| $V_o$ | Capillary Extrusion velocity (m/min) |
| $A_o$ | Spin pack extrusion area ($cm^2$) |
| $\eta$ | Melt viscosity (poise) |
| DQ | Delay quench |
| ON | Measured at the "neck" point |
| ypm, y/min | yards per min |
| mpm, m/min | meter per min |
| gpm, g/min | grams per min |
| $\rho m$ | Measured fiber density ($g/cm^3$) |
| $\rho cor$ | Fiber density corrected for delusterant |
| $\rho a$ | Amorphous density (1.335 $g/cm^3$) |
| $\rho x$ | Crystal Density (1.455 $g/cm^3$) |
| $X_v$ | Volume fraction crystallinity (%/100) |
| $X_w$ | Weight fraction crystallinity (%/100) |
| S | Percent boil-off shrinkage |
| DHS | Percent dry heat shrinkage |
| ΔS | Shrinkage Differential (DHS-S) |
| $S_m$ | Maximum shrinkage potential (%) |
| ST | Shrinkage Tension (g/d) |
| $ST_{max}$ | Maximum shrinkage tension (g/d) |
| $T(ST_{max})$ | Shrinkage tension peak temperature (°C.) |
| $P_S$ | Shrinkage power (g/d)(%) |
| $T_{SET}$ | Maximum set temperature |
| Mi | Instantaneous tensile modulus (g/d) |
| M | Initial (Young's) tensile modulus (g/d) |
| $M_{py}$ | Post yield modulus (g/d) |
| $T_7$ | Tenacity-at-7%-elongation (g/d) |
| $T_{20}$ | Tenacity-at-20%-elongation (g/d) |
| T | Tenacity (g/d) |
| $T_B$ | Tenacity-at-break (g/dd) |
| $(T_B)_n$ | Normalized $T_B$ (g/d) |
| gpdd, g/dd | Grams per drawn denier |
| gpd, g/d | Grams per (original undrawn) denier |
| SF | Shape Factor (= $P_M/P_{RND}$) |
| $P_M$ | Measured perimeter (P) |

-continued

| | |
|---|---|
| $P_{RND}$ | P of round filament of equal x-section area |
| RDDR | Relative Disperse Dye Rate ($min^{\frac{1}{2}}$) |
| DDR | Disperse Dye Rate ($min^{\frac{1}{2}}$) |
| RDR | Residual Draw-Ratio |
| 1.abX | Draw-ratio of value "1.ab", for example |
| $E_B$ | Elongation-at-Break (%) |
| Tanα | Secant post-yield modulus (g/d) |
| Tanβ | Tangent post-yield modulus (g/d) |
| $\Delta_n$ | Birefringence |
| $\Delta_a$ | Birefringence of amorphous regions |
| $\Delta_c$ | Birefringence of crystalline regions |
| $\Delta^o$ | Intrinsic Birefringence |
| SOC | Stress-Optical Coefficient $(gpd)^{-1}$ |
| $f_a$ | Amorphous orientation function |
| $f_c$ | Crystalline orientation function |
| COA | Crystal orientation angle (WAXS) |
| LPS | Long Period Spacing (SAXS, A) |
| CS | Average (WAXS, 010) crystal size (A) |
| Tcc (DSC) | DSC-cold crystallization temp., (°C.) |
| T(E"max) | E" peak temperature ($T_{60}$) |
| E" | Dynamic loss modulus (g/d) |
| $M_{son}$ | Sonic Modulus (g/d) |
| $M_S$ | Shrinkage Modulus (g/d) |
| SV | Sonic velocity (kg/min) |
| $V_{f,am}$ | Amorphous free-volume ($Å^3$) |
| Å | Angstroms |
| mil | 0.001 inches = 0.0254 mm = 25.4 microns |
| μ | Micron ($10^{-6}$ m = $10^{-4}$ cm = $10^{-3}$ mm) |
| km/min | kilometers/min = $10^3$ meters/minute |
| A | Hydrocarbylenedioxy units [—O—R'—O—] |
| B | Hydrocarbylenedicarbonyl units [—C(O)—R"—C(O)—] |
| R', R" | hydrocarbylene group |
| C,H,O | Carbon, hydrogen, and oxygen |
| —O— | "Oxy" (ether) linkage |
| —C(O)— | Carbonyl group |
| RPC | Rapid Pin Count |
| FOY | Percent weight finish-on-yarn |
| AJT | Air-jet texturing |
| LOY | Low-oriented yarns |
| MOY | Medium-oriented yarns |
| HOY | Highly oriented yarns |
| POY | Partially-oriented yarns |
| SOY | Spin-oriented yarns |
| DUY | Direct-use yarns |
| FDY | Fully drawn yarns |
| PBY | Post-bulkable yarns |
| WDFY | Warp draw feed yarns |
| DFY | Draw feed yarns |
| DTFY | Draw texturing feed yarns |
| FTT | False-twist texturing |
| SBC | Stufer-box crimping |
| SBT | Stuffer-box texturing |
| SDSO | Simplified direct spin-orientation |
| WAXS | Wide-angle x-ray scattering |
| SAXS | Small-angle x-ray scattering |
| DSC | Differential Scanning Calorimetry |
| RAD | Radial quench |
| XF | Cross-flow quench |
| DT | Draw tension (gpd) |
| DTV | Draw tension variation (%) |
| IFDU | Interfilament denier uniformity |
| RND | Round |
| TRI | Trilobal |
| RIB | Ribbon |
| HOL | Hollow |
| ABO | After boil-off shrinkage |
| BBO | Before boil-off shrinkage |
| RV | Relative Viscosity |
| HRV | LRV + 1.2 |
| RV | 1.28 (HRV) |
| FVC | Fractional void content |
| EVA | Extrusion void area |
| ID | Inner diameter |
| OD | outer diameter |
| d | diameter of filament (cm) |
| d(cm) | $11.89 \times 10^{-4}\sqrt{(dpf/\rho)}$ |
| $N_{iso}$ | Isotropic index of refraction |
| $(\eta_o)$2GT | $[0.0653(LRV + 1.2)^{3.33}]$ at 295° C. |
| $(\eta_o)$Tp | $(\eta_o)295°$ C. × $(295/T_p)6$ |
| $ft^3$ | 0.0284 $m^3$ |
| μ (micron) | $10^{-4}$ cm |

-continued

| | |
|---|---|
| mil (0.001") | $2.54 \times 10^{-3}$ cm = 25.4 microns |
| m/min | 0.9144 yd/min |
| dpf | 1 gram/9000 meters |
| g/min | 0.132 pph |
| $(T_M)_a$ | $(T_M)^o + 2 \times 10^{-4}(L/D)G_a$, °C. |
| $G_a$ ($sec^{-1}$) | $(32/60\pi)(w/1.2195)(1/D_{RND})^3$, $sec^{-1}$ |
| $t_R$ (min) | $[1.2195\ V_F(cm^3)]/(w\ \#_c)$, min |
| $\sigma_a$ g/d | $(0.01/SOC)(LRV/LRV_{20.8})(T_R/T_P)^6[V^2/dpf][A_o/\#_c]^{0.7}$ |
| $E_R$ | $V/V_o = 2.25 \times 10^5(1.2195\pi)(D_{RND}^2/dpf)$ |
| $\epsilon_a$ | $Ln(E_R)$ |
| $T_s$ | $660(WL/D^4)^{0.685}$, °C.; (W = pph and L and D in mils |
| $T_R$ | $(T_M)_a + 40°$ C. |
| w | dpf V(mpm)/9000 = dpf V(km/min)/9, g/min |
| $D_{RND}$ | $2(A_c/\pi)^{\frac{1}{2}}$, cm |
| $X_v$ | $(\rho_{cor}-\rho_a)/(\rho_x-\rho_a)$ |
| $X_w$ | $(\rho_x/\rho_{cor})X_v$ |
| $\rho_x$ | 1.455 g/cm$^3$ |
| $\rho_a$ | 1.335 g/cm$^3$ |
| $\rho_{cor}$ | $\rho_{measured}$-0.0087(% $TiO_2$), g/cm$^3$ |
| ΔS | (DHS, %-S, %) |
| $S_M$ | $(550-E_{B,\%})/6.5$, % |
| $M_{py}$ | $(1.2T_{20}-1.07T_7)/(1.2-1.07)$, g/d |
| $T_B$ | (Tenacity, T)(RDR), g/d |

-continued

| | |
|---|---|
| RDR | $(1 + E_B, \%/100)$, |
| $(T_B)_n$ | $T_B \times LRV^{0.75}(1-X)^{-4}$ |
| $\Delta_n$ | $\Delta_c + \Delta_a = \Delta^o[X_v f_c + (1-X_v)f_a]$ |
| $f_c$ | (1-COA/180) |
| f | $\Delta_n/\Delta_n^o = (3 < \cos > ^2-1)/2$ |
| $\Delta_n^o$ | 0.220 |
| SOC | $\Delta_n/\sigma_a = 0.7\ (g/d)^{-1}$ |
| $V_{f,am}$ | $CS^3[(1-X_v)/X_v][1-f_a)/f_a]$, Å$^3$ |
| ΔP = | $4(L/D_{RND})^n\eta_a G_a$, n = 1 for Newtonian melts and as $G_a \rightarrow 0$ |
| $(dpf)_b/(dpf)_a$ | $[(L/D)_a/(L/D)_b]^n\ (V_a/V_b)(D_b/D_a)^3$ |
| ΔP | $4(L/D)\eta_a G_a = 4(L/D)\tau_{wall}$ |
| $\tau_{wall}$ | $\eta_a G_a$ |
| $G_a$ | $(32/\pi\rho)(w/D^3)$, $sec^{-1}$ |
| $V_o$ | $(w/\rho)$/(Area), cm/min |
| g/d | 1.0893N/dtex |
| 1 g | $0.9804 \times 10^3$ dynes |
| 1 N | $10^3$ dynes |
| PSI | 0.0703 kg/cm$^2$ |
| g/cm$^2$ | $0.9(\rho)$(g/d) = $(\rho)$(g/dtex) |
| EVA | $\pi(ID^2/4)$ |
| FVC | $(ID/OD)^2$ |
| $P_S$ | (ST, g/d) × (S, %) |
| ABO | BBO[100/(100-S)] |

TABLE I

| EX.-ITEM | 1-1 | 1-2 | 1-3 | 1-4 | 2-1 | 2-2 | 2-3 | 2-4 | 2-5 | 2-6 | 3-1 |
|---|---|---|---|---|---|---|---|---|---|---|---|
| POLYMER | | | | | | | | | | | |
| LRV | 19 | → | → | → | 20.8 | → | → | → | → | → | 21.2 |
| TiO2% | .30 | → | → | → | .10 | → | → | → | → | → | .035 |
| FIL/YARN | | | | | | | | | | | |
| dpf | .53 | .52 | .49 | .51 | .74 | .99 | .94 | .75 | .63 | .50 | .73 |
| % Fils | 300 | 100 | 300 | 100 | 68 | 100 | 80 | 100 | 80 | 100 | 68 |
| Yarn Denier | 158 | 51.7 | 148 | 50.6 | 50 | 99 | 75 | 75 | 50 | → | → |
| EXTRUSION | | | | | | | | | | | |
| TP, °C. | 290 | 290 | 295 | 295 | 299 | 301 | 300 | → | 200 | → | 288 |
| /Ro, cm −2 | 12.6 | 4.2 | 12.6 | 4.2 | 2.8 | 4.2 | 3.3 | 4.2 | 3.3 | 4.2 | 2.8 |
| , g/min | .188 | .185 | .225 | .233 | .300 | .402 | .382 | .305 | .256 | .203 | .282 |
| q, cm 3/min | .155 | .152 | .185 | .191 | .246 | .330 | .313 | .250 | .210 | .167 | .231 |
| tr, min | 1.05 | 3.22 | 0.88 | 2.57 | 2.93 | 1.48 | 1.96 | 1.96 | 2.92 | 2.93 | 3.12 |
| L, mils | 9 | 60 | 9 | 60 | → | → | → | → | → | → | 20 |
| L, cm K10 | .229 | 1.52 | .229 | 1.52 | → | → | → | → | → | → | .508 |
| DRND, mils | 6 | 15 | 6 | 15 | → | → | → | → | → | → | 9 |
| DRND, cm K10 | .152 | .381 | .152 | .381 | → | → | → | → | → | → | .229 |
| L/DRND | 1.5 | 4 | 1.5 | 4 | → | → | → | → | → | → | 2.22 |
| AC, mil 2 | 28.3 | 176.8 | 28.3 | 176.8 | → | → | → | → | → | → | 63.6 |
| AC, cm 2 H10 3 | .182 | 1.14 | .182 | 1.14 | → | → | → | → | → | → | .411 |
| Ga, sec −1 | 7389 | 465 | 8844 | 586 | 755 | 1011 | 961 | 767 | 644 | 511 | 3284 |
| (L/DRND)GaH10 −1 | 1108 | 186 | 1327 | 234 | 302 | 404 | 384 | 397 | 258 | 204 | 729 |
| k(L/DRND)Ga, °C. | 2.2 | 0.4 | 2.7 | 0.5 | 0.6 | 0.8 | 0.7 | 0.8 | 0.5 | 0.4 | 1.4 |
| QUENCHING | | | | | | | | | | | |
| LDQ, cm | 2.5 | 2.5 | 4.8 | → | 5.7 | → | → | → | → | → | 6.7 |
| 12 dpf, cm | 8.7 | 8.7 | 7.6 | 8.6 | 10.1 | 11.9 | 11.6 | 10.4 | 9.5 | 8.5 | 10.3 |
| Va, m/min | 21.3 | → | → | → | → | → | → | → | → | → | 13.1 |
| Lc, cm | 137 | → | → | → | → | → | → | → | → | → | 109 |
| 50 90 dpf, cm | 116 | 115 | 117 | 114 | 126 | 140 | 137 | 128 | 121 | 114 | 127 |
| SPINNING | | | | | | | | | | | |
| V, y/min | 3500 | 3500 | 4500 | 4500 | 4000 | → | → | → | → | → | 3800 |
| V, m/min | 3200 | 3200 | 4115 | 4115 | 3658 | → | → | → | → | → | 3475 |
| ER(=V/Vo) | 378 | 2407 | 409 | 2455 | 1692 | 1265 | 1332 | 1669 | 1987 | 2504 | 617 |
| εa [=lN(ER)] | 5.93 | 7.79 | 6.01 | 7.81 | 7.43 | 7.14 | 7.19 | 7.42 | 7.59 | 7.83 | 6.43 |
| εahT7, g/d | 5.34 | 9.82 | 7.03 | 10.3 | 6.76 | 5.89 | 6.04 | 7.20 | — | — | 6.43 |
| YARN | | | | | | | | | | | |
| S, % | 55 | 35 | 11.2 | 7.4 | 25 | 11 | 7 | 12 | — | — | — |
| Mi, g/d | 43 | 55 | 59 | 65 | 45 | 37 | 36 | 38 | — | — | — |
| T7, g/d | 0.90 | 1.26 | 1.17 | 1.32 | 0.91 | 0.84 | 0.84 | 0.97 | — | — | 1.00 |
| E8, % | 85 | 63 | 76 | 62 | 66 | 81 | 86 | 77 | — | — | 101 |
| T, g/d | 3.0 | 3.1 | 3.6 | 3.4 | 3.1 | 3.3 | 3.4 | 3.5 | — | — | 3.14 |
| T8, g/d | 5.55 | 5.05 | 6.34 | 5.51 | 5.15 | 5.97 | 5.58 | 6.20 | — | — | 6.32 |
| (T8)n, g/d | 5.77 | 5.57 | 6.87 | 5.97 | 5.17 | 6.00 | 5.60 | 6.23 | — | — | 6.23 |
| (T8)n/T7 | 6.41 | 4.42 | 5.87 | 4.52 | 5.68 | 7.14 | 6.66 | 6.42 | — | — | 6.23 |
| DS, % | — | — | — | — | 3.5 | 2.7 | 2.0 | 3.5 | — | — | 1.24 |
| DTV, % | — | — | — | — | — | — | — | — | — | — | 0.29 |
| BFS | NO | NO | NO | NO | NO | NO | NO | NO | YES | YES | NO |

| EX.-ITEM | 3-2 | 3-3 | 3-4 | 3-5 | 3-6 | 3-7 | 3-8 | 3-9 | 3-10 | 3-11 |
|---|---|---|---|---|---|---|---|---|---|---|
| POLYMER | | | | | | | | | | |
| LRV | → | → | → | → | → | → | → | → | 20.8 | 21.2 |

TABLE I-continued

| | | | | | | | | | | |
|---|---|---|---|---|---|---|---|---|---|---|
| TiO2% | → | → | → | → | → | → | → | → | .030 | .035 |
| FIL/YARN | | | | | | | | | | |
| dpf | → | → | → | → | → | .88 | .51 | .76 | .49 | .51 |
| % Fils | → | → | → | → | → | → | → | → | → | → |
| Yarn Denier | → | → | → | → | → | 60 | 35 | 51.5 | 33 | 35 |
| EXTRUSION | | | | | | | | | | |
| TP, °C. | → | → | → | → | 289 | 289 | 300 | 288 | 294 | 290 |
| /Ro, cm −2 | → | → | → | → | → | → | → | → | → | → |
| , g/min | .297 | .312 | .326 | .341 | .282 | .224 | .233 | .332 | .224 | .241 |
| q, cm 3/min | .244 | .256 | .268 | .280 | .231 | .184 | .191 | .272 | .184 | .198 |
| tr, min | 2.95 | 2.81 | 2.69 | 2.57 | 3.12 | 3.92 | 3.77 | 4.11 | 3.92 | 3.64 |
| L, mils | → | → | → | → | → | → | 50 | → | → | → |
| L, cm K10 | → | → | → | → | → | → | 1.27 | → | → | → |
| DRND, mils | → | → | → | → | → | → | → | → | → | → |
| DRND, cm H10 | → | → | → | → | → | → | → | → | → | → |
| L/DRND | → | → | → | → | → | → | 5.56 | → | → | → |
| AC, mil 2 | → | → | → | → | → | → | → | → | → | → |
| AC, cm 2 H10 3 | → | → | → | → | → | → | → | → | → | → |
| Ga, sec −1 | 3459 | 3634 | 3797 | 3971 | 3284 | 2609 | 2714 | 3867 | 2609 | 2807 |
| (L/DRND/Ga 10 −1 | 658 | 807 | 842 | 471 | 729 | 579 | 1509 | 2151 | 1451 | 1561 |
| k(L/DRND)Ga, °C. | 1.3 | 1.6 | 1.7 | 0.9 | 1.4 | 1.2 | 3.0 | 4.3 | 2.9 | 3.1 |
| QUENCHING | | | | | | | | | | |
| LDQ, cm | → | → | → | → | → | → | → | → | → | → |
| 12 dpf, cm | → | → | → | → | → | 11.3 | 8.6 | 10.5 | 8.4 | 8.6 |
| Va, m/min | → | → | → | → | 16.3 | → | 21.3 | → | 18.9 | 13.1 |
| Lc, cm | → | → | → | → | → | → | → | → | → | → |
| 50 90 dpf, cm | → | → | → | → | → | 135 | 115 | 129 | 113 | 114 |
| SPINNING | | | | | | | | | | |
| V, y/min | 4000 | 4200 | 4408 | 4600 | 3800 | 2500 | 4500 | 4300 | 4500 | 4650 |
| V, m/min | 3658 | 3841 | 4024 | 4206 | 3475 | 2286 | 4115 | 3932 | 4115 | 4252 |
| ER(=V/Vo) | → | → | → | → | → | 512 | 884 | 593 | 920 | 884 |
| εa [=ln(ER)] | → | → | → | → | → | 6.24 | 6.78 | 6.39 | 6.82 | 6.78 |
| εahT7, g/d | 6.94 | 7.59 | 8.36 | 9.00 | 5.79 | 3.18 | — | 6.90 | 9.34 | 8.81 |
| YARN | | | | | | | | | | |
| S, % | — | — | 2.9 | — | 3.7 | — | — | 3.3 | 4.6 | — |
| Mi, g/d | — | — | — | — | — | — | — | — | 71.6 | — |
| T7, g/d | 1.08 | 1.18 | 1.30 | 1.40 | 0.90 | 0.51 | — | 1.08 | 1.37 | 1.30 |
| E8, % | 94.1 | 94.2 | 87.4 | 79.6 | 99.7 | 136.8 | — | — | 54.5 | 71.0 |
| T, g/d | 3.12 | 3.21 | 3.12 | 3.09 | 3.29 | 2.98 | — | — | 3.02 | 2.97 |
| T8, g/d | 6.06 | 6.23 | 5.85 | 5.55 | 6.57 | 7.06 | — | — | 4.67 | 5.08 |
| (T8)n, g/d | 5.98 | 6.11 | 5.77 | 5.47 | 6.48 | 6.96 | — | — | 4.69 | 5.01 |
| (T8)n/T7 | 5.53 | 5.17 | 4.43 | 3.90 | 7.20 | 13.6 | — | — | 3.42 | 3.85 |
| OS, % | 1.22 | 1.26 | 1.26 | 1.35 | 1.69 | 1.56 | — | 1.3 | — | 1.42 |
| DTV, % | 0.21 | 0.26 | 0.26 | 0.21 | 0.34 | 0.50 | — | 1.0 | — | 0.37 |
| BFS | NO | NO | NO | NO | NO | NO | YES | YES | YES | YES |

TABLE 2

| EX.-ITEM | 3-12 | 3-13 | 3-14 | 3-15 | 3-16 | 3-17 | 3-18 | 3-19 | 3-20 | 3-21 | 3-22 |
|---|---|---|---|---|---|---|---|---|---|---|---|
| POLYMER | | | | | | | | | | | |
| LRV | 21.2 | → | → | → | → | → | → | → | → | → | → |
| TiO2% | .035 | → | → | → | → | → | → | → | → | → | → |
| FIL/YARN | | | | | | | | | | | |
| dpf | .51 | → | → | → | .89 | .75 | .70 | .89 | .88 | .88 | .83 |
| % Fils | 136 | → | → | → | 68 | → | → | → | → | → | → |
| Yarn Denier | 70 | → | → | → | 60.6 | 50.8 | 50.8 | 60.4 | 60.6 | 60.6 | 56.1 |
| EXTRUSION | | | | | | | | | | | |
| TP, °C. | 291 | → | → | 287 | 287 | 291 | 291 | 288 | → | → | → |
| /Ro, cm −2 | 5.6 | → | → | → | 2.8 | → | → | → | → | → | → |
| , g/min | .209 | .225 | .246 | .225 | .244 | .229 | .235 | .225 | .244 | .263 | .260 |
| q, cm 3/min | .172 | .185 | .202 | .185 | .200 | .187 | .192 | .185 | .200 | .216 | .213 |
| tr, min | 3.25 | 3.02 | 2.77 | 3.02 | 3.60 | 3.85 | 3.75 | 3.90 | 3.60 | 3.34 | 3.38 |
| L, mils | 36 | → | → | → | → | → | → | 20 | → | → | → |
| L, cm K10 | .914 | → | → | → | → | → | → | .508 | → | → | → |
| DRND, mils | 9 | → | → | → | → | → | → | → | → | → | → |
| DRND, cm K10 | .229 | → | → | → | → | → | → | → | → | → | → |
| L/DRND | 4 | → | → | → | → | → | → | 2.22 | → | → | → |
| AC, mil 2 | 63.6 | → | → | → | → | → | → | → | → | → | → |
| AC, cm 2 H10 3 | .411 | → | → | → | → | → | → | → | → | → | → |
| Ga, sec −1 | 2435 | 2621 | 2866 | 2621 | 2843 | 2668 | 2738 | 2620 | 2842 | 3063 | 3038 |
| (L/DRND)GaH10 −1 | 974 | 1049 | 1146 | 1049 | 1137 | 1067 | 1095 | 582 | 631 | 681 | 673 |
| k(L/DRND)Ga, °C. | 1.9 | 2.1 | 2.3 | 2.1 | 2.3 | 2.1 | 1.2 | 1.2 | 1.3 | 1.4 | 1.4 |
| QUENCHING | | | | | | | | | | | |
| LDQ, cm | 6.7 | → | → | → | → | → | → | → | → | → | → |
| 12 dpf, cm | 8.6 | → | → | → | 11.3 | 10.4 | 8.4 | 11.3 | 11.3 | 11.3 | 10.9 |
| Va, m/min | 30.6 | → | → | → | → | → | → | 16.3 | → | → | → |
| Lc, cm | 109 | → | → | → | → | → | → | → | → | → | → |
| 50 90 dpf, cm | 115 | → | → | → | 135 | 128 | 125 | 135 | 135 | 135 | 132 |

TABLE 2-continued

| | | | | | | | | | | | |
|---|---|---|---|---|---|---|---|---|---|---|---|
| SPINNING | | | | | | | | | | | |
| V, y/min | 4000 | 4300 | 4700 | 4300 | 2700 | 3000 | 3300 | 2500 | 2700 | 2900 | 3100 |
| V, m/min | 3658 | 3932 | 4298 | 3932 | 2469 | 2743 | 3018 | 2286 | 2469 | 2652 | 2835 |
| ER(=V/Vo) | 884 | → | → | 506 | 610 | 644 | 644 | 506 | 506 | 506 | 546 |
| εa [=ln(ER)] | 6.78 | → | → | 6.23 | 6.41 | 6.47 | 6.47 | 6.22 | 6.22 | 6.22 | 6.30 |
| εahT7, g/d | 6.92 | 7. 6 | 8.61 | 7.79 | 3.72 | 3.82 | 4.21 | 3.17 | 3.36 | 3.61 | 4.22 |
| YARN | | | | | | | | | | | |
| T7, g/d | 1.02 | 1.10 | 1.27 | 1.25 | 0.58 | 0.59 | 0.65 | 0.51 | 0.54 | 0.58 | 0.67 |
| E8, % | 82.7 | 76.1 | 69.8 | 70.1 | 127.5 | 104.8 | 108.3 | 143.8 | 139.2 | 133.2 | 128.3 |
| T, g/d | 3.22 | 3.20 | 3.19 | 3.12 | 2.73 | 2.52 | 2.95 | 2.97 | 3.05 | 3.10 | 3.25 |
| T8, g/d | 5.88 | 5.63 | 5.42 | 5.31 | 6.20 | 5.16 | 6.14 | 7.24 | 7.30 | 7.23 | 7.42 |
| (T8)n, g/d | 5.82 | 5.57 | 5.37 | 5.26 | 6.14 | 5.11 | 6.08 | 7.17 | 7.23 | 7.16 | 7.35 |
| (T8)n/T7 | 5.70 | 5.06 | 4.22 | 4.20 | 10.5 | 8.66 | 9.35 | 14.0 | 13.3 | 12.3 | 10.9 |
| OS, % | 1.17 | 1.36 | 1.72 | 1.61 | 0.99 | 1.06 | 1.03 | 1.56 | 1.54 | 1.48 | 1.68 |
| DTV, % | 0.22 | 0.36 | 0.28 | 0.33 | 0.53 | 0.40 | 0.46 | 0.67 | 0.65 | 0.47 | 0.34 |

| EX.-ITEM | 3-23 | 3-24 | 3-25 | 4-1 | 4-2 | 4-3 | 4-4 | 4-5 | 4-6 | 4-7 |
|---|---|---|---|---|---|---|---|---|---|---|
| POLYMER | | | | | | | | | | |
| LRV | → | → | → | → | 21.1 | 20.6 | → | → | 20.6 | → |
| TiO2% | → | → | → | → | .30 | 1.0 | → | → | 1.0 | → |
| FIL/YARN | | | | | | | | | | |
| dpf | .75 | .75 | .75 | .70 | → | → | → | → | .70 | → |
| % Fils | → | → | → | 100 | → | → | → | → | 100 | → |
| Yarn Denier | 50.9 | 50.8 | 50.8 | 70 | → | → | → | → | 70 | → |
| EXTRUSION | | | | | | | | | | |
| TP, °C. | → | → | → | → | 288 | → | → | → | 288 | → |
| /Ro, cm −2 | → | → | → | 4.2 | → | → | → | → | 4.2 | → |
| , g/min | .259 | .274 | .298 | .331 | .327 | .327 | .270 | .285 | .299 | .313 |
| q, cm 3/min | .213 | .225 | .244 | .271 | .254 | .254 | .222 | .233 | .245 | .257 |
| tr, min | 3.37 | 3.21 | 2.95 | 1.81 | 1.93 | 1.93 | 2.21 | 2.10 | 2.00 | 1.91 |
| L, mils | → | → | → | 36 | → | → | → | → | 36 | → |
| L, cm K10 | → | → | → | .914 | → | → | → | → | .914 | → |
| DRND, mils | → | → | → | → | → | → | → | → | 9 | → |
| DRND, cm K10 | → | → | → | → | → | → | → | → | .229 | → |
| L/DRND | → | → | → | 4 | → | → | → | → | 4 | → |
| AC, mil 2 | → | → | → | → | → | → | → | → | 63.6 | → |
| AC, cm 2 H10 3 | → | → | → | → | → | → | → | → | .411 | |
| Ga, sec −1 | 3028 | 3191 | 3471 | 3856 | 3810 | 3810 | 3146 | 3321 | 2484 | 3646 |
| (L/DRND)GaH10 −1 | 673 | 709 | 771 | 1543 | 1524 | 1524 | 1258 | 1328 | 1393 | 1459 |
| k(L/DRND)Ga, °C. | 1.4 | 1.4 | 1.5 | 3.1 | 3.0 | 3.0 | 2.5 | 2.7 | 2.8 | 2.9 |
| QUENCHING | | | | | | | | | | |
| LDQ, cm | → | → | → | → | → | → | → | → | 6.7 | → |
| 12 dpf, cm | 10.4 | 10.4 | 10.4 | 8.4 | → | → | → | → | 8.4 | → |
| Va, m/min | → | → | → | 13.1 | 21.2 | 13.1 | → | → | 13.1 | → |
| Lc, cm | → | → | → | → | → | → | → | → | 109 | → |
| 50 90 dpf, cm | 128 | 128 | 128 | 125 | → | → | → | → | 125 | → |
| SPINNING | | | | | | | | | | |
| V, y/min | 3400 | 3600 | 3800 | 4650 | 4600 | 4600 | 3800 | 4000 | 4200 | 4400 |
| V, m/min | 3109 | 3292 | 3475 | 4252 | 4206 | 5206 | 3475 | 3658 | 3840 | 4023 |
| ER(=V/Vo) | 603 | 603 | 603 | 644 | → | → | → | → | 644 | → |
| εa [=ln(ER)] | 6.40 | 6.40 | 6.40 | 6.47 | → | → | → | → | 6.47 | → |
| εahT7, g/d | 4.99 | 5.38 | 5.82 | 7.96 | 8.35 | 7.44 | 6.15 | 6.21 | 6.60 | 7.18 |
| YARN | | | | | | | | | | |
| T7, g/d | 0.78 | 0.84 | 0.90 | 1.23 | 1.29 | 1.15 | 0.95 | 0.96 | 1.02 | 1.11 |
| EB, % | 107.4 | 110.2 | 109.1 | 69.9 | 82.8 | 82.3 | 102.6 | 97.2 | 91.8 | 87.0 |
| T, g/d | 3.31 | 3.31 | 3.37 | 3.34 | 3.00 | 2.90 | 2.95 | 2.95 | 2.93 | 2.91 |
| T8, g/d | 6.78 | 6.96 | 7.05 | 5.67 | 5.48 | 5.29 | 5.98 | 5.82 | 5.62 | 5.44 |
| (T8)n, g/d | 6.71 | 6.89 | 6.98 | 5.61 | 5.37 | 5.18 | 6.10 | 5.70 | 5.51 | 5.33 |
| (T8)n/T7 | 8.60 | 8.20 | 7.57 | 4.56 | 4.16 | 4.50 | 6.42 | 5.93 | 5.40 | 4.80 |
| DS, % | 1.71 | 1.73 | 1.69 | 1.7 | 1.46 | 2.01 | 2.10 | 2.07 | 2.08 | 1.98 |
| DTV, % | 0.52 | 0.52 | 0.34 | — | — | 0.44 | 0.52 | 0.44 | 0.47 | 0.42 |

TABLE III

| EX.-ITEM | 4-8 | 4-9 | 5-1 | 5-2 | 5-3 | 5-4 | 5-5 | 5-6 | 5-7 | 5-8 | 5-9 |
|---|---|---|---|---|---|---|---|---|---|---|---|
| POLYMER | | | | | | | | | | | |
| LRV | 20.6 | → | 21.1 | → | → | → | → | → | → | → | → |
| TiO2% | 1.0 | → | .30 | → | → | → | → | → | → | → | → |
| FIL/YARN | | | | | | | | | | | |
| dpf | .70 | → | .85 | → | → | → | → | → | .77 | .78 | .76 |
| % Fils | 100 | → | → | → | → | → | → | → | → | → | → |
| Yarn Denier | 70 | → | 85 | → | → | → | → | → | 77 | 78 | 76 |
| EXTRUSION | | | | | | | | | | | |
| TP, °C. | 288 | → | 286 | → | → | → | 287 | 292 | 287 | → | → |
| /Ro, cm −2 | 4.2 | → | → | → | → | → | → | → | → | → | → |
| , g/min | .316 | .358 | .207 | .233 | .259 | .285 | .259 | .259 | .258 | .262 | .255 |
| q, cm 3/min | .260 | .293 | .170 | .191 | .212 | .234 | .212 | .212 | .212 | .214 | .209 |
| tr, min | 1.88 | 1.67 | 2.88 | 2.57 | 2.31 | 2.09 | 2.31 | → | → | 2.29 | 2.34 |

TABLE III-continued

| | | | | | | | | | | | |
|---|---|---|---|---|---|---|---|---|---|---|---|
| L, mils | 36 | → | 50 | → | → | → | 36 | 18 | 36 | → | 50 |
| L, cm K10 | .914 | → | 1.27 | → | → | → | .914 | .457 | .914 | → | 1.27 |
| DRND, mils | 9 | → | 12 | → | → | → | 9 | 6 | 9 | → | 12 |
| DRND, cm K10 | .229 | → | .305 | → | → | → | .229 | .152 | .229 | → | .305 |
| L/DRND | 4 | → | 4.17 | → | → | → | 4 | 3 | 4 | → | 4.17 |
| AC, mil 2 | 63.5 | → | 113.1 | → | → | → | 63.6 | 28.3 | 63.6 | → | 113.1 |
| AC, cm 2 H10 3 | .411 | → | .731 | → | → | → | .411 | .182 | .411 | → | .730 |
| Ga, sec −1 | 3681 | 4169 | 1016 | 1144 | 1272 | 1399 | 3017 | 10181 | 3006 | 3052 | 1252 |
| (L/DRND)GaH10 −1 | 1473 | 1668 | 424 | 477 | 530 | 584 | 1207 | 4072 | 1202 | 1221 | 522 |
| k(L/DRND)Ga, °C. | 2.9 | 3.3 | 0.8 | 0.9 | 1.1 | 1.2 | 2.4 | 8.1 | 2.4 | 2.4 | 1.0 |
| QUENCHING | | | | | | | | | | | |
| LDQ, cm | 6. | → | → | → | → | → | → | → | → | 11.8 | 6.7 |
| 12 dpf, cm | 8.4 | → | 11.1 | → | → | → | → | → | 10.5 | → | → |
| Va, m/min | 13.1 | → | 25 | → | → | → | → | → | → | → | → |
| Lc cm | 109 | → | → | → | → | → | → | → | → | → | → |
| 50 90 dpf, cm | 125 | → | 133 | → | → | → | → | → | 129 | → | → |
| SPINNING | | | | | | | | | | | |
| V, y/min | 4450 | 4600 | 2400 | 2700 | 3000 | 3300 | 3000 | → | 3300 | → | → |
| V, m/min | 4069 | 4206 | 2195 | 2469 | 2743 | → | 3018 | 2743 | 3018 | → | → |
| ER(=V/Vo) | 644 | → | 943 | → | → | → | 530 | 236 | 585 | → | 1054 |
| εa [=ln(ER)] | 6.47 | → | 6.85 | → | → | → | 6.27 | 5.46 | 6.37 | → | 6.96 |
| εahT7, g/d | 7.38 | 7.44 | 4.38 | 5.14 | 5.62 | 6.58 | 5.27 | 4.48 | 6.12 | 5.92 | 6.68 |
| YARN | | | | | | | | | | | |
| T7, g/d | 1.14 | 1.15 | 0.64 | 0.75 | 0.82 | 0.96 | 0.84 | 0.82 | 0.96 | 0.93 | 0.96 |
| E8, % | 86.0 | 82.3 | 136.2 | 124.9 | 118.0 | 104.1 | 116.2 | 117.8 | 103.9 | 107.4 | 103.8 |
| T, g/d | 2.91 | 2.90 | 2.83 | 2.90 | 3.08 | 3.11 | 2.98 | 2.64 | 3.14 | 3.16 | 3.19 |
| T8, g/d | 5.38 | 5.29 | 6.68 | 6.70 | 6.71 | 6.35 | 6.27 | 5.75 | 6.40 | 6.55 | 6.50 |
| (T8)n, g/d | 5.59 | 5.50 | 6.65 | 6.61 | 6.62 | 6.26 | 6.10 | 5.67 | 6.31 | 6.46 | 6.41 |
| (T8)n/T7 | 4.90 | 4.78 | 10.4 | 8.81 | 8.07 | 6.52 | 7.35 | 6.91 | 6.57 | 6.94 | 6.67 |
| DS, % | 1.61 | 2.01 | 1.85 | 1.46 | 1.09 | 1.01 | 0.97 | 0.9 | 1.09 | 3.98 | 0.99 |
| DTV, % | 0.42 | 0.44 | 0.57 | 0.53 | 0.38 | 0.34 | 1.50 | 0.57 | 0.37 | 1.01 | 0.37 |
| IFDU, % | — | — | 7.8 | 8.1 | 8.1 | 7.9 | 5.9 | — | 6.5 | 11.4 | 5.9 |

| EX.-ITEM | 5-10 | 5-11 | 5-12 | 5-13 | 6-1 | 6-2 | 6-3 | 6-4 | 6-5 | 6-6 |
|---|---|---|---|---|---|---|---|---|---|---|
| POLYMER | | | | | | | | | | |
| LRV | → | → | → | → | → | → | → | 21.1 | → | → |
| TiO2% | → | → | → | → | → | → | → | 0.3 | → | → |
| FIL/YARN | | | | | | | | | | |
| dpf | .76 | .83 | .76 | .69 | .42 | .56 | .75 | .42 | .56 | .75 |
| % Fils | → | → | → | → | → | → | → | → | → | → |
| Yarn Denier | 76 | 83 | 76 | .69 | 42 | 56 | 75 | 42 | 56 | 75 |
| EXTRUSION | | | | | | | | | | |
| TP, °C. | → | 291 | → | → | → | → | → | → | → | → |
| /Ro, cm −2 | → | → | → | → | → | → | → | → | → | → |
| , g/min | .255 | .202 | .232 | .245 | .141 | .188 | .252 | .141 | .188 | .252 |
| q, cm 3/min | .209 | .166 | .190 | .201 | .115 | .154 | .206 | .115 | .154 | .206 |
| tr, min | → | 2.95 | 2.58 | 2.44 | 4.26 | 3.18 | 2.38 | 4.26 | 3.18 | 2.38 |
| L, mils | → | 36 | → | → | → | → | → | → | → | → |
| L, cm K10 | → | .914 | → | → | → | → | → | → | → | → |
| DRND, mils | → | 9 | → | → | → | → | → | → | → | → |
| DRND, cm K10 | → | .229 | → | → | → | → | → | → | → | → |
| L/DRND | → | 4 | → | → | → | → | → | → | → | → |
| AC, mil 2 | → | 63.6 | → | → | → | → | → | → | → | → |
| AC, cm 2 H10 3 | → | .411 | → | → | → | → | → | → | → | → |
| Ga, sec −1 | → | 2352 | 2703 | 2854 | 1643 | 2190 | 2936 | 1643 | 2190 | 2936 |
| (L/DRND)GaH10 −1 | → | 941 | 1081 | 1142 | 657 | 876 | 1174 | 657 | 876 | 1174 |
| k(L/DRND)Ga, °C. | → | 1.9 | 2.1 | 2.2 | 1.3 | 1.7 | 2.3 | 1.3 | 1.7 | 2.3 |
| QUENCHING | | | | | | | | | | |
| LDQ, cm | 11.8 | 6.7 | → | → | → | → | → | 2.9 | → | → |
| 12 dpf, cm | → | 10.9 | 10.4 | 10.0 | 7.8 | 9.0 | 10.4 | 7.8 | 9.0 | 10.4 |
| Va, m/min | → | 21 | 19 | → | 16.3 | → | → | → | → | → |
| Lc, cm | → | → | → | → | → | → | → | → | → | → |
| 50 90 dpf, cm | → | 132 | 129 | 124 | 108 | 117 | 128 | 108 | 117 | 128 |
| SPINNING | | | | | | | | | | |
| V, y/min | → | 2400 | 3000 | 3300 | → | → | → | → | → | → |
| V, m/min | → | 2195 | 2743 | 3018 | → | → | → | → | → | → |
| ER(=V/Vo) | → | 543 | 593 | 653 | 1073 | 805 | 601 | 1073 | 805 | 601 |
| εa [=ln(ER)] | → | 6.30 | 6.39 | 6.48 | 6.98 | 6.69 | 6.40 | 6.98 | 6.69 | 6.40 |
| εahT7, g/d | 6.61 | 5.86 | 6.22 | 6.29 | | | | | | |
| YARN | | | | | | | | | | |
| T7, g/d | 0.95 | 0.93 | 0.96 | 0.97 | — | — | — | — | — | — |
| E8, % | 104.7 | 106.8 | 104.2 | 103.0 | — | — | — | — | — | — |
| T, g/d | 3.15 | 3.20 | 3.30 | 3.30 | — | — | — | — | — | — |
| T8, g/d | 6.45 | 6.62 | 6.74 | 6.70 | — | — | — | — | — | — |
| (T8)n, g/d | 6.36 | 6.53 | 6.65 | 6.61 | — | — | — | — | — | — |
| (T8)n/T7 | 6.69 | 7.02 | 6.92 | 6.81 | — | — | — | — | — | — |
| DS, % | 4.16 | 1.26 | 1.44 | 1.26 | 12.1 | 3.8 | 2.4 | 3.6 | 2.6 | 1.1 |
| DTV, % | 0.74 | 0.84 | 0.96 | 0.69 | — | 1.3 | 0.9 | 1.5 | 0.7 | 1.7 |

TABLE III-continued

| | | | | | | | | | | | |
|---|---|---|---|---|---|---|---|---|---|---|---|
| IFDU, % | | 11.2 | — | — | — | — | — | — | — | — | — |

TABLE IV

| EX.-ITEM | 6-7 | 6-8 | 6-9 | 6-10 | 7-1 | 7-2 | 7-3 | 7-4 | 7-5 | 7-6 | 7-7 |
|---|---|---|---|---|---|---|---|---|---|---|---|
| POLYMER | | | | | | | | | | | |
| LRV | 21.1 | → | → | → | → | → | → | → | → | → | → |
| TiO2, % | 0.3 | → | → | → | .035 | → | → | → | → | → | → |
| FIL/YARN | | | | | | | | | | | |
| dpf | .42 | → | → | → | .90 | 1.15 | .81 | .81 | .81 | .84 | .84 |
| % Fils | 100 | → | → | → | → | → | → | → | → | → | → |
| Yarn Denier | 42 | → | → | → | 90 | 115 | 80.9 | 81.2 | 80.8 | 80.5 | 81.2 |
| EXTRUSION | | | | | | | | | | | |
| TP, °C. | 293 | 296 | 291 | → | 288 | 290 | → | 288 | 292 | 287 | → |
| /Ro, cm −2 | 4.2 | → | → | → | → | → | → | → | → | → | → |
| , g/min | .141 | → | → | → | .215 | .275 | .247 | .272 | .272 | .213 | .233 |
| q, cm 3/gm | .115 | → | → | → | .166 | .225 | .208 | .223 | .223 | .175 | .191 |
| tr, min | 4.26 | → | → | → | 2.95 | 2.18 | 2.36 | 2.20 | 2.20 | 2.80 | 2.56 |
| L, mils | 36 | → | → | → | 50 | → | → | → | → | 36 | → |
| L, cm K10 | .914 | → | → | → | 1.27 | → | → | → | → | .914 | → |
| DRND, mils | 9 | → | → | → | 12 | → | → | → | → | 9 | → |
| DRND, cm K10 | .299 | → | → | → | .305 | → | → | → | → | .229 | → |
| L/DRND | 4 | → | → | → | 4.17 | → | → | → | → | 4 | → |
| AC, mil 2 | 63.6 | → | → | → | 113.1 | → | → | → | → | 63.6 | → |
| AC, mm 2 H10 3 | .411 | → | → | → | .730 | → | → | → | → | .411 | → |
| Ga, sec −1 | 1643 | → | → | → | 1056 | 1350 | 1213 | 1336 | 1336 | 2481 | 2714 |
| (L/DRND)GaH10 −1 | 6571 | → | → | → | 440 | 563 | 586 | 557 | 557 | 993 | 1086 |
| k(L/DRND)Ga, °C. | 13.1 | → | → | → | 0.9 | 1.1 | 1.0 | 1.1 | 1.1 | 2.0 | 2.2 |
| QUENCHING | | | | | | | | | | | |
| LDQ, cm | 2.9 | → | → | → | 6.7 | → | → | → | → | → | → |
| 12 dpf, cm | 7.8 | → | → | → | 11.4 | 12.9 | 10.8 | → | → | 11.0 | 11.0 |
| Va, m/min | 16.3 | → | → | → | → | → | → | → | → | → | → |
| Lc, cm | 109 | → | 97 | 81 | 137 | → | → | → | → | → | → |
| 50 90 dpf, cm | 109 | → | → | → | 135 | 147 | 131 | → | → | 132 | → |
| SPINNING | | | | | | | | | | | |
| V, y/min | 3300 | → | → | → | 2350 | 2350 | 3000 | 3300 | 3300 | 2500 | 2700 |
| V, m/min | 3018 | → | → | → | 2149 | 2149 | 2743 | 3018 | 3018 | 2286 | 2469 |
| ER(=V/Vo) | 1073 | → | → | → | 890 | 697 | 989 | → | → | 537 | 537 |
| εa [=ln(ER)] | 6.98 | → | → | → | 6.79 | 6.55 | 6.90 | → | → | 6.29 | 6.29 |
| εahT7, g/d | — | — | — | — | 4.69 | 8.82 | 5.93 | 6.49 | 7.31 | 4.91 | 5.22 |
| YARN | | | | | | | | | | | |
| T7, g/d | — | — | — | — | 0.69 | 0.43 | 0.86 | 0.94 | 1.06 | 0.78 | 0.83 |
| E8, % | — | — | — | — | 120.6 | 132.8 | 94.3 | 93.7 | 73.8 | 121.6 | 116.8 |
| T, g/d | — | — | — | — | 2.51 | 2.00 | 2.49 | 2.87 | 2.13 | 2.70 | 2.88 |
| T8, g/d | — | — | — | — | 5.55 | 4.66 | 4.83 | 5.57 | 3.71 | 5.99 | 6.25 |
| (T8)N, g/d | — | — | — | — | 5.47 | 4.59 | 4.76 | 5.49 | 3.65 | 5.90 | 6.16 |
| (T8)n/T7 | — | — | — | — | 7.9 | 10.7 | 5.5 | 5.8 | 3.4 | 7.6 | 7.4 |
| DS, % | 3.8 | 3.8 | 3.3 | 3.1 | — | — | 9.9 | 4.3 | 5.0 | 14.2 | 8.4 |
| DTV, % | 1.7 | 1.9 | 1.3 | 1.0 | — | — | — | — | — | 1.70 | 1.19 |

| EX.-ITEM | 7-8 | 7-9 | 7-10 | 7-11 | 8-1 | 8-2 | 8-3 | 9-1 | 9-2 | 9-3 |
|---|---|---|---|---|---|---|---|---|---|---|
| POLYMER | | | | | | | | | | |
| LRV | → | → | → | → | 15.7 | → | → | 21.9 | → | → |
| TiO2, % | → | → | → | → | → | → | → | → | → | → |
| FIL/YARN | | | | | | | | | | |
| dpf | .85 | .81 | .85 | .81 | .86 | .76 | .78 | .5 | → | → |
| % Fils | → | → | → | → | → | → | → | → | → | → |
| Yarn Denier | 84.7 | 81.2 | 84.5 | 81.2 | 85.6 | 76.0 | 78.1 | 50 | → | → |
| EXTRUSION | | | | | | | | | | |
| TP, °C. | → | 290 | 287 | 292 | 284 | 284 | 285 | 289 | 291 | 293 |
| /Ro, cm −2 | → | → | → | → | → | → | 4.2 | 4.2 | → | → |
| , g/min | .259 | .247 | .276 | .272 | .210 | .208 | .238 | 218 | .239 | .254 |
| q, cm 3/min | .212 | .208 | .227 | .223 | .172 | .171 | .195 | 169 | .184 | .208 |
| tr, min | 2.31 | 2.36 | 2.16 | 2.20 | 2.85 | 2.84 | 2.51 | 2.90 | 2.66 | 2.36 |
| L, mils | → | → | → | → | → | → | → | 50 | → | → |
| L, cm K10 | → | → | → | → | → | → | → | 1.27 | → | → |
| DRND, mils | → | → | → | → | → | → | → | 12 | → | → |
| DRND, cm K10 | → | → | → | → | → | → | → | .305 | → | → |
| L/DRND | → | → | → | → | → | → | → | 4.17 | → | → |
| AC, mil 2 | → | → | → | → | → | → | → | 113.1 | → | → |
| AC, cm 2 H10 3 | → | → | → | → | → | → | → | .730 | → | → |
| Ga, sec −1 | 3017 | 2878 | 3215 | 3169 | 2447 | 2423 | 2773 | 1070 | 1166 | 1247 |
| (L/DRND)GaH10 −1 | 1207 | 1151 | 1286 | 1268 | 979 | 969 | 1109 | 442 | 487 | 521 |
| k(L/DRND)Ga, °C. | 2.4 | 2.3 | 2.6 | 2.6 | 1.9 | 1.9 | 2.2 | 0.9 | 0.9 | 1.0 |
| QUENCHING | | | | | | | | | | |
| LDQ, cm | → | → | → | → | 7.1 | → | → | 6.7 | → | → |
| 12 dpf, cm | 11.1 | 10.8 | 11.1 | 10.8 | 11.1 | 10.5 | 10.6 | 10.0 | → | → |
| Va, m/min | → | → | → | → | 25 | → | 25 | 30.6 | → | → |

TABLE IV-continued

| | | | | | | | | | | |
|---|---|---|---|---|---|---|---|---|---|---|
| Lc, cm | → | → | → | → | 109 | → | 109 | 100 | → | → |
| 50 90 dpf, cm | 133 | 131 | 133 | 131 | 133 | 128 | 129 | 114 | → | → |
| SPINNING | | | | | | | | | | |
| V, y/min | 3000 | 3000 | 3200 | 3300 | 2400 | 2700 | 3000 | 4300 | 4700 | 5000 |
| V, m/min | 2743 | 2743 | 2926 | 3018 | 2195 | 2468 | 2743 | 3932 | 4298 | 4570 |
| ER(=V/Vo) | 530 | 556 | 530 | 556 | 524 | 593 | 586 | 1602 | → | → |
| εa [=ln(ER)] | 6.27 | 6.56 | 6.27 | 6.56 | 6.26 | 6.39 | 6.37 | 7.38 | → | → |
| εahT7, g/d | 5.70 | 5.32 | 6.08 | 5.64 | 3.88 | 4.92 | 4.97 | 10.1 | 9.74 | 11.1 |
| YARN | | | | | | | | | | |
| T7, | 0.91 | 0.81 | 0.97 | 0.86 | 0.62 | 0.77 | 0.78 | 1.37 | 1.32 | 1.51 |
| E8, % | 108.5 | 98.5 | 102.8 | 93.3 | 127.8 | 113. | 102.3 | 67.1 | 69.5 | 66.4 |
| T, g/d | 2.94 | 2.60 | 2.98 | 2.30 | 1.81 | 1.88 | 1.89 | 3.19 | 3.28 | 3.14 |
| T8, g/d | 6.14 | 5.17 | 6.05 | 4.44 | 4.13 | 4.00 | 3.82 | 5.33 | 5.56 | 5.22 |
| (T8)N, g/d | 6.05 | 5.09 | 5.96 | 4.33 | 5.54 | 5.36 | 5.12 | 4.58 | 4.78 | 4.49 |
| (T8)n/T7 | 6.6 | 6.3 | 6.1 | 5.0 | 8.9 | 7.0 | 6.6 | 3.35 | 3.62 | 3.03 |
| DS, % | 2.4 | 9.1 | 1.7 | 4.95 | 2.33 | 3.47 | 2.33 | 1.42 | 1.34 | 1.29 |
| DTV, % | 0.44 | — | 0.33 | — | 0.81 | 0.75 | 0.63 | .41 | .36 | .23 |

TABLE V

| EX.-ITEM | 9-4 | 9-5 | 9-6 | 9-7 | 9-8 | 9-9 | 9-10 | 9-11 | 10-1 | 10-2 | 10-3 |
|---|---|---|---|---|---|---|---|---|---|---|---|
| POLYMER | | | | | | | | | | | |
| LRV | 21.9 | → | → | → | → | → | → | → | 21.9 | → | → |
| TiO2, % | 0.3 | → | → | → | → | → | → | → | → | → | → |
| FIL/YARN | | | | | | | | | | | |
| dpf | 0.5 | → | → | → | → | → | → | → | 0.7 | → | → |
| % Fils | 100 | → | → | → | → | → | → | → | → | → | → |
| Yarn Denier | 50 | → | → | → | → | → | → | → | 70 | → | → |
| EXTRUSION | | | | | | | | | | | |
| TP, °C. | 290 | → | 292 | 293 | 290 | → | → | 297 | 286 | → | → |
| /Ao, cm 2 | 4.2 | → | → | → | → | → | → | → | → | → | → |
| , g/min | .171 | .218 | .239 | .254 | .171 | .218 | .239 | .254 | .334 | → | → |
| q, cm 3/min | .132 | .169 | .184 | .208 | .132 | .169 | .184 | .208 | .258 | → | → |
| tr, min | 3.71 | 2.90 | 2.66 | 2.36 | 3.71 | 2.90 | 2.66 | 2.36 | 1.90 | → | → |
| L, mils | 36 | → | → | → | 18 | → | → | → | 36 | → | → |
| L, cm H10 | .914 | → | → | → | .456 | → | → | → | .914 | → | → |
| DRND, mils | 9 | → | → | → | 6 | → | → | → | 9 | → | → |
| DRND, cm K10 | .229 | → | → | → | .152 | → | → | → | .229 | → | → |
| L/DRND | 4 | → | → | → | 3 | → | → | → | 4 | → | → |
| AC, mil 2 | 63.6 | → | → | → | 28.3 | → | → | → | 63.6 | → | → |
| AC, cm 2 H10 3 | .411 | → | → | → | .182 | → | → | → | .411 | → | → |
| Ga, sec −1 | 1992 | 2540 | 2784 | 2959 | 6722 | 8570 | 9395 | 9985 | 3891 | → | → |
| (L/DRND)GaH10 −1 | 397 | 1016 | 1114 | 1184 | 2017 | 2571 | 2819 | 2995 | 1556 | → | → |
| k(L/DRND)Ga, °C. | 0.8 | 2.0 | 2.2 | 2.3 | 4.0 | 5.5 | 5.6 | 6.0 | 3.1 | → | → |
| QUENCHING | | | | | | | | | | | |
| LDQ, cm | 6.7 | → | → | → | → | → | → | → | → | → | → |
| 12 dpf, cm | 10.0 | → | → | → | → | → | → | → | 8.5 | → | → |
| Va, m/min | 30.6 | → | → | → | → | → | → | → | 11.3 | 21.3 | 30.6 |
| LC, cm | 100 | → | → | → | → | → | → | → | → | → | → |
| 50 90 dpf, cm | 114 | → | → | → | → | → | → | → | 125 | → | → |
| SPINNING | | | | | | | | | | | |
| V, y/min | 4100 | 4300 | 4700 | 5000 | 4100 | 4300 | 4700 | 5000 | 4700 | → | → |
| V, m/min | 3749 | 3932 | 4298 | 4570 | 3749 | 3932 | 4298 | 4572 | 4298 | → | → |
| ER(=V/Vo) | 1602 | 901 | → | → | 401 | → | → | → | 644 | → | → |
| εa [=ln(ER)] | 7.38 | 6.80 | → | → | 5.99 | → | → | → | 6.47 | → | → |
| εahT7, g/d | 9.08 | 8.77 | 11.0 | 11.0 | 5.63 | 8.03 | 7.85 | 8.81 | 7.70 | 7.81 | 8.22 |
| YARN | | | | | | | | | | | |
| S, % | 3.7 | 3.3 | 3.7 | 3.2 | 4.9 | 3.8 | 3.9 | 4.3 | 3.3 | 3.1 | 3.0 |
| Mi, g/d | 42.1 | 39.4 | 42.7 | 46.1 | 35.1 | 47.1 | 45.0 | 50.9 | 44.2 | 50.7 | 47.1 |
| T7, g/d | 1.23 | 1.29 | 1.61 | 1.62 | 0.94 | 1.34 | 1.31 | 1.47 | 1.19 | 1.16 | 1.27 |
| E8, % | 72.9 | 72.8 | 53.1 | 62.8 | 76.4 | 64.3 | 67.9 | 62.7 | 77.5 | 76.8 | 71.7 |
| T, g/d | 3.18 | 3.31 | 2.96 | 3.21 | 3.05 | 3.12 | 3.28 | 3.31 | 3.41 | 3.40 | 3.28 |
| T8, g/d | 5.50 | 5.70 | 4.53 | 5.23 | 5.28 | 5.13 | 5.51 | 5.39 | 6.05 | 6.01 | 5.63 |
| (T8)n, g/d | 4.95 | 5.64 | 4.08 | 4.71 | 4.75 | 5.62 | 4.96 | 4.85 | 5.87 | 5.83 | 5.46 |
| (T8)n/T7 | 4.02 | 4.37 | 2.53 | 2.90 | 5.05 | 4.19 | 3.78 | 3.29 | 4.93 | 5.02 | 4.29 |
| DS, % | 1.40 | 1.30 | 1.31 | 1.58 | 1.47 | 1.49 | 1.54 | 1.38 | 1.67 | 1.96 | 1.29 |
| DTV, % | .52 | .36 | .23 | .25 | .47 | .31 | .40 | .33 | .43 | .73 | .37 |

| EX.-ITEM | 10-4 | 10-5 | 10-6 | 10-7 | 10-8 | 10-9 | 10-10 | 10-11 | 10-12 | 10-13 |
|---|---|---|---|---|---|---|---|---|---|---|
| POLYMER | | | | | | | | | | |
| LRV | → | → | → | → | → | → | → | → | → | → |
| TiO2, % | → | → | → | → | → | → | → | → | → | → |
| FIL/YARN | | | | | | | | | | |
| dpf | → | → | → | → | → | → | → | → | → | → |
| % Fils | → | → | → | → | → | → | → | → | → | → |
| Yarn Denier | → | → | → | → | → | → | → | → | → | → |
| EXTRUSION | | | | | | | | | | |
| TP, °C. | → | → | 294 | → | → | → | 286 | 294 | → | 286 |

TABLE V-continued

| | | | | | | | | | | |
|---|---|---|---|---|---|---|---|---|---|---|
| /Ro, cm −2 | → | → | → | → | → | → | → | → | → | → |
| , g/min | → | → | → | → | → | .355 | → | → | .334 | → |
| q, cm 3/min | → | → | → | → | → | .291 | → | → | .258 | → |
| tr, min | → | → | → | → | → | 1.68 | → | → | 1.9 | → |
| L, mils | → | → | → | → | → | → | 50 | → | → | → |
| L, cm K10 | → | → | → | → | → | → | 1.27 | → | → | → |
| DRND, mils | → | → | → | → | → | → | 12 | → | → | → |
| DRND, cm K10 | → | → | → | → | → | → | .305 | → | → | → |
| L/DRND | → | → | → | → | → | → | 4.17 | → | → | → |
| AC, mil 2 | → | → | → | → | → | → | 113.1 | → | → | → |
| AC, cm 2 H10 3 | → | → | → | → | → | → | .730 | → | → | → |
| Ga, sec −1 | → | → | → | → | → | 4136 | 1743 | → | 1640 | → |
| (L/DRND)GaH10 −1 | → | → | → | → | → | 1654 | 727 | → | 684 | → |
| k(L/DRND)Ga, °C. | → | → | → | → | → | 3.3 | 1.4 | → | 1.3 | → |
| QUENCHING | | | | | | | | | | |
| LDQ, cm | → | → | → | → | → | → | → | → | → | → |
| 12 dpf, cm | → | → | → | → | → | → | 10.0 | → | → | → |
| Va, m/min | 21.3 | 30.6 | 21.3 | → | 30.6 | 21.3 | → | → | → | → |
| Lc, cm | 61 | → | 109 | → | 61 | 109 | → | → | → | → |
| 50 90 dpf, cm | → | → | → | → | → | → | 125 | → | → | → |
| SPINNING | | | | | | | | | | |
| V, y/min | → | → | → | → | → | 5000 | 5000 | → | 4700 | → |
| V, m/min | → | → | → | → | → | 4572 | 4572 | → | 4298 | → |
| ER(=V/Vo) | → | → | → | → | → | 644 | 1145 | → | → | → |
| εa [=ln(ER)] | → | → | → | → | → | 6.47 | 7.04 | → | → | → |
| εahT7, g/d | 8.09 | 8.35 | 7.18 | 7.44 | 7.44 | 7.89 | 8.10 | 8.88 | 8.66 | 7.74 |
| YARN | | | | | | | | | | |
| S, % | 2.9 | 3.0 | 3.4 | 3.1 | 3.1 | 3.1 | 3.2 | 3.4 | 3.1 | 3.5 |
| Mi, g/d | 45.3 | 44.6 | 45.2 | 47.1 | 39.5 | 48.6 | 41.4 | 48.5 | 48.7 | 42.6 |
| T7, g/d | 1.25 | 1.29 | 1.11 | 1.15 | 1.15 | 1.22 | 1.15 | 1.12 | 1.23 | 1.10 |
| E8, % | 71.9 | 68.1 | 77.3 | 75.8 | 74.6 | 74.3 | 78.0 | 78.0 | 75.2 | 83.0 |
| T, g/d | 3.37 | 3.24 | 3.51 | 3.50 | 3.43 | 3.55 | 3.53 | 3.58 | 3.47 | 3.47 |
| T8, g/d | 5.79 | 5.45 | 6.22 | 6.15 | 5.99 | 6.19 | 6.28 | 6.37 | 6.35 | 6.08 |
| (T8)n, g/d | 5.62 | 5.29 | 6.03 | 5.97 | 5.81 | 6.00 | 6.09 | 6.18 | 6.16 | 5.90 |
| (T8)n/T7 | 4.49 | 4.10 | 5.43 | 5.19 | 5.05 | 4.91 | 5.29 | 5.51 | 5.00 | 5.36 |
| DS, % | 1.46 | 1.13 | 1.34 | 1.23 | 1.16 | 1.32 | 1.23 | 1.86 | 1.77 | 2.24 |
| DTV, % | .36 | .22 | .48 | .26 | .21 | 0.67 | 0.52 | 0.42 | 0.45 | 0.45 |

TABLE VI

| EX.-ITEM | 10-14 | 10-15 | 13-1 | 13-2 | 13-3 | 13-4 | 13-5 | 13-6 | 13-7 | 13-8 |
|---|---|---|---|---|---|---|---|---|---|---|
| POLYMER | | | | | | | | | | |
| LRV | 21.9 | → | 20.8 | → | → | → | → | → | → | → |
| TiO2, % | 0.3 | → | → | → | → | → | → | → | → | → |
| FIL/YARN | | | | | | | | | | |
| dpf | 0.7 | → | 0.5 | → | → | → | → | 0.7 | → | → |
| % Fils | 100 | → | → | → | → | → | → | → | → | → |
| Yarn Denier | 70 | → | 50 | → | → | → | → | 70 | → | → |
| EXTRUSION | | | | | | | | | | |
| TP, °C. | 294 | 286 | 293 | → | → | → | → | → | → | → |
| /Ro, cm −2 | 4.2 | → | → | → | → | → | → | → | → | → |
| w, g/min | .306 | → | .229 | .239 | .249 | .259 | .269 | .321 | .335 | .349 |
| q, cm 3/min | .251 | → | .188 | .196 | .204 | .213 | .221 | .263 | .275 | .286 |
| tr, min | 1.95 | → | 2.61 | 2.50 | 2.4 | 2.3 | 2.22 | 1.86 | 1.79 | 1.71 |
| L, mils | 50 | → | 36 | → | → | → | → | → | → | → |
| L, cm K10 | 1.27 | → | .914 | → | → | → | → | → | → | → |
| DRND, mils | 12 | → | 9 | → | → | → | → | → | → | → |
| DRND, cm K10 | .305 | → | .229 | → | → | → | → | → | → | → |
| L/DRND | 4.17 | → | 4 | → | → | → | → | → | → | → |
| AC, mil 2 | 113.1 | → | 63.6 | → | → | → | → | → | → | → |
| AC,cm 2 H10 3 | .730 | → | .411 | → | → | → | → | → | → | → |
| Ga, sec −1 | 1502 | → | 2668 | 2784 | 2901 | 3017 | 3134 | 3735 | 3836 | 4061 |
| (L/DRND)GaH10 −1 | 627 | → | 1067 | 1114 | 1160 | 1207 | 1254 | 1494 | 1534 | 1625 |
| k(L/DRND)Ga, °C. | 1.2 | → | 2.1 | 2.2 | 2.3 | 2.4 | 2.5 | 3.0 | 3.1 | 3.2 |
| QUENCHING | 6.7 | → | 5.7 | → | → | → | → | → | → | → |
| LDQ, cm | 6.7 | → | 5.7 | → | → | → | → | → | → | → |
| 12 dpf, cm | 10.0 | → | 8.5 | → | → | → | → | 10.0 | → | → |
| Va, m/min | 21.3 | → | 18.5 | → | → | → | → | → | → | → |
| Lc, cm | 109 | → | 81 | → | → | → | → | → | → | → |
| 50 90 dpf, cm | 125 | → | 114 | → | → | → | → | 125 | → | → |
| SPINNING | | | | | | | | | | |
| V, y/min | 4300 | → | 4500 | 4700 | 4900 | 5100 | 5300 | 4500 | 4700 | 4900 |
| V, m/min | 3932 | → | 4115 | 4298 | 4481 | 4633 | 4846 | 4115 | 4298 | 4481 |
| ER(=V/Vo) | 1145 | → | 901 | → | → | → | → | 644 | → | → |
| ε a [=ln(ER)] | 7.04 | → | 6.80 | → | → | → | → | 6.47 | → | → |
| εahT7, g/d | 6.97 | 6.69 | 8.36 | 8.36 | 8.98 | 9.52 | 10.1 | 6.66 | 6.92 | 7.44 |
| YARN | | | | | | | | | | |
| S, % | 3.5 | 3.6 | — | 3.2 | 4.0 | 4.0 | 3.2 | 3.5 | 4.5 | 3.5 |
| Mi, g/d | 46.7 | 36.4 | — | — | — | — | — | — | — | — |

TABLE VI-continued

| | | | | | | | | | | |
|---|---|---|---|---|---|---|---|---|---|---|
| T7, g/d | 0.99 | 0.95 | 1.23 | 1.23 | 1.32 | 1.40 | 1.49 | 1.03 | 1.07 | 1.15 |
| E8, % | 84.8 | 89.1 | 52.1 | 58.7 | 53.6 | 47.5 | 45.5 | 66.8 | 69.4 | 67.5 |
| T, g/d | 3.45 | 3.37 | 2.73 | 2.84 | 2.82 | 2.71 | 2.70 | 2.88 | 3.04 | 3.13 |
| T8, g/d | 6.35 | 6.38 | 4.37 | 4.15 | 4.51 | 4.33 | 4.00 | 3.93 | 5.15 | 5.24 |
| (T8)n, g/d | 6.16 | 6.19 | 4.41 | 4.19 | 4.56 | 4.37 | 4.04 | 3.97 | 5.20 | 5.29 |
| (T8)n/T7 | 6.22 | 6.51 | 3.58 | 3.40 | 3.45 | 3.12 | 2.71 | 3.85 | 4.85 | 4.60 |
| DS, % | 1.68 | 1.87 | 3.85 | 1.20 | 1.23 | 1.21 | 1.04 | 1.00 | 0.97 | 0.90 |
| DTV, % | 0.38 | 0.71 | — | — | — | — | — | — | — | — |
| EX.-ITEM | 13-9 | 13-10 | 15-1 | 15-2 | 15-3 | 15-4 | 15-5 | 16-1 | 17-1 | 17-2 |
| POLYMER | | | | | | | | | | |
| LRV | → | → | 21.2 | → | → | → | → | → | → | → |
| TiO2, % | → | → | 0.035 | → | → | → | → | → | → | → |
| FIL/YARN | | | 290 | 294 | → | → | → | 285 | 290 | → |
| dpf | → | → | .85 | .59 | .50 | .45 | .38 | .82 | .86 | .86 |
| % Fils | → | → | 68 | 200 | 200 | 168 | 100 | 100 | 50 | → |
| Yarn Denier | → | → | 58 | 118 | 100 | 75.6 | 38 | 82 | 43 | 43 |
| EXTRUSION | | | | | | | | | | |
| TP, °C. | → | → | 290 | 294 | 294 | 294 | 294 | 285 | 290 | 290 |
| /Ro, cm −2 | → | → | 2.8 | 8.4 | 8.4 | 7.1 | 4.2 | 4.2 | 2.1 | 2.1 |
| , g/min | .363 | .377 | .207 | .144 | .224 | .201 | .093 | .196 | .306 | .394 |
| q, cm 3/min | .298 | .309 | .170 | .119 | .184 | .165 | .076 | .161 | .250 | .324 |
| tr, min | 1.64 | 1.58 | 4.22 | 3.19 | 2.06 | 2.74 | 4.99 | 3.03 | 3.90 | 3.01 |
| L, mils | → | → | 50 | 36 | 36 | 36 | 18 | 36 | 72 | 72 |
| L, cm K10 | → | → | 1.27 | .914 | → | → | .457 | .914 | 1.83 | → |
| DRND, mils | → | → | 9 | → | → | → | 6 | 9 | 15 | → |
| DRND, cm K10 | → | → | .229 | → | → | → | .152 | .229 | .381 | → |
| L/DRND | → | → | 5.6 | 4 | → | → | 3 | 4 | 4.8 | → |
| AC, mil 2 | → | → | 63.6 | → | → | → | 28.3 | 63.6 | 176.6 | → |
| AC, cm 2 H10 3 | → | → | .411 | → | → | → | .182 | .411 | 1.141 | → |
| Ga, sec −1 | 4224 | 4388 | 3349 | 1676 | 2602 | 2343 | 3543 | 2282 | 230 | 991 |
| (L/DRND)GaH10 −1 | 1690 | 1755 | 1875 | 670 | 1041 | 937 | 1093 | 912 | 110 | 476 |
| k(L/DRND)Ga, °C. | 3.4 | 3.5 | 3.8 | 1.4 | 2.1 | 1.9 | 2.2 | 1.8 | 0.2 | 1.0 |
| QUENCHING | | | | | | | | | | |
| LDQ, cm | → | → | 6.7 | 2.9 | → | → | → | → | → | → |
| 12 dpf, cm | → | → | 11.0 | 9.2 | 8.5 | 8.0 | 7.4 | 10.9 | 11.1 | 11.1 |
| Va, m/min | → | → | 16 | 30 | → | → | 16 | 22 | 13 | 13 |
| Lc, cm | → | → | 109 | → | → | → | → | → | → | → |
| 50 90 dpf, cm | → | → | 133 | 119 | 114 | 110 | 105 | 131 | 133 | 133 |
| SPINNING | | | | | | | | | | |
| V, y/min | 5100 | 5300 | 2400 | 2400 | 4400 | 4400 | 2400 | 2350 | 3500 | 4500 |
| V, m/min | 4633 | 4846 | 2195 | 2195 | 4023 | 4023 | 2195 | 2149 | 3200 | 4115 |
| ER(=V/Vo) | → | → | 530 | 764 | 901 | 1001 | 1527 | 550 | 2911 | 2911 |
| εa [=ln(ER)] | → | → | 6.27 | 6.64 | 6.80 | 6.91 | 6.27 | 6.31 | 7.98 | 7.98 |
| εahT7, g/d | 7.89 | 8.54 | — | 4.78 | 9.86 | — | — | 6.37 | 7.02 | 12.0 |
| YARN | | | | | | | | | | |
| S, % | 3.4 | 4.0 | — | — | 2.8 | 3.4 | 15.5 | 2.5 | 4.3 | 5.10 |
| Mi, g/d | — | — | — | — | — | — | — | — | — | — |
| T7, g/d | 1.22 | 1.32 | — | .72 | 1.45 | 1.34 | 0.79 | 1.01 | 0.88 | 1.50 |
| E8, % | 56.3 | 54.8 | 144.9 | 126.6 | 82.8 | 86.5 | 121.8 | 92.9 | 90.0 | 46.0 |
| T, g/d | 2.91 | 2.93 | 2.88 | 2.97 | 3.12 | 3.22 | 3.23 | 2.40 | 3.00 | 2.65 |
| T8, g/d | 4.55 | 4.54 | 7.05 | 6.72 | 5.70 | 6.01 | 7.16 | 4.64 | 5.70 | 3.87 |
| (T8)n, g/d | 4.60 | 4.59 | 6.98 | 6.66 | 3.89 | 5.64 | 7.09 | 4.54 | 5.64 | 3.83 |
| (T8)n/T7 | 3.77 | 3.47 | — | 9.25 | 2.68 | 4.21 | 9.06 | 4.50 | 6.41 | 2.55 |
| DS, % | 2.90 | 2.90 | 4.26 | — | — | — | — | — | — | — |
| DTV, % | — | — | — | 0.62 | 0.34 | 0.34 | 0.99 | — | — | — |

TABLE VII

| EX.-ITEM | 11-1 | 2 | 3 | 4 | 5 | 6 | 7 | 8 | 9 |
|---|---|---|---|---|---|---|---|---|---|
| PROCESS | | | | | | | | | |
| Type | WD | → | → | → | → | → | → | → | → |
| Speed, mpm | 600 | → | → | → | → | → | → | → | → |
| Draw Temp., °C. | COLD | → | → | 155 | → | → | COLD | → | → |
| Set Temp., °C. | OFF | → | → | → | → | → | → | → | → |
| Draw Ratio | 1.45 | 1.50 | 1.55 | 1.45 | 1.50 | 1.55 | 1.45 | 1.50 | 1.55 |
| YARN | | | | | | | | | |
| fils | 100 | → | → | → | → | → | → | → | → |
| Denier | 58.4 | 56.2 | 54.7 | 58.6 | 56.7 | 55.0 | 53.2 | 51.4 | 50.3 |
| S, % | 4.8 | 4.7 | 5.3 | 5.9 | 5.5 | 5.7 | 4.6 | 4.6 | 4.5 |
| MOD., g/d | 82.7 | 89.4 | 93.9 | 86.7 | 90.4 | 95.2 | 91.0 | 96.1 | 100.5 |
| T7, g/d | 3.2 | 3.7 | 4.1 | 3.2 | 3.7 | 4.1 | 3.4 | 3.9 | 4.3 |
| EB, % | 33.7 | 28.8 | 25.7 | 35.3 | 31.2 | 25.8 | 34.0 | 26.5 | 22.6 |
| T, g/d | 4.9 | 5.1 | 5.3 | 4.9 | 5.1 | 5.2 | 5.0 | 5.1 | 5.3 |
| DS, % | 1.8 | 1.7 | 1.9 | 2.0 | 1.9 | 1.9 | 1.8 | 1.9 | 1.8 |
| Uster, % | 0.5 | 0.5 | 0.5 | 0.6 | 0.6 | 0.6 | 0.5 | 0.6 | 0.5 |
| EX.-ITEM | 10 | 11 | 12 | 13 | 14 | 15 | 16 | 17 | 18 |
| PROCESS | | | | | | | | | |

TABLE VII-continued

| | | | | | | | | | |
|---|---|---|---|---|---|---|---|---|---|
| Type | → | → | → | → | → | → | → | → | → |
| Speed, mpm | → | → | → | → | → | → | → | → | → |
| Draw Temp., °C. | 155 | → | → | COLD | → | → | 155 | → | → |
| Set Temp., °C. | → | → | → | → | → | → | → | → | → |
| Draw Ratio | 1.45 | 1.50 | 1.55 | 1.45 | 1.50 | 1.55 | 1.45 | 1.50 | 1.55 |
| YARN | | | | | | | | | |
| fils | → | → | → | → | → | → | → | → | → |
| Denier | 53.5 | 51.8 | 49.8 | 48.3 | 46.7 | 45.5 | 48.6 | 47.1 | 46.1 |
| S, % | 5.6 | 5.2 | 5.5 | 4.7 | 4.3 | 4.5 | 5.0 | 5.2 | 5.3 |
| MOD., g/d | 89.9 | 93.5 | 99.2 | 94.7 | 97.4 | 99.3 | 90.5 | 96.8 | 99.4 |
| T7, g/d | 3.4 | 3.9 | 4.4 | 3.6 | 4.0 | 4.4 | 3.6 | 4.0 | 4.4 |
| EB, % | 32.6 | 28.2 | 24.0 | 30.8 | 27.0 | 22.8 | 30.8 | 25.5 | 22.5 |
| T, g/d | 4.8 | 5.1 | 5.3 | 5.0 | 5.2 | 5.3 | 4.9 | 5.0 | 5.2 |
| DS, % | 2.0 | 2.7 | 2.1 | 2.1 | 2.2 | 2.2 | 2.2 | 2.2 | 2.3 |
| Uster, % | 0.6 | 0.6 | 0.7 | 0.6 | 0.6 | 0.6 | 0.6 | 0.6 | 0.7 |

TABLE VIII

| EX.-ITEM | 12-1 | 2 | 3 | 4 | 5 | 6 | 14-1 | 2 | 3 | 4 | 5 | 6 | 7 | 8 |
|---|---|---|---|---|---|---|---|---|---|---|---|---|---|---|
| PROCESS | | | | | | | | | | | | | | |
| Type | WD | → | → | → | → | → | AJT | → | → | → | → | → | → | → |
| Speed, mpm | 600 | → | → | → | → | → | 300 | → | → | → | → | → | → | → |
| Draw Temp., °C. | COLD | → | → | → | → | → | → | → | → | → | → | → | → | → |
| Draw Ratio | 1.69 | 1.57 | 1.44 | 1.42 | 1.42 | 1.42 | 1.0 | 1.1 | 1.2 | 1.32 | 1.0 | 1.1 | 1.2 | 1.32 |
| Set Temp., °C. | 180 | 180 | 180 | 180 | 170 | 160 | OFF | → | → | → | → | → | → | → |
| YARN | | | | | | | | | | | | | | |
| fils | 68 | → | → | → | → | → | 100 | → | → | → | 68 | → | → | → |
| Denier | 35.9 | 35.6 | 35.4 | 35.9 | 36.1 | 36.1 | 101.4 | 95.0 | 85.8 | 77.3 | 81.8 | 75.1 | 70.4 | 64.7 |
| Bulk, % | NA | → | → | → | → | → | 11.4 | 11.8 | 11.4 | 12.0 | 12.1 | 13.1 | 15.7 | 17.0 |
| S, % | 3.9 | 4.2 | 4.4 | 4.0 | 4.0 | 4.9 | 3.5 | 4.3 | 8.2 | 12.7 | 3.4 | 4.9 | 8.2 | 11.8 |
| DHS, % | — | — | — | — | — | — | 2.8 | 4.1 | 7.6 | 11.0 | 3.2 | 4.4 | 7.1 | 10.4 |
| T7, g/d | 3.97 | 3.84 | 3.56 | 3.54 | 3.54 | 3.49 | — | — | — | — | — | — | — | — |
| E8, % | 23.2 | 24.4 | 26.7 | 26.7 | 27.2 | 28.6 | 61.1 | 57.1 | 41.3 | 27.2 | 64.4 | 60.9 | 43.3 | 29.6 |
| T, g/d | 5.23 | 4.96 | 4.54 | 4.56 | 4.50 | 4.50 | 1.96 | 2.22 | 2.42 | 2.64 | 2.12 | 2.46 | 2.58 | 2.78 |
| DS, % | 1.9 | 1.8 | 2.0 | 2.1 | 2.1 | 2.4 | NA | → | → | → | NA | → | → | → |
| Uster, % | — | — | — | — | — | — | NA | → | → | → | NA | → | → | → |

We claim:

1. Yarns comprising fine polyester filaments of denier per filament (dpf) in the range 0.2 to 0.8, said polyester having a relative viscosity (LRV) in the range 13 to 23, a zero-shear polymer melting point ($T_M^o$) in the range 240° C. to 265° C., and a glass transition temperature ($T_g$) in the range 40° C. to 80° C.; and said yarns having the following characteristics:

(a) tenacity-at-7%-elongation ($T_7$) in the range 0.5 to 1.75 gpd, such that the $[(T_B)_n/(T_7)]$-ratio is at least $[5/(T_7)]$, wherein $(T_B)_n$ is normalized tenacity-at-break;

(b) elongation-at-break ($E_B$) in the range 40% to 160%;

(c) boil-off shrinkage (S) less than the maximum shrinkage potential ($S_m$), wherein $Sm=[(550-E_B)/6.5]\%$;

(d) maximum shrinkage tension ($ST_{max}$) in the range 0.05 to 0.2 gpd, with a peak temperature $T(ST_{max})$ in the range 5° C. to 30° C. above the glass-transition temperature ($T_g$)

(e) an average along-end filament denier spread (DS) of no more than 4%.

2. Yarns according to claim 1, wherein the boil-off shrinkage (S) is at least 12%, the elongation-at-break ($E_B$) is in the range 80% to 160%, and the tenacity-at-7%-elongation ($T_7$) is in the range 0.5 to 1 gpd.

3. Yarns according to claim 1, wherein said polyester filaments have a shrinkage differential ($\Delta S=DHS-S$) no more than +2%, and each of the boil-off shrinkage (S) and the dry heat shrinkage (DHS) is in the range 2% to 12%, and are such that the filament denier, after shrinkage, is no more than 1; and wherein the tenacity-at-7%-elongation ($T_7$) is in the range 1 to 1.75 gpd, and the elongation-at-break ($E_B$) is in the range 40% to 90%, and a post-yield modulus ($M_{py}$) in the range 2 to 12 gpd.

4. Yarns according to claim 1 having the capability of being uniformly cold drawn, wherein said polyester filaments have a shrinkage differential ($\Delta S=DHS-S$) no more than +2%, and each of the boil-off shrinkage (S) and the dry heat shrinkage (DHS) is in the range 2% to 12%, and having a temperature of onset of cold crystallization $T_c$(DSC) of no more than 105° C. and an instantaneous tensile modulus at least 0.

5. Yarns comprising fine polyester filaments of denier per filament (dpf) after boil-off shrinkage in the range 0.2 to 0.8 dpf, said polyester having a relative viscosity (LRV) in the range 13 to 23, a zero-shear polymer melting point ($T_M^o$) in the range 240° C. to 265° C., and a glass-transition temperature ($T_g$) in the range 40° C. to 80° C.; and said yarns having the following characteristics:

(i) boil-off shrinkage (S) and dry heat shrinkage (DHS) in the range of 2% to 12%;

(ii) Tenacity-at-7%-elongation ($T_7$) at least 1 gpd, such that the $[(T_B)n/(T_7)]$-ratio is at least $[5/(T_7)]$, wherein $(T_B)n$ is normalized tenacity-at-break, and elongation-at-break ($E_B$) in the range 15% to 55%;

(iii) post-yield modulus ($M_{py}$) in the range 5 to 25 gpd;

(iv) an average along-end filament denier spread (DS) no more than 4%.

6. Yarns comprising fine polyester filaments of denier per filament (dpf) in the range 0.2 to 0.8 dpf, after boil-off shrinkage, said polyester having a relative viscosity (LRV) in the range 13 to 23, a zero-shear polymer melting point ($T_M^o$) in the range 240° C. to 265° C., and a glass-transition temperature ($T_g$) in the range 40° C. to 80° C.; said yarns being bulky and having the following characteristics:

(i) boil-off shrinkage (S) and dry heat shrinkage (DHS) in the range of 2% to 12%;

(ii) tenacity-at-7%-elongation ($T_7$) greater than 1 gpd, $E_B$ in the range 15% to 55% and post-yield modulus ($M_{py}$) in the range 5 to 25 gpd.

7. Yarns according to claim 5 or 6, wherein said polyester filaments have a dynamic loss modulus peak temperature $T(E''_{max})$ of no more than 115° C.

8. Yarns according to any one of claim 1, 5 or 6, wherein said polyester filaments have a relative disperse dye rate (RDDR) of at least 0.1.

9. Yarns according to any one of claims 1, 5 or 6, wherein said polyester filaments have a shape factor (SF) of at least 1.25.

10. Yarns according to claim 1 or 5, wherein said polyester filaments have an average along-end denier spread (DS) of no more than 2%.

11. Yarns according to any one of claims 1, 5 or 6, wherein said polyester contains in the range of 1 to 3 mole % of ethylene-M-sulfo-isophthalate structural units, wherein M is an alkali metal cation.

12. Yarns according to any one of claims 1, 5 or 6, wherein said polyester is essentially poly(ethylene terephthalate), composed of first alternating glycol structural units A, [—O—$C_2H_4$—O—], and di-carboxylate structural units B, [—C(O)—$C_6H_4$—C(O)—], modified with minor amounts of other structural units selected from the group consisting of glycol structural units A' and di-carboxylic structural units B', that differ from said first alternating glycol structural units A and di-carboxylate structural units B, such as to provide a polyester polymer with a zero-shear melting point ($T_M^o$) in the range 240° C. to 265° C., and a glass-transition temperature ($T_g$) in the range 40° C. to 80° C.

* * * * *